US006412232B1

(12) United States Patent
Provitola

(10) Patent No.: US 6,412,232 B1
(45) Date of Patent: Jul. 2, 2002

(54) STRUCTURAL SYSTEM OF TOROIDAL ELEMENTS AND METHOD OF CONSTRUCTION THEREWITH

(76) Inventor: Anthony Italo Provitola, P.O. Box 2855, DeLand, FL (US) 32721-2855

( * ) Notice: Subject to any disclaimer, the term of this patent is extended or adjusted under 35 U.S.C. 154(b) by 0 days.

(21) Appl. No.: 09/276,665

(22) Filed: Mar. 26, 1999

(51) Int. Cl.[7] ..... E04B 1/19

(52) U.S. Cl. ..... 52/80.1; 52/698; 52/81.1; 403/389; 403/385; 403/396

(58) Field of Search ..... 403/389, 385, 403/396; 256/59, 65; 52/698, 712, 81.1

(56) References Cited

U.S. PATENT DOCUMENTS

| | | | | | |
|---|---|---|---|---|---|
| 1,706,215 | A | * | 3/1929 | Davidson | 403/396 |
| 2,767,003 | A | * | 10/1956 | Gilmont | 403/396 |
| 3,192,668 | A | * | 7/1965 | Grieb | 52/81.1 |
| 3,197,927 | A | * | 8/1965 | Fuller | 52/81.1 |
| 3,490,638 | A | * | 1/1970 | Elliott et al. | 52/81.1 X |
| 3,524,288 | A | * | 8/1970 | Coppa | 52/81.1 |
| 3,898,777 | A | * | 8/1975 | Georgiev et al. | 52/81 |
| 3,959,937 | A | | 6/1976 | Spunt | |
| 4,001,964 | A | | 1/1977 | Hooker | |
| 4,027,449 | A | | 6/1977 | Alcalde-Civileti | |
| 4,075,813 | A | * | 2/1978 | Nalick | 52/747 |
| 4,128,104 | A | * | 12/1978 | Corey | 135/3 R |
| 4,160,345 | A | * | 7/1979 | Nalick | 52/81 |
| 4,183,190 | A | | 1/1980 | Bance | |
| 4,253,284 | A | | 3/1981 | Bliss | |
| 4,446,666 | A | | 5/1984 | Gilman | |
| 4,475,323 | A | | 10/1984 | Schwartzberg | |
| 4,856,254 | A | * | 8/1989 | Jungwirth | 52/741 |
| 4,942,700 | A | | 7/1990 | Hoberman | |
| 5,377,460 | A | * | 1/1995 | Hicks | 52/81.1 |
| 5,379,557 | A | * | 1/1995 | Kotter | 52/81.1 |
| 5,394,661 | A | * | 3/1995 | Noble | 52/167.4 |
| 5,464,987 | A | | 11/1995 | Ihara | |
| 5,704,169 | A | * | 1/1998 | Richter | 52/81.2 |
| 5,716,693 | A | | 2/1998 | Pittman | |
| 5,888,608 | A | | 3/1999 | Tsai | |
| 5,907,931 | A | * | 6/1999 | Sun | 52/81.4 |
| 6,134,849 | A | * | 10/2000 | Holler | 52/80.1 |

FOREIGN PATENT DOCUMENTS

| | | | | |
|---|---|---|---|---|
| AT | 1370202 | * | 1/1988 | 52/81.1 |
| FR | 1191776 | * | 10/1959 | 52/81.1 |
| NL | 57944 | * | 9/1967 | 52/81.1 |
| NL | 1609341 | * | 2/1978 | 52/81.1 |
| WO | WO941/13896 | * | 10/1959 | 52/81.1 |

* cited by examiner

*Primary Examiner*—Carl D. Friedman
*Assistant Examiner*—Phi Dieu Tran A

(57) ABSTRACT

A structural system of connected toroidal elements for all types of structures of all sizes, wherein such toroidal elements may be connected in level layers which may in turn be connected in stacks to form towers, domical and spherical structures, and connected in the forms of regular polyhedra to form domical and spherical structures. Structures may be constructed of frameworks formed by connected toroidal elements of various sizes and shapes.

51 Claims, 60 Drawing Sheets

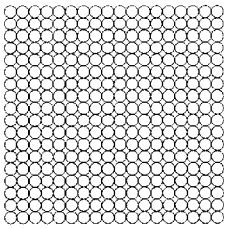
FIG. 308
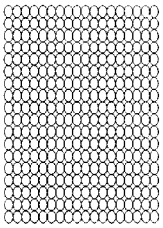
FIG. 309
FIG. 310
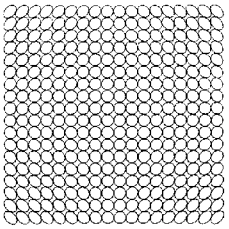
FIG. 311
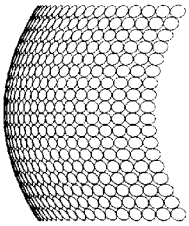
FIG. 312
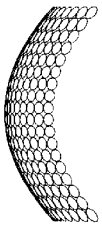
FIG. 313
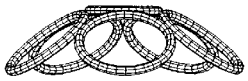
FIG. 314
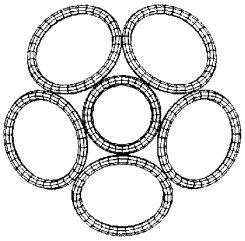
FIG. 315
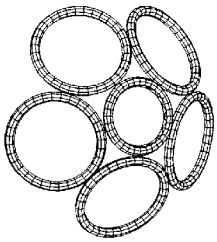
FIG. 316
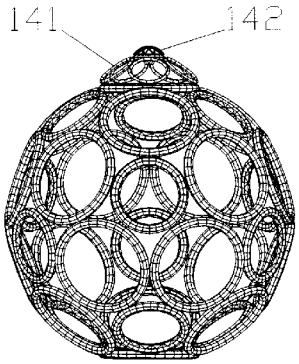
FIG. 317
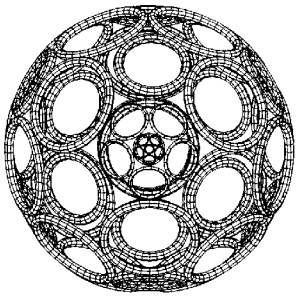
FIG. 318
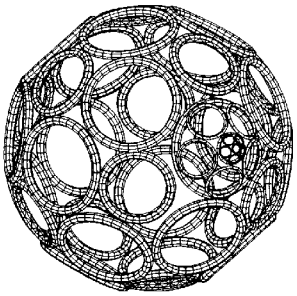
FIG. 319

STRUCTURAL SYSTEM OF TOROIDAL ELEMENTS AND METHOD OF CONSTRUCTION THEREWITH

CROSS-REFERENCE TO RELATED APPLICATIONS

This application is related to the application for the invention entitled "Structural System of Torsion Elements and Method of Construction Therewith", application Ser. No. 09/276,666, by the same inventor filed on Mar. 26, 1999, the same date and immediately before this application, "Structural System of Toroidal Elements and Method of Construction Therewith", application Ser. No. 09/276,665. In this connection it is to be noted that the preferred embodiment of the present invention uses the invention entitled "Structural System of Torsion Elements and Method of Construction Therewith", and the preferred embodiment of the invention entitled "Structural System of Torsion Elements and Method of Construction Therewith" uses the present invention.

STATEMENT REGARDING FEDERALLY SPONSORED RESEARCH OR DEVELOPMENT

Not Applicable

REFERENCE TO MICROFICHE APPENDIX

Not Applicable

BACKGROUND OF THE INVENTION

A significant advance in basic structural systems for stationary structures has not occurred since the advent of prestressed and reinforced concrete, structural steel, and the use of cable as a tensional element. There have been some innovative engineering and architectural advances, such as various types of folding structures, tube and ball and other space trusses and the dymaxion concept. However, none of these advances has escaped the use of conventional structural elements in compression, tension and flexion mode. Although there have been more recent developments in the field of vehicular structure, such as formed sheet rigidification, the fundamental methods have not changed significantly from the rigid rib, stringer, and truss design. The present invention is a significant advance in structural systems, both stationary and moveable, with respect to weight, strength, flexibility and magnitude.

There does not appear to be any prior art that his invention builds upon except generally in the field of structural engineering, none of which directly addresses structural combinations of toroidal elements.

The patent classification system does not contain a classification for structural systems as such, the most appropriate description of the present invention, but does address specific types of structures, such as "static structures" (Class 52), "bridges" (Class 14), "railway rolling stock" (105/396+), "ships" (114/65+), "aeronautics" (244/117+), "land vehicles bodies and tops" (296/) etc. There are also no classifications for structures which are dynamic in managing the stress of structural elements or for structures which can dynamically change shape or volume. The latter of these may be addressed to a certain extent in Class/Subclass 52/109, which allows for the extension and retraction of a structure by the use of pivoted diagonal levers, or in Class/Subclass 52/160, which covers closures and other panels made of flexible material, With respect to toroidal structural elements, no structural classification could be found.

Therefore, at least with respect to the extent that the classification system may reveal such, there does not appear to be prior art described therein. However, there are some superficial graphic similarities involving shapes and forms to be found in certain patents that claim inventions that are confined to specific structural forms.

There are two United States Patents that disclose structures that utilize ring or circular elements. One is the Ring Structure disclosed by U.S. Pat. No. 4,128,104 which is "a structural framework composed of ring members intersecting one another in a particular manner". The other is the Modular Dome Structure, U.S. Pat. No. 3,959,937, which is comprised of "ring-shaped" elements of equal size which form a dome when connected in a particular manner. That disclosure is restricted to "improved building construction for domes or other spherical frames", and does not teach a universal structural system.

Otherwise, there does not appear to be any prior art involving the structural use of toroidal elements which are designed to be load bearing.

BRIEF SUMMARY OF THE INVENTION

The present invention is a structural system which employs "toroidal elements", structural elements which are toroidal in shape, which are connected to form structures, and a method of construction therewith. The structural system of toroidal elements may be used to create new structural forms for both stationary and moveable structures. Some of the structural forms can be applied to construct buildings for unstable foundation conditions and which can survive foundation movement and failure. The use of toroidal elements may also be applied to create structures which are dynamic, with the constituent elements capable of movement by design, not only by deflection as a result of loading, but also by the active management of structural stresses. Toroidal elements may also be varied in shape dynamically so as to achieve alteration of the shape, size and volume of the structure of which they are constituent. The use of the invention includes every conceivable structure, from the smallest to the largest, nanostructures, bridges, towers, furniture, aircraft, land and sea vehicles, appliances, instruments, buildings, spacecraft, and planetary and space habitats.

The present invention also contemplates that structures comprised of connected toroidal elements may be incorporated in yet other structures that also have conventional structural elements. The preferred embodiment of the present invention employs toroidal elements which are torsion elements or are constructions of torsion elements.

The method of construction of structures using the present invention is also disclosed through numerous drawings of combinations and arrays of connected toroidal elements.

BRIEF DESCRIPTION OF THE DRAWINGS

FIG. 172 is a cutaway perspective view of the toroidal element in FIG. 111.

FIG. 173 is a cutaway side view of the toroidal element in FIG. 171.

FIG. 174 is a cutaway plan view of a hexagonal toroidal element with 2 internal shafts, one in each opposing half of the hexagon.

Figure 174:
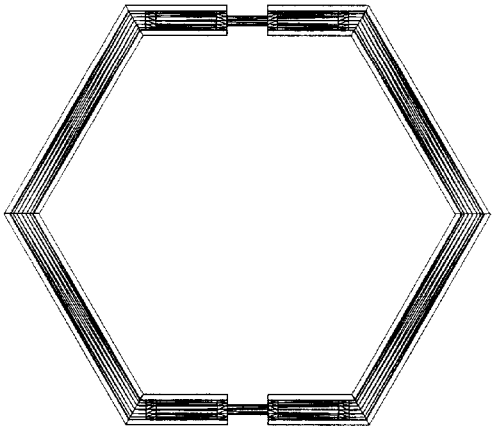
Figure 175:
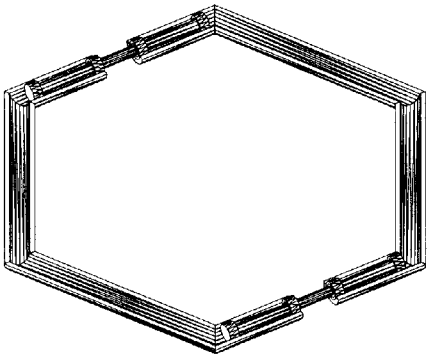

FIG. 175 a cutaway perspective view of the toroidal element in FIG. 174.

Figure 171:
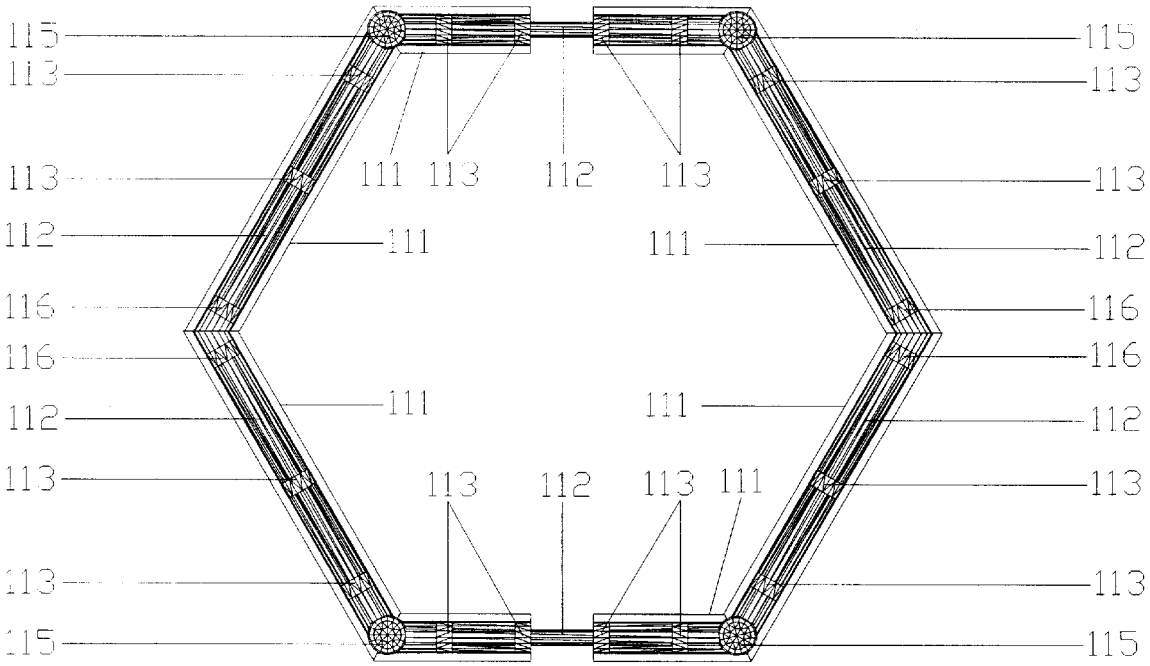
FIG. 171 is a cutaway plan view of a hexagonal toroidal element with 2 sets of 3 rotationally joined internal shafts, one in each opposing half of the hexagon.
Figure 176:
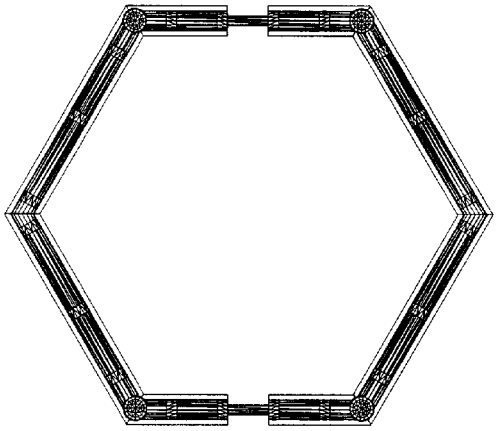

FIG. 176 is a cutaway plan view of a hexagonal toroidal element with 2 sets of 3 rotationally joined internal shafts, one in each opposing half of the hexagon (same as FIG. 171).

Figure 172:
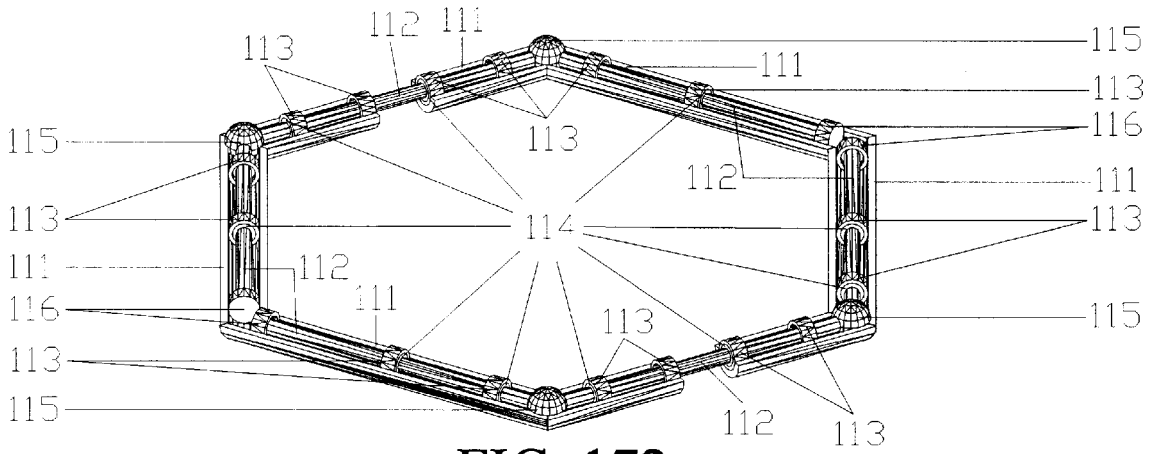
Figure 177:
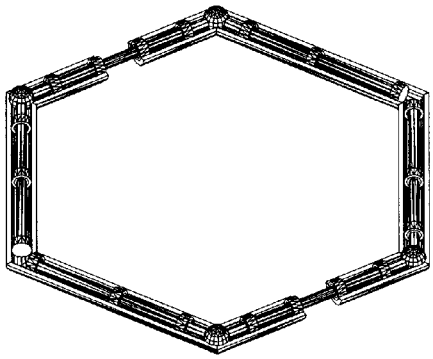

FIG. 177 is a cutaway perspective view of the toroidal element in FIG. 176 (same as FIG. 172).

Figure 178:
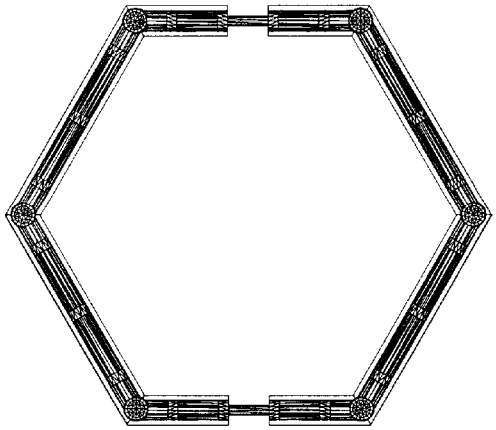

FIG. 178 is a cutaway plan view of a hexagonal toroidal element with 6 internal shafts, all rotationally joined.

Figure 179:
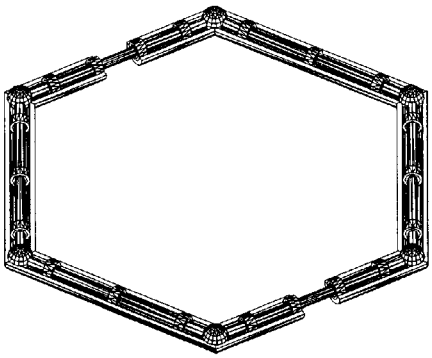

FIG. 179 is a cutaway perspective view of the toroidal element in FIG. 178.

Figure 169:
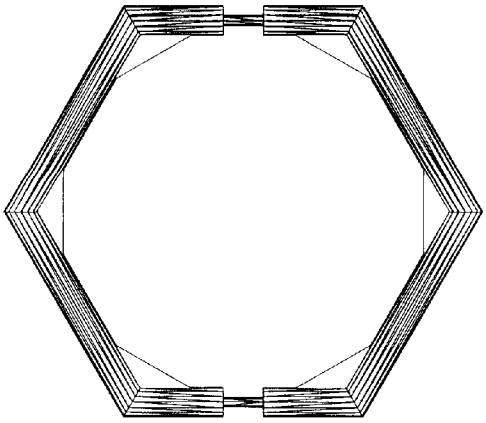
FIG. 169 is a plan view of the toroidal element shown in FIG. 167 with interior corner bracing.
Figure 180:
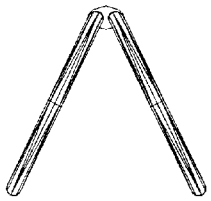

FIG. 180 is a side view of two hexagonal toroidal elements shown in FIG. 169 angularly connected by one coupling.

Figure 181:
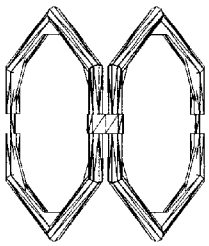

FIG. 181 is a plan view of the two toroidal elements in FIG. 180.

Figure 182:
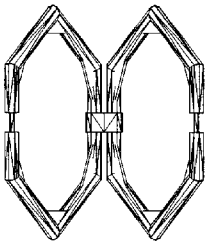

FIG. 182 is a bottom view of the two toroidal elements in FIG. 180

Figure 183:
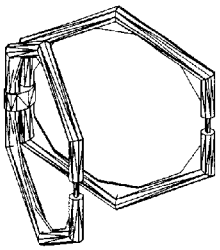

FIG. 183 is a perspective view of the toroidal elements in FIG. 180.

Figure 184:
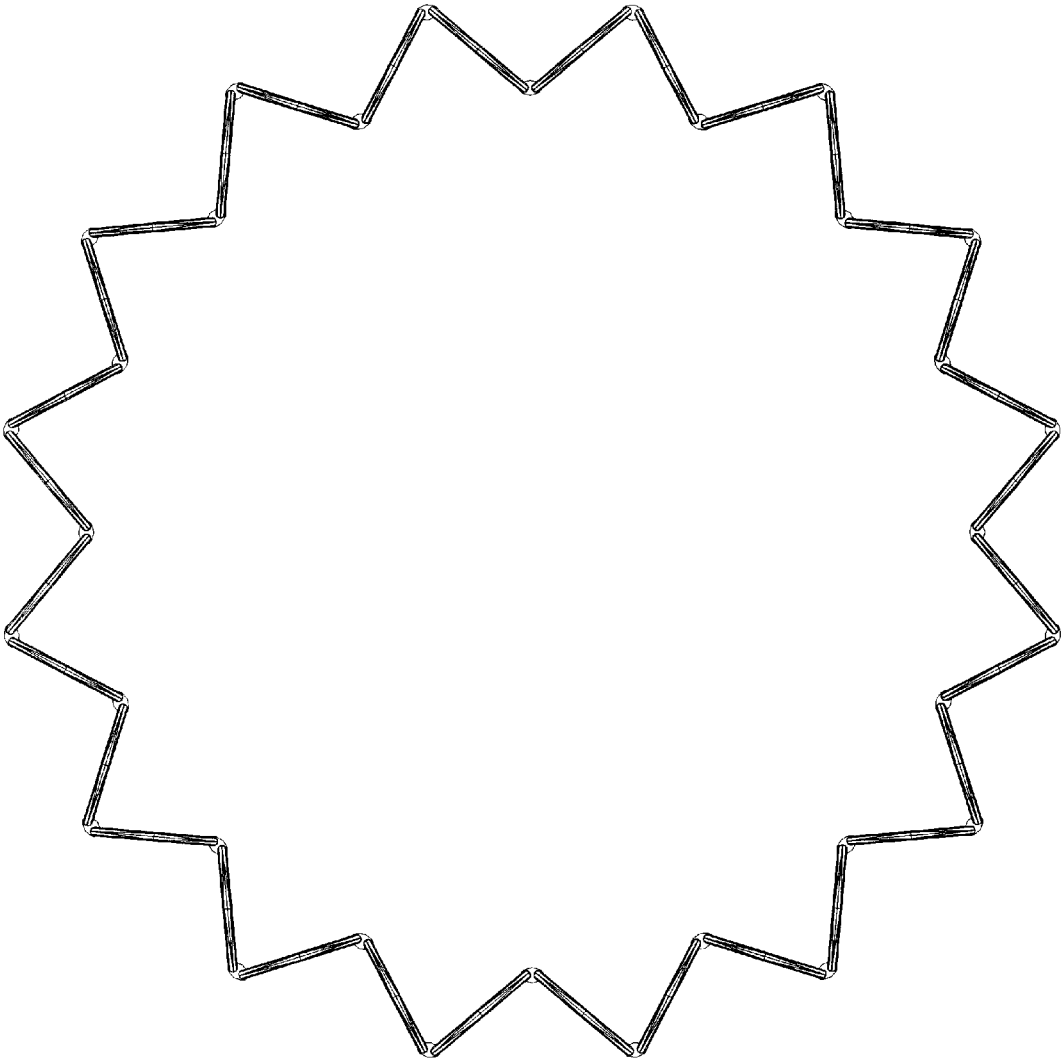

FIG. 184 a plan view of 16 pairs of hexagonal toroidal elements as shown in FIG. 180 connected to form a toroid.

Figure 185:
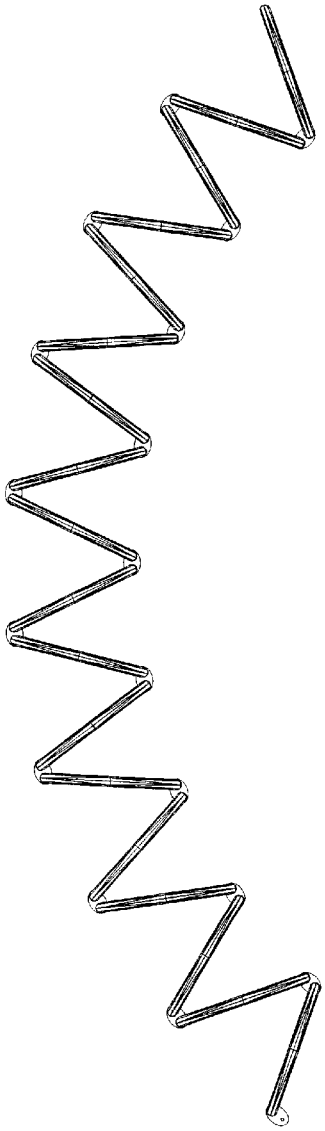

FIG. 185 is a plan view of a part (approximately one-quarter) of a circular array of 32 pairs of hexagonal toroidal elements as shown in FIG. 184.

Figure 186:
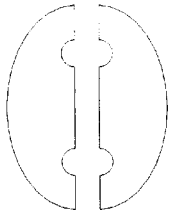
Figure 187:
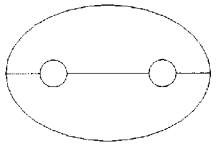

FIGS. 186 and 187 are plan views of a two element coupling for polygonal toroids with axles showing, respectively, the coupling open and the coupling closed.

Figure 188:
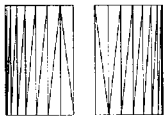
Figure 189:
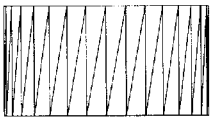

FIGS. 188 and 189 are side views of the coupling in FIGS. 186 and 187 showing, respectively, the coupling open and the coupling closed.

Figure 190:
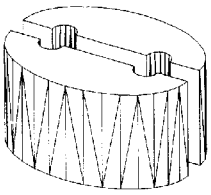
Figure 191:
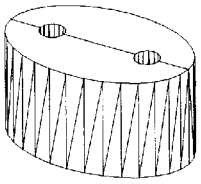

FIGS. 190 and 191 are perspective views of the coupling in FIGS. 186 and 187 showing, respectively, the coupling open and the coupling closed.

Figure 192:
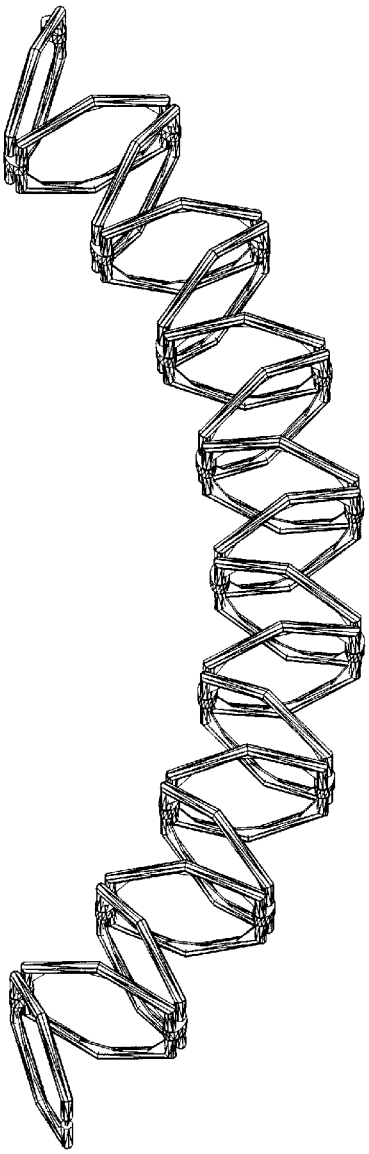

FIG. 192 is a perspective view of the partial circular array shown in FIG. 185.

Figure 193:
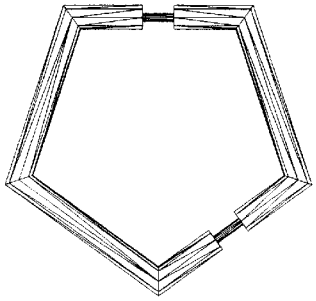

FIG. 193 is a plan view of a pentagonal toroidal element with internal shafts.

Figure 194:
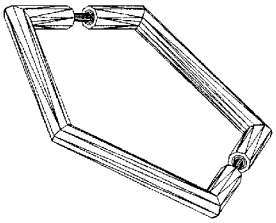

FIG. 194 is a perspective view of the toroidal element in FIG. 193.

Figure 195:
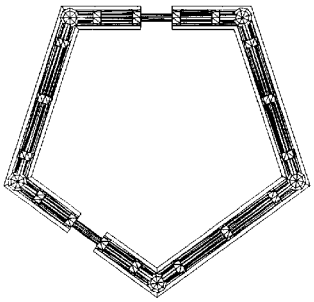

FIG. 195 is a cutaway plan view of a pentagonal toroidal element, as shown in FIG. 193, with 5 internal shafts, all rotationally joined.

Figure 196:
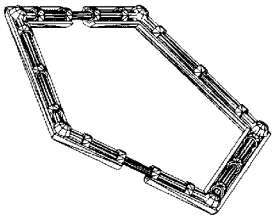

FIG. 196 is a cutaway perspective view of the toroidal element in FIG. 195.

Figure 197:
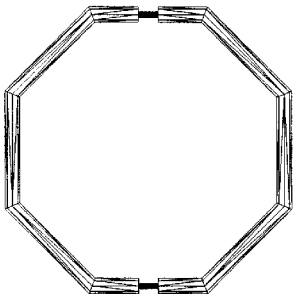

FIG. 197 is a plan view of a octagonal toroidal element with internal shafts.

Figure 198:
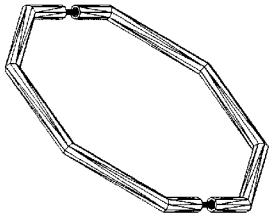

FIG. 198 is a perspective view of the toroidal element in FIG. 197.

Figure 199:
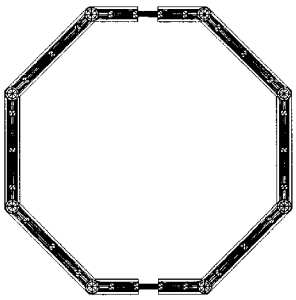

FIG. 199 is a cutaway plan view of an octagonal toroidal element, as shown in FIG. 197, with 8 internal shafts, all rotationally joined.

Figure 200:
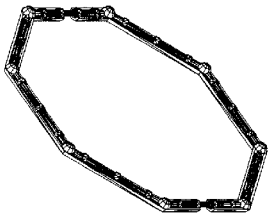

FIG. 200 is a cutaway perspective view of the toroidal element in FIG. 199.

Figure 201:
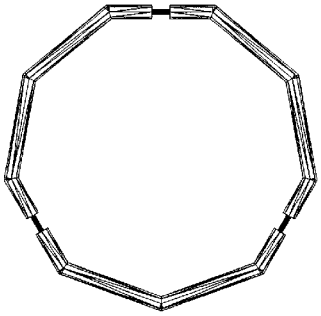

FIG. 201 is a plan view of a nonagonal toroidal element with internal shafts.

Figure 202:
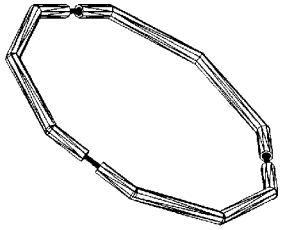

FIG. 202 is a perspective view of the toroidal element in FIG. 201.

Figure 203:
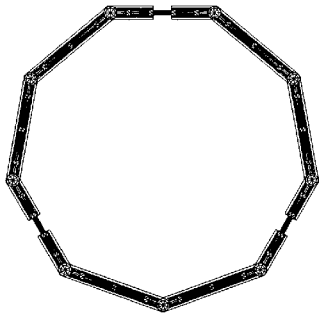

FIG. 203 is a cutaway plan view of a nonagonal toroidal element, as shown in FIG. 201, with 9 internal shafts, all rotationally joined.

Figure 204:
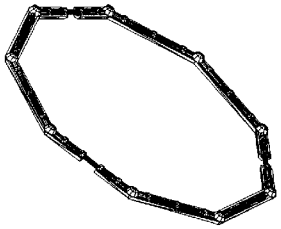

FIG. 204 is a cutaway perspective view of the toroidal element in FIG. 203

Figure 205:
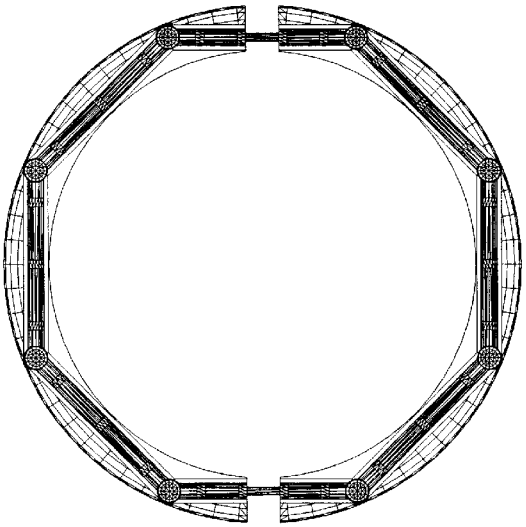

FIG. 205 is a cutaway plan view of a circular toroidal element with internal shafts rotationally joined in an octagonal core.

Figure 206:
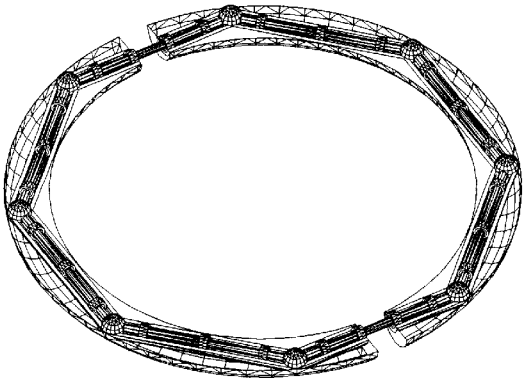

FIG. 206 is a cutaway perspective view of the toroidal element shown in FIG. 205.

Figure 12:
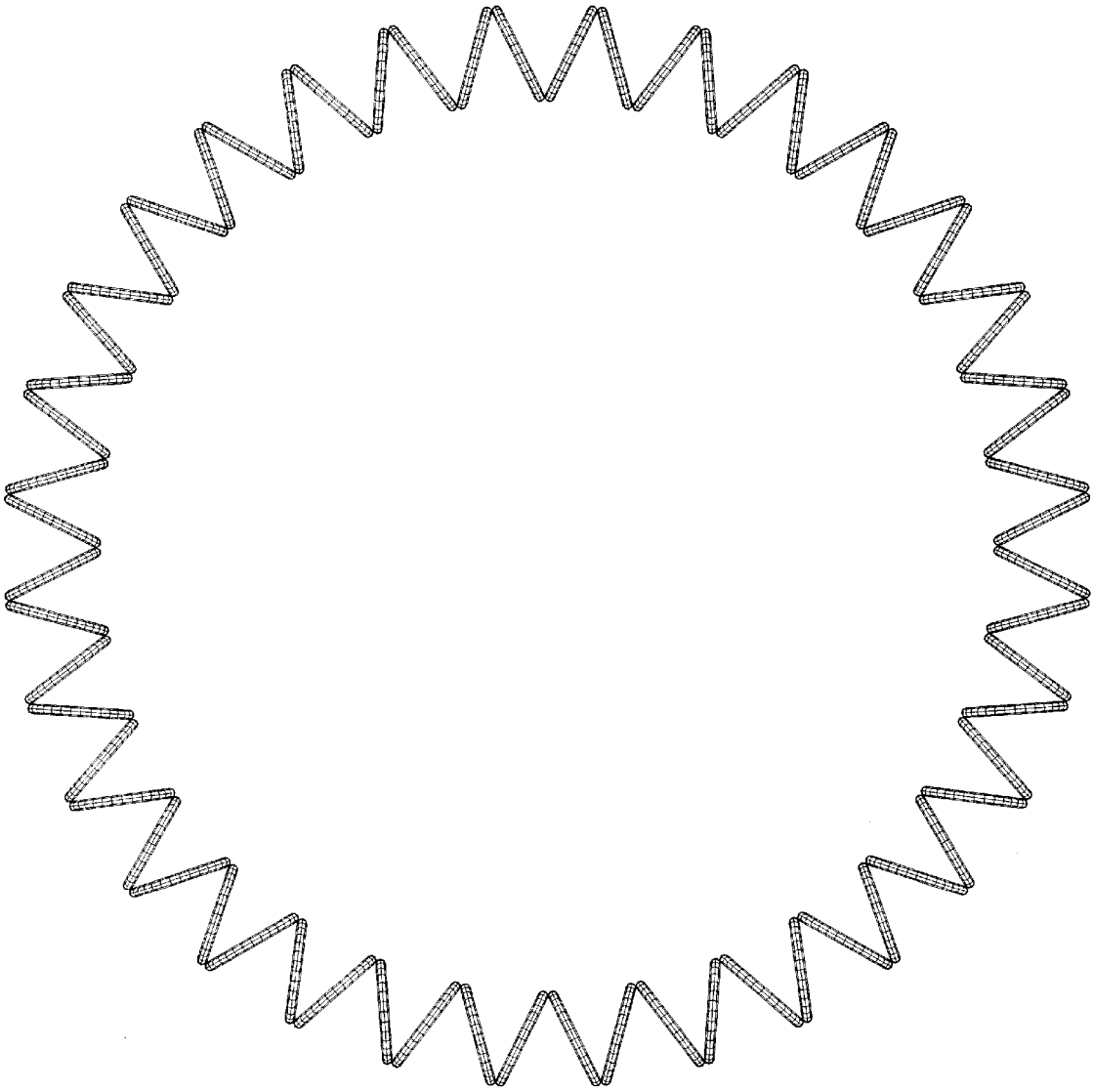
FIG. 12 is a plan view of 32 pairs of toroidal torsional elements shown in FIG. 9 connected in a circular array forming a toroid.
Figure 13:
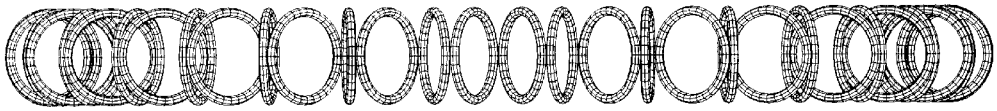
FIG. 13 is a side view of the toroid formed by the circular array shown in FIG. 12.
Figure 14:
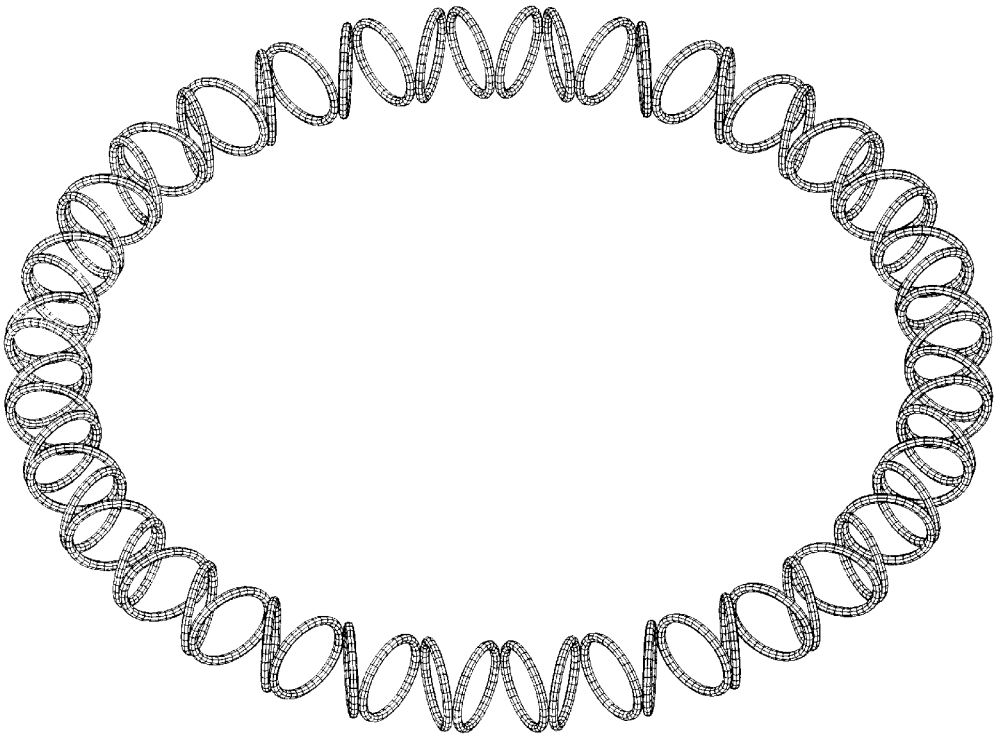
FIG. 14 is a perspective view of the toroid formed by the circular array shown in FIG. 12.
Figure 207:
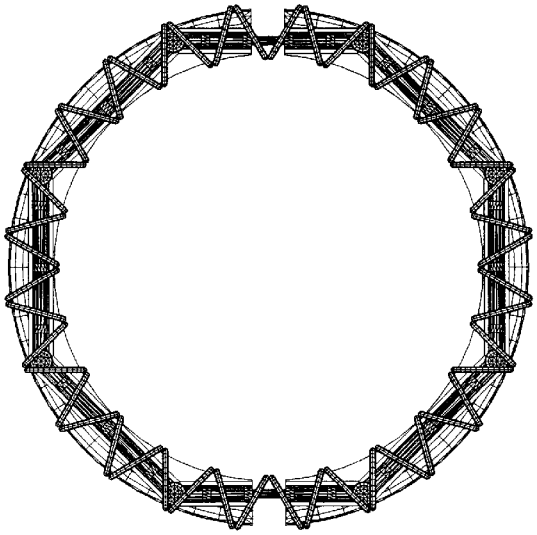

FIG. 207 is a plan view of the toroidal element shown in FIG. 205 the tube of which is enclosed by the tube of another toroidal element of the type shown in FIG. 12 but with 24 pairs of elements.

Figure 208:
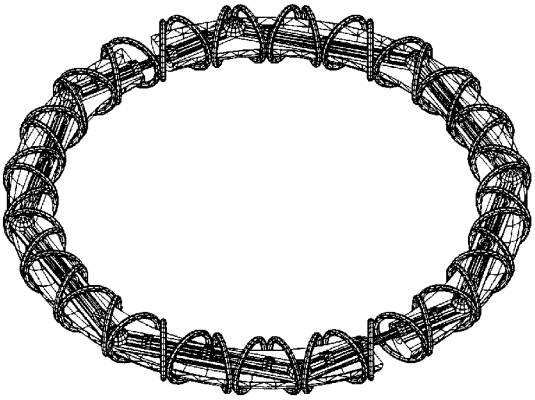

FIG. 208 is a perspective view of the toroidal element shown in FIG. 207.

Figure 15:
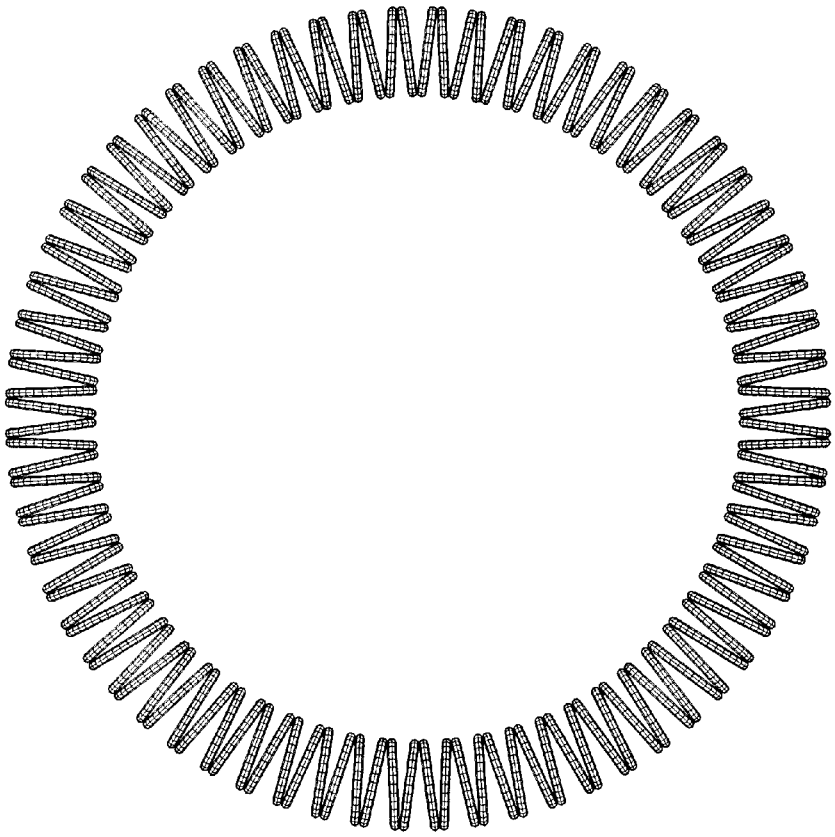
FIG. 15 is a plan view of 64 pairs of angularly connected toroidal torsional elements connected in a circular array forming a toroid.
Figure 209:
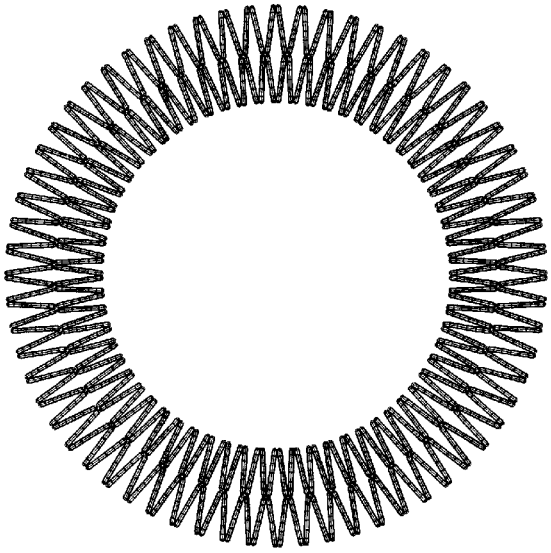

FIG. 209 is a plan view of a toroidal element as shown in FIG. 15 connected to a similar concentric toroidal element within it, the radii of the tubes of the inner and outer toroidal elements being equal.

Figure 210:
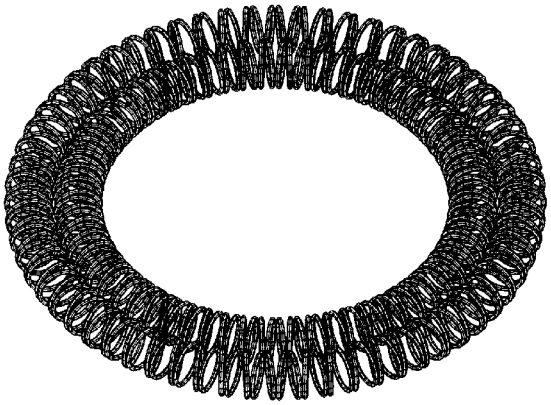

FIG. 210 is a perspective view of the toroid structure in FIG. 209.

Figure 211:
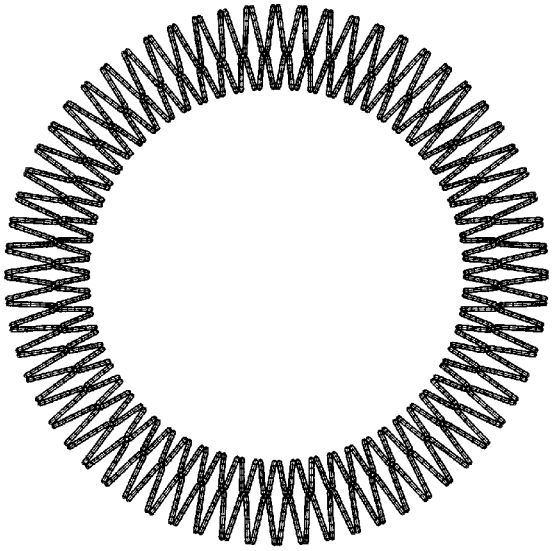

FIG. 211 is a plan view of a toroidal element as shown in FIG. 15 connected to a similar concentric toroidal element within it, the angulation of the inner and outer pairs of toroidal elements being equal.

Figure 212:
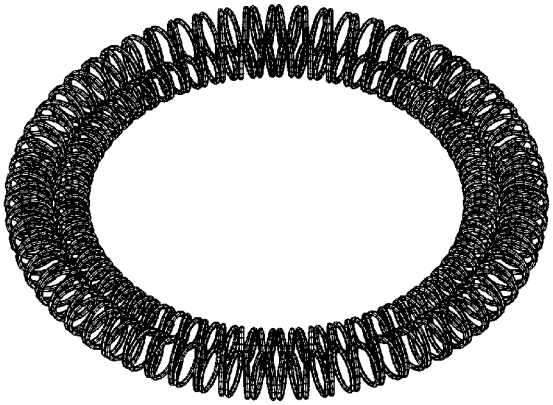

FIG. 212 is a perspective view of the toroid structure in FIG. 211.

Figure 213:
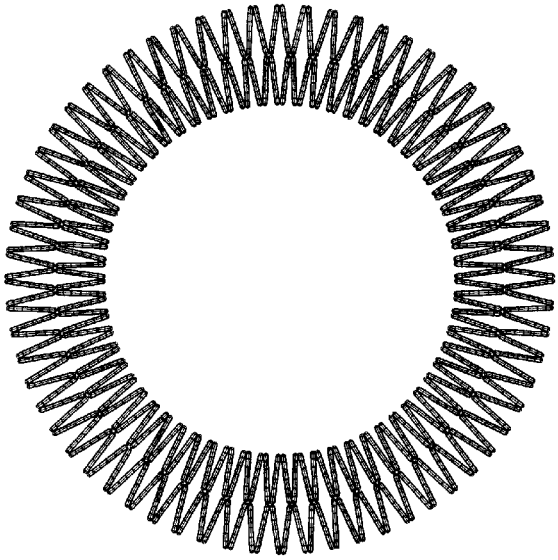

FIG. 213 is a plan view of a toroidal element as shown in FIG. 15 connected to a similar concentric toroidal element within it, the radii of the toroidal elements comprising the inner and outer toroidal elements being equal.

Figure 214:
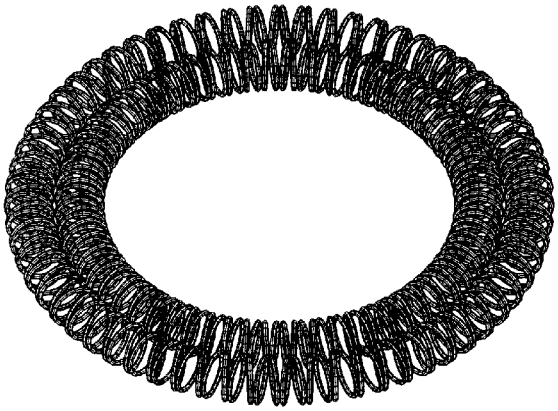

FIG. 214 is a perspective view of the toroid structure in FIG. 213.

Figure 25:
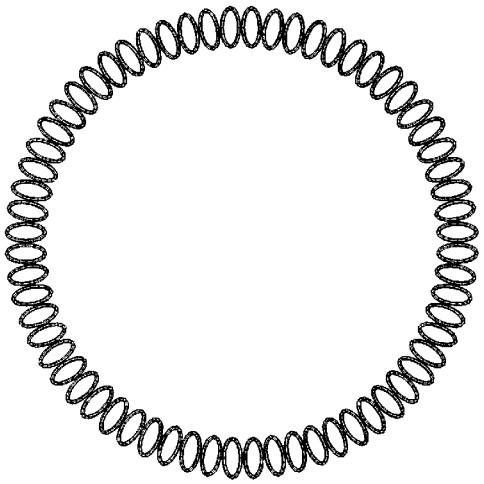
FIG. 25 is a plan view of a toroid formed by 32 pairs of the angularly connected toroidal torsional elements oriented as shown in FIG. 10 connected in a circular array.
Figure 28:
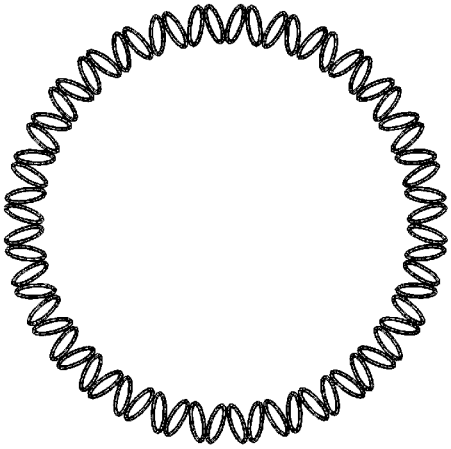
FIG. 28 is a plan view of a toroid formed by 32 pairs of the angularly connected toroidal torsional elements oriented at an angle of about 45 degrees in rotation about the axis arrow shown in FIG. 10 connected in a circular array.
Figure 26:
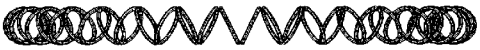
FIG. 26 i a side view of the toroid formed by the circular array shown in FIG. 25.
Figure 29:
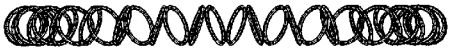
FIG. 29 is a side view of the toroid formed by the circular array shown in FIG. 28.
Figure 27:
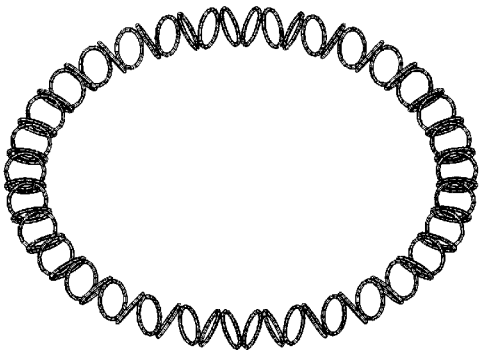
FIG. 27 is a perspective view of the toroid formed by the circular array shown in FIG. 25.
Figure 30:
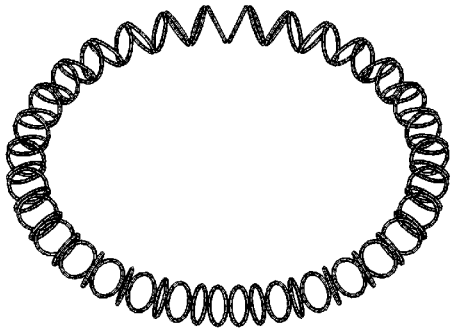
FIG. 30 is a perspective view of the toroid formed by the circular array shown in FIG. 28.
Figure 215:
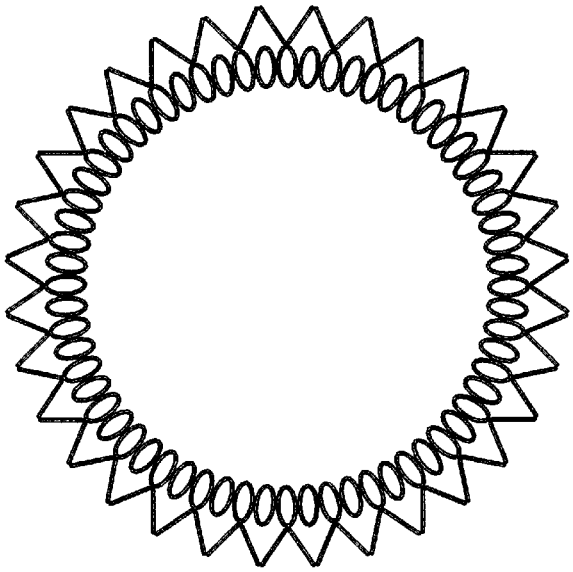

FIG. 215 is a plan view of a toroidal element as shown in FIG. 12 connected to a concentric inner toroidal element as shown in FIG. 25.

Figure 216:
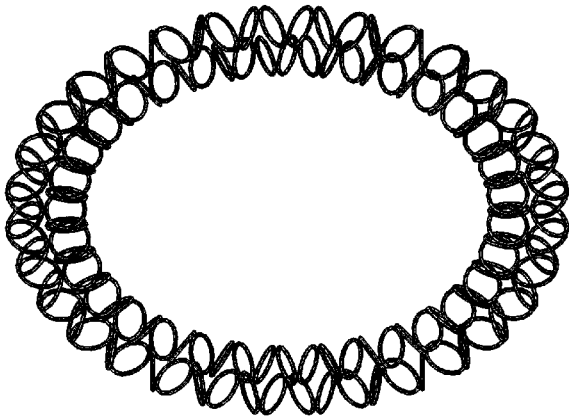

FIG. 216 is a perspective view of the toroid structure in FIG. 215.

Figure 217:
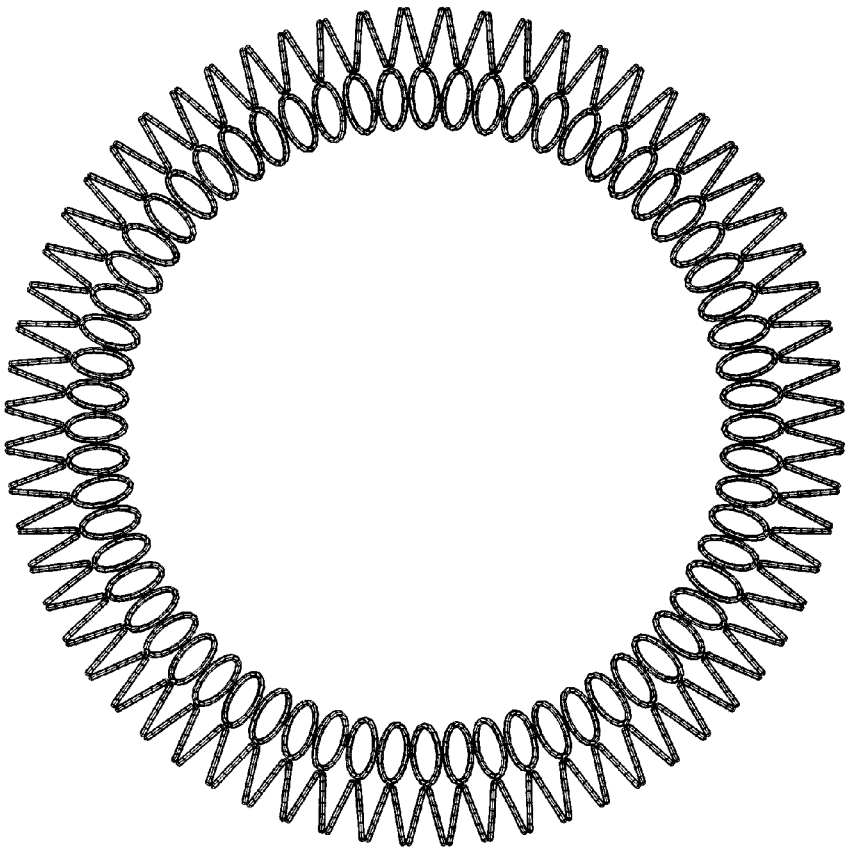

FIG. 217 a plan view of a toroidal element as shown in FIG. 15 connected to a concentric inner toroidal element as shown in FIG. 25.

Figure 218:
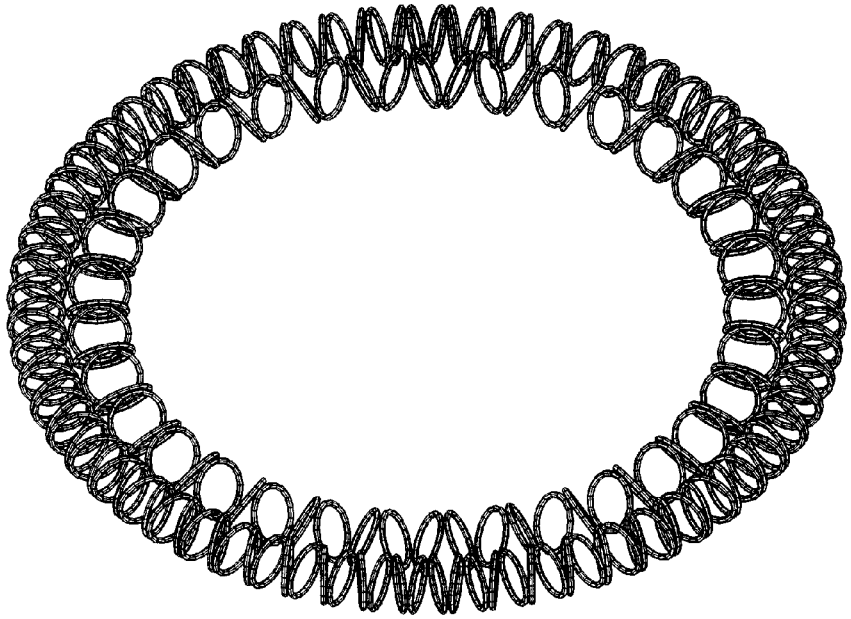
Figure 219:
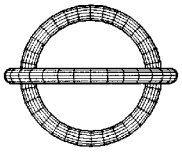
Figure 220:
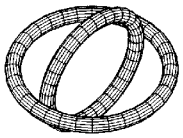
Figure 221:
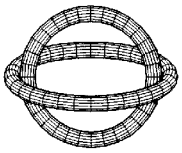
Figure 222:
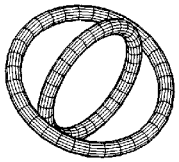
Figure 223:
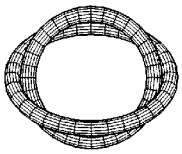
Figure 224:
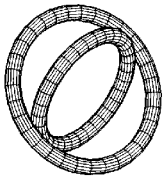
Figure 225:
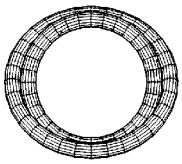
Figure 226:
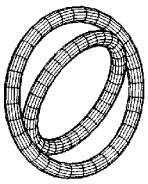
Figure 227:
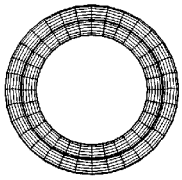
Figure 228:
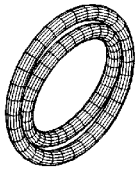

FIG. 218 is a perspective view of the toroid structure in FIG. 217.

FIGS. 219 through 228 show various concentric connections of two toroidal elements at different angles (even numbered showing the plan view and odd numbered showing a perspective view).

Figure 229:
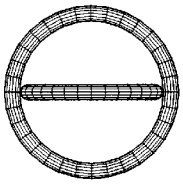
Figure 230:
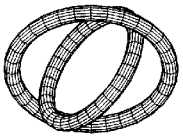
Figure 231:
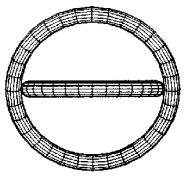
Figure 232:
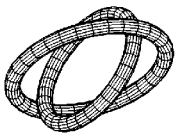
Figure 233:
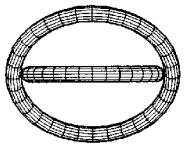
Figure 234:
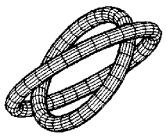
Figure 235:
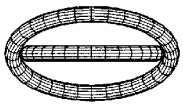
Figure 236:
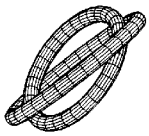
Figure 237:
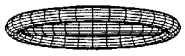
Figure 238:
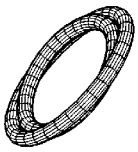

FIGS. 229 trough 238 show the various concentric connections of the toroidal elements shown in FIGS. 219 through 228 with the pairs rotated 90 degrees about the horizontal (even numbered showing the side (rotated) view and odd numbered showing a further perspective view).

Figure 239:
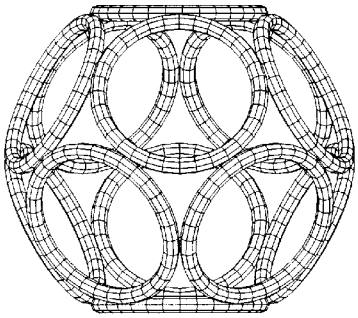

FIG. 239 is a side view of a spherical/icosohedral structure comprised of twelve connected toroidal elements.

Figure 240:
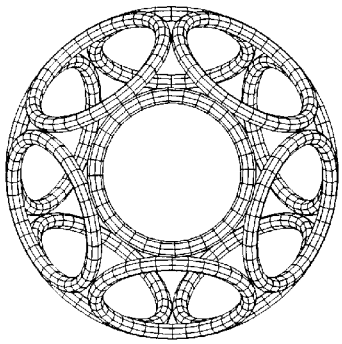

FIG. 240 is a plan view of the structure shown in FIG. 239.

Figure 241:
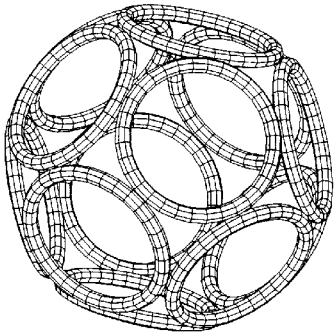

FIG. 241 is a perspective view of the structure shown in FIG. 239.

Figure 242:
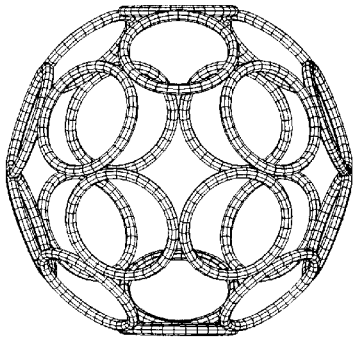

FIG. 242 is a side view of a spherical/dodecahedral structure comprised of twenty connected toroidal elements.

Figure 243:
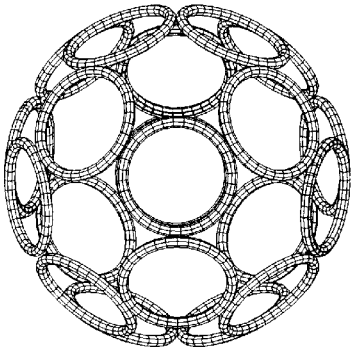

FIG. 243 is a plan view of the structure shown in FIG. 242.

Figure 244:
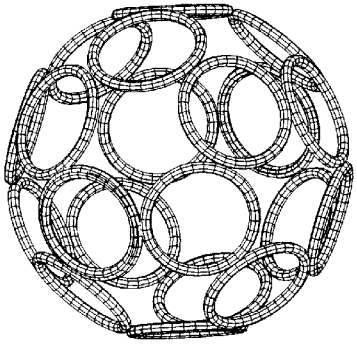

FIG. 244 is a perspective view of the structure shown in FIG. 242.

Figure 245:
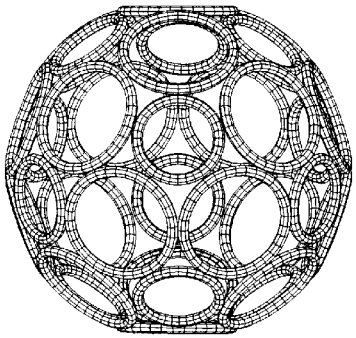

FIG. 245 is a side view of the structure shown in FIG. 242 with the gaps bridged by toroidal elements of lesser diameter.

Figure 246:
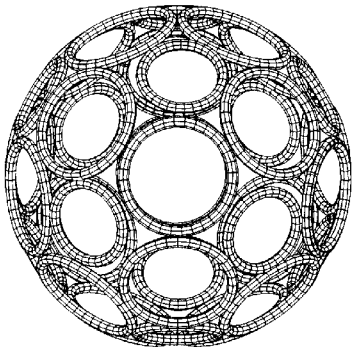

FIG. 246 is a plan view of the structure shown in FIG. 245.

Figure 247:
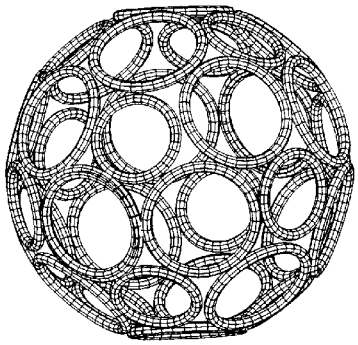

FIG. 247 is a perspective view of the structure shown in FIG. 245.

Figure 152:
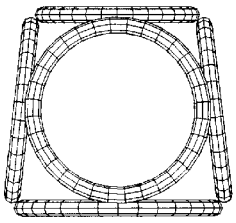
Figure 154:
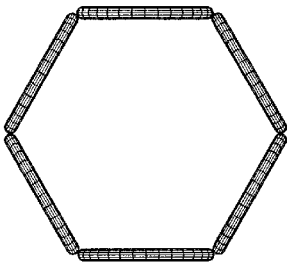
Figure 248:
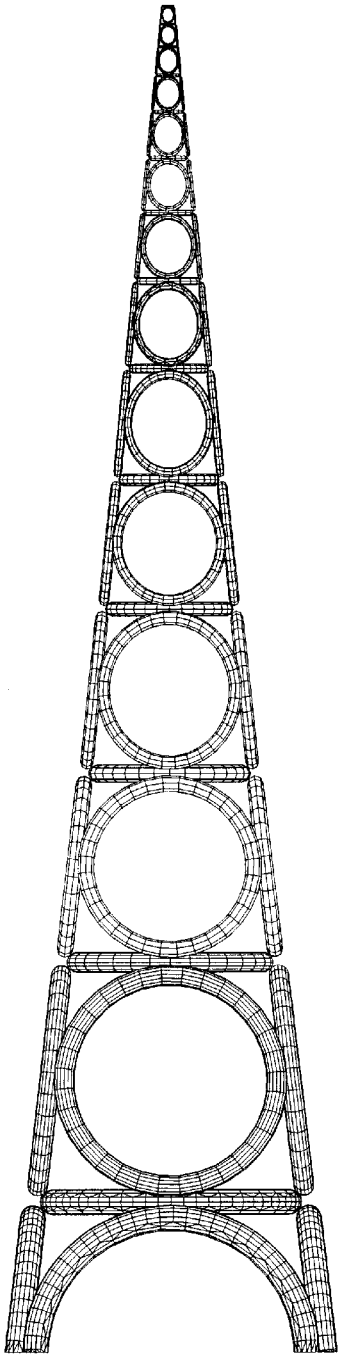

FIG. 248 is an elevation of a tower structure formed by a vertical array of connected prismatic structural modules as shown in FIG. 152 of upwardly diminishing dimension.

Figure 249:
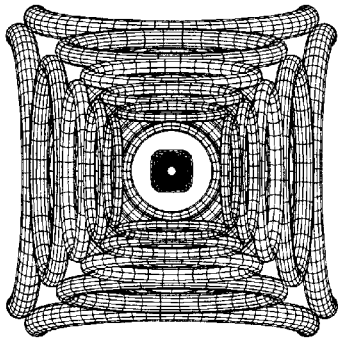

FIG. 249 is a plan view of the structure shown in FIG. 248.

Figure 250:
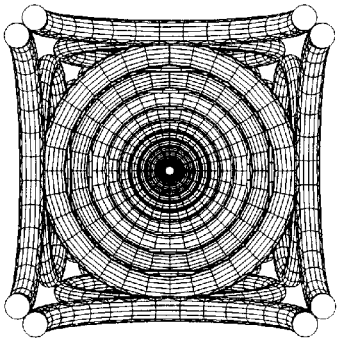
Figure 251:
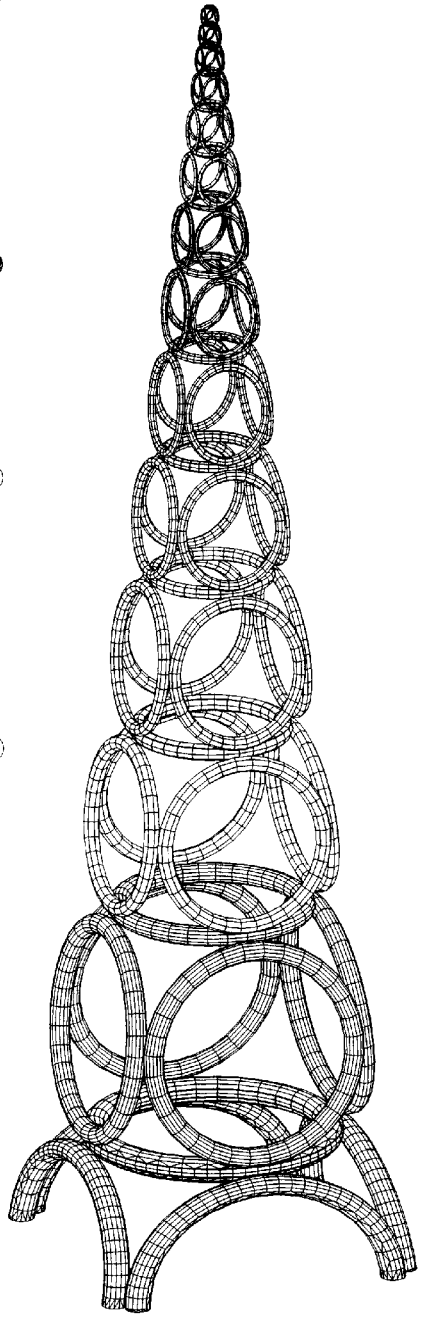

FIG. 250 is a bottom view of the structure shown in FIG. 248,

FIG. 251 is a perspective view of the structure shown in FIG. 248.

Figure 252:
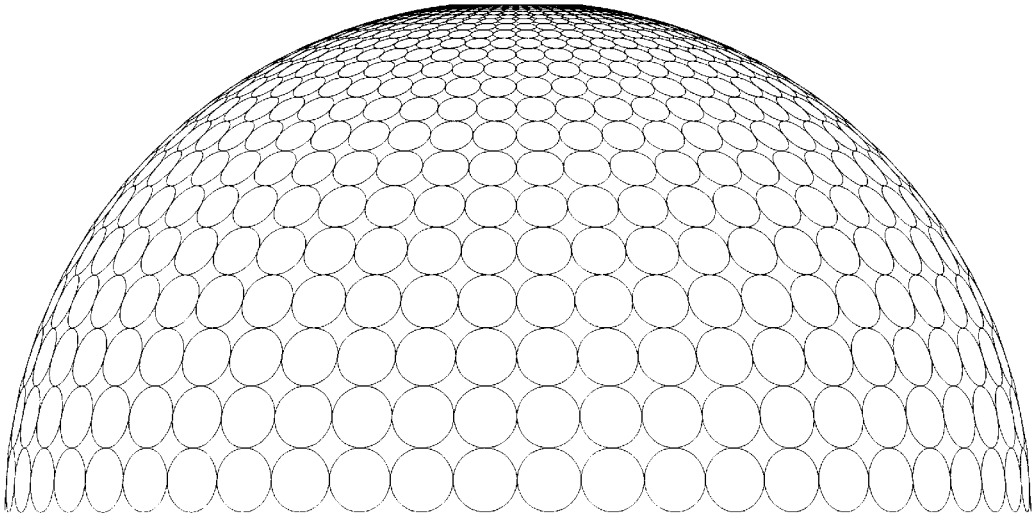

FIG. 252 is a schematic elevation of a dome structure formed by successive layers of equal numbers of toroidal elements of upwardly diminishing diameter, each toroidal element connected at four points to those adjacent.

Figure 253:
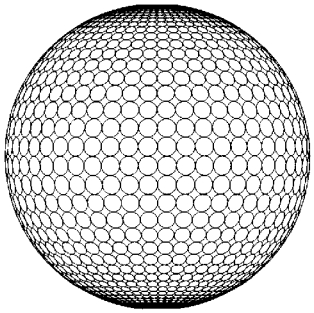

FIG. 253 is a schematic elevation of a spherical structure formed by two of the dome structures shown in FIG. 252 connected in opposite polar orientation.

Figure 254:
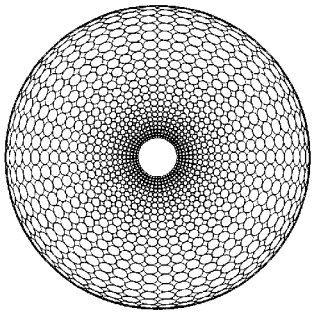

FIG. 254 is a schematic plan view of the spherical structure in FIG. 253.

Figure 255:
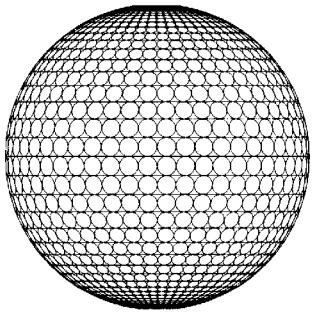
Figure 256:
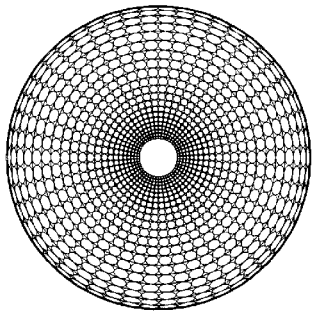

FIG. 255 is a schematic elevation of a spherical structure as shown in FIG. 253 with the toroidal elements within each layer connected to other layers via intermediate latitudinal toroidal elements FIG. 256 is a schematic plan view of the spherical structure in FIG. 255.

Figure 257:
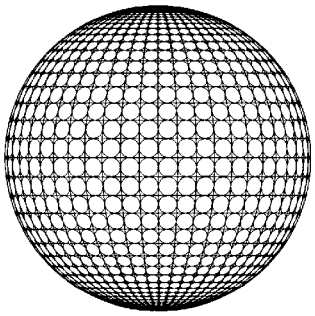

FIG. 257 is a schematic elevation of a spherical structure as shown in FIG. 255 with the toroidal elements connected to the left and right via intermediate longitudinal toroidal elements.

Figure 258:
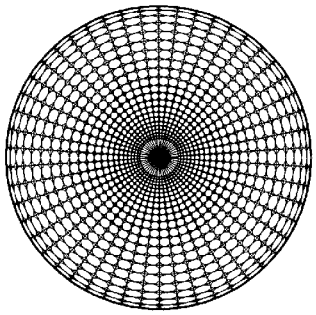

FIG. 258 is a schematic plan view of the spherical structure in FIG. 257.

Figure 259:
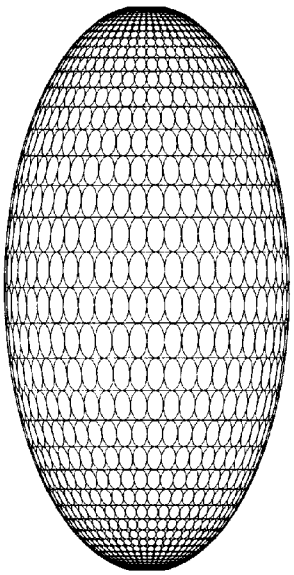

FIG. 259 is a schematic elevation of a prolate spherical structure of the same type as the spherical structure shown in FIG. 255.

Figure 260:
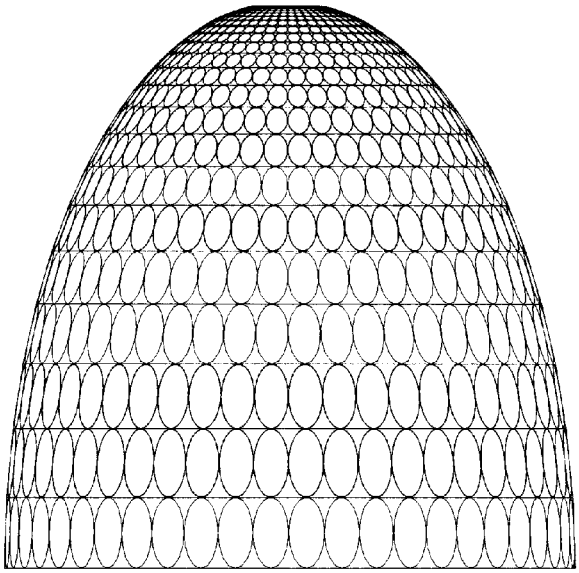

FIG. 260 is a schematic elevation of a prolate spherical dome structure identical with the upper half of the prolate spherical structure shown in FIG. 259.

Figure 261:
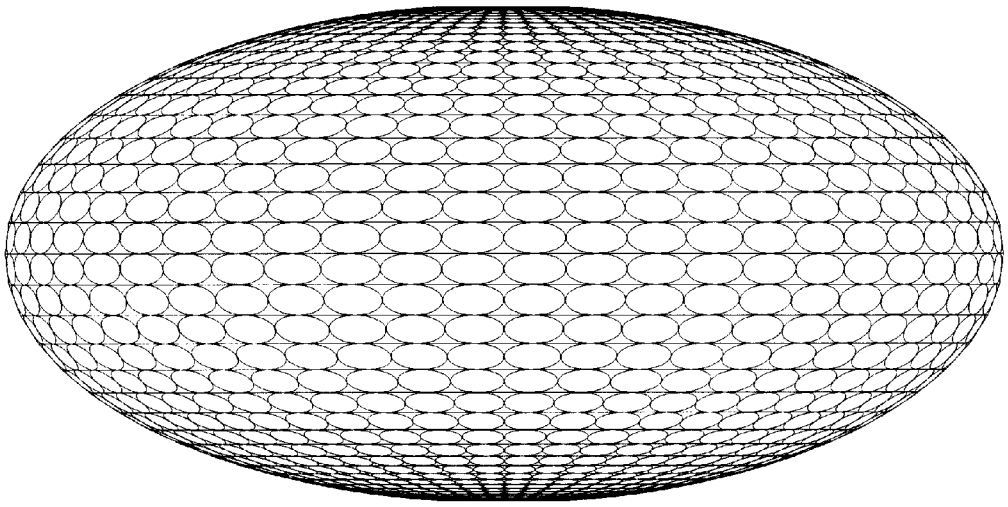

FIG. 261 is a schematic elevation of an oblate spherical structure of the same type as the spherical structure shown in FIG. 255.

Figure 262:
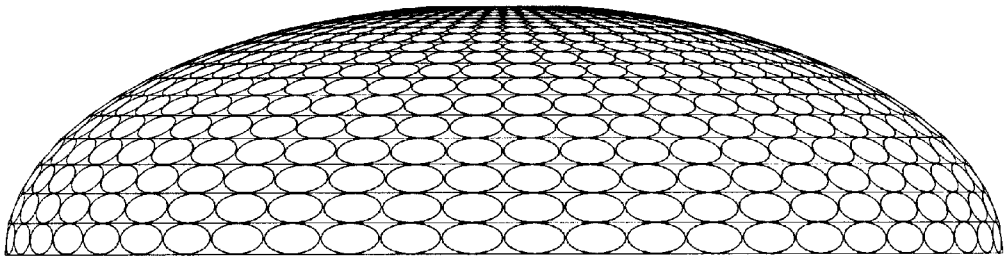

FIG. 262 is a schematic elevation of an oblate spherical dome structure identical with the upper half of the oblate spherical structure shown in FIG. 261

Figure 263:
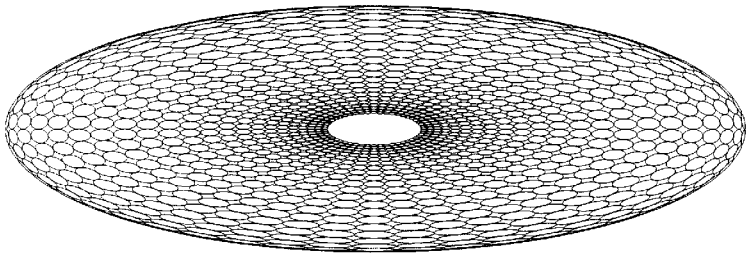

FIG. 263 is a schematic plan view of a structure of the same type as the spherical structure shown in FIG. 253 but which is prolate along one horizontal axis and oblate along the other perpendicular horizontal axis.

Figure 264:
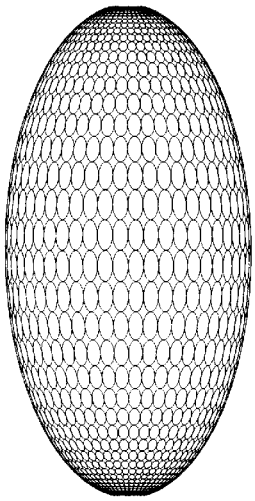

FIG. 264 is a schematic elevation of the view of prolation of the structure shown in FIG. 263.

Figure 265:
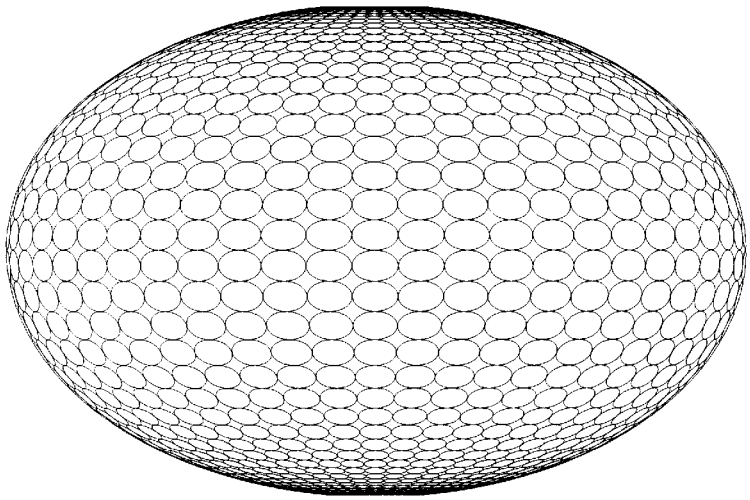

FIG. 265 is a schematic elevation of the view of oblation of the structure shown in FIG. 263.

Figure 266:
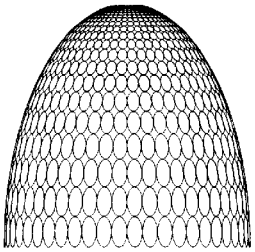

FIG. 266 is a schematic elevation of the view of prolation of a dome structure which is identical to the upper half of the structure shown in FIG. 264.

Figure 267:
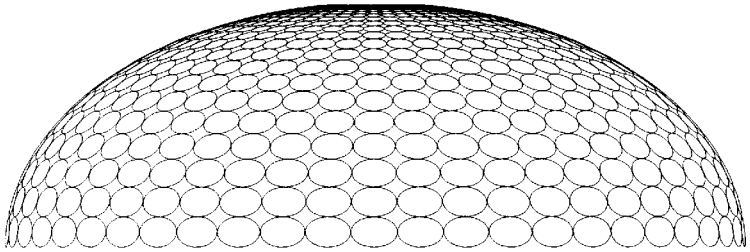

FIG. 267 is a schematic elevation of the view of oblation of a dome structure which is identical to the upper half of the structure shown in FIG. 265.

Figure 268:
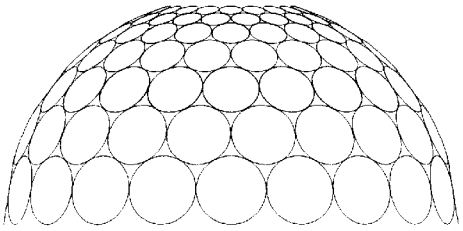

FIG. 268 is an schematic elevation of a dome structure formed by successive interleaved layers of equal numbers of toroids of upwardly diminishing diameter, each toroid connected at six points to those adjacent.

Figure 269:
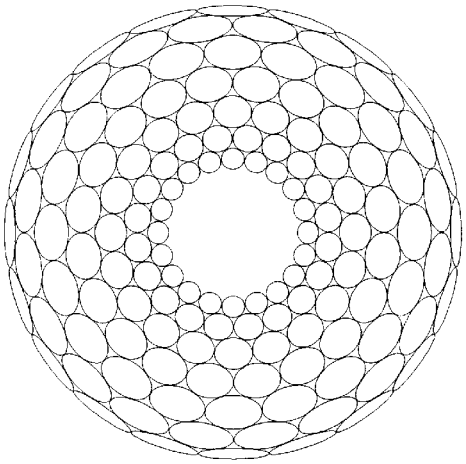

FIG. 269 is a schematic plan view of the dome structure in FIG. 268.

Figure 270:
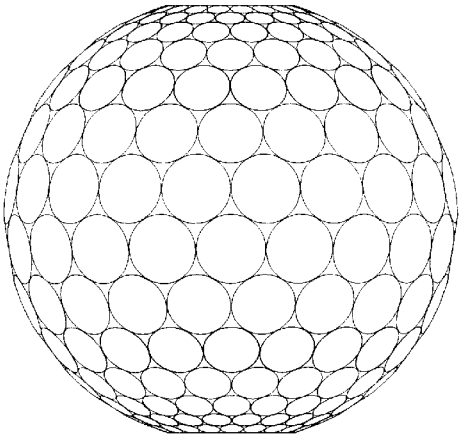

FIG. 270 is a schematic elevation of a spherical structure formed by two of the dome structures shown in FIG. 268 connected convexly opposite.

Figure 271:
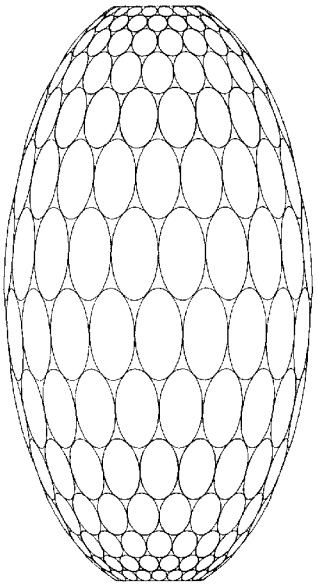

FIG. 271 is a schematic elevation of a prolate spherical structure of the same type as the spherical structure shown in FIG. 270.

Figure 272:
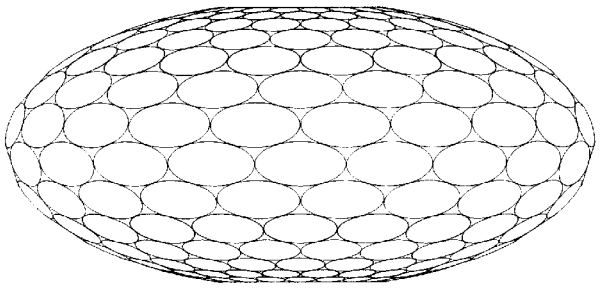

FIG. 272 is schematic elevation of an oblate spherical structure of the same type as the spherical structure shown in FIG. 270.

Figure 273:
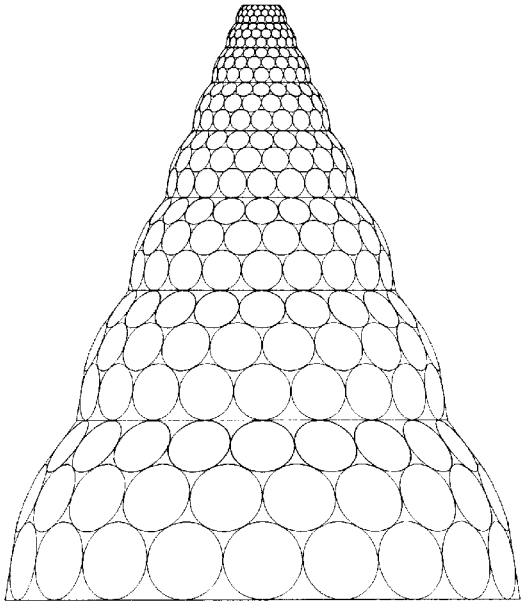

FIG. 273 is a schematic elevation of a tower structure comprised of successive layers of dimishing diameter of the first three layers of the dome structure shown in FIG. 268, with the tower layers connected to intermediate latitudinal toroidal elements.

Figure 274:
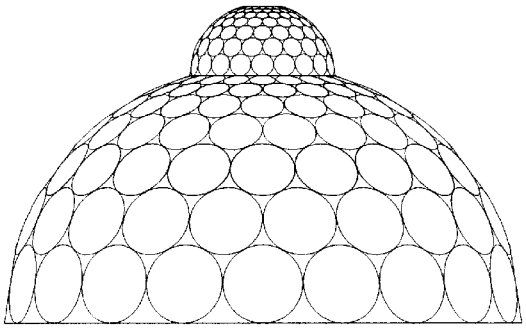

FIG. 274 is schematic elevation of the dome structure shown in FIG. 268 capped by a similar dome structure of lesser diameter to form a compound dome structure.

Figure 275:
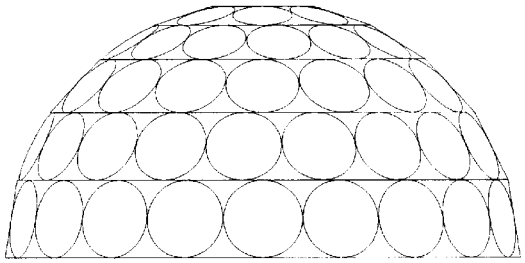

FIG. 275 is a schematic elevation of a dome structure formed by successive layers of connected toroids of upwardly diminishing number but of approximately the same diameter, with the toroids connected within each layer connected to other layers via intermediate upper and lower latitudinal toroids.

Figure 276:
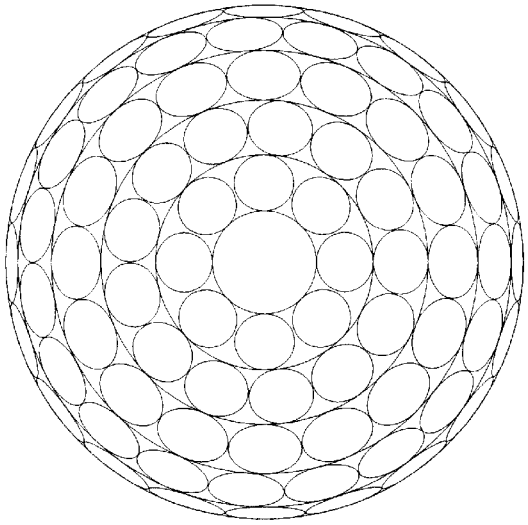

FIG. 276 is a schematic plan view of the dome structure shown in FIG. 275.

Figure 277:
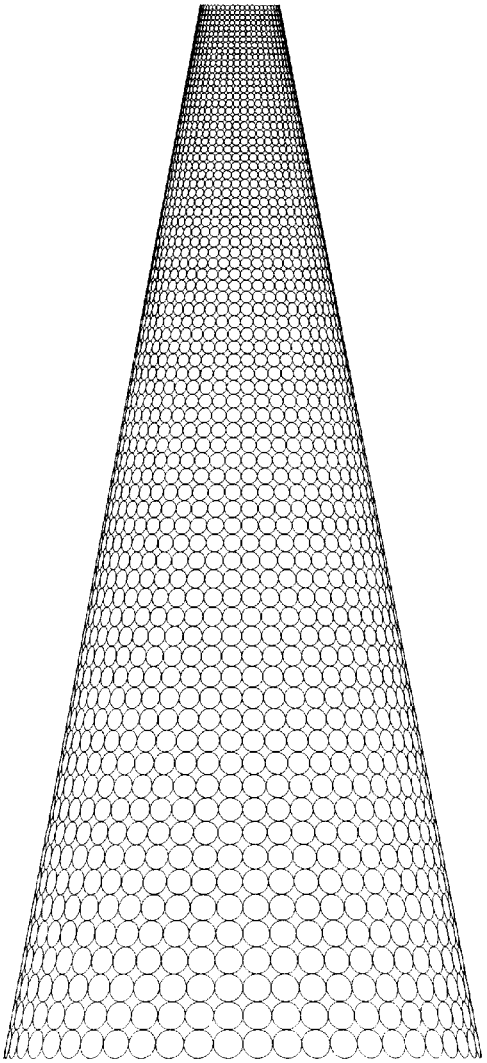

FIG. 277 is a schematic elevation of a conical tower structure formed by successive layers of equal numbers of toroids of upwardly dishing diameter, each toroid connected at four points to those adjacent.

Figure 278:
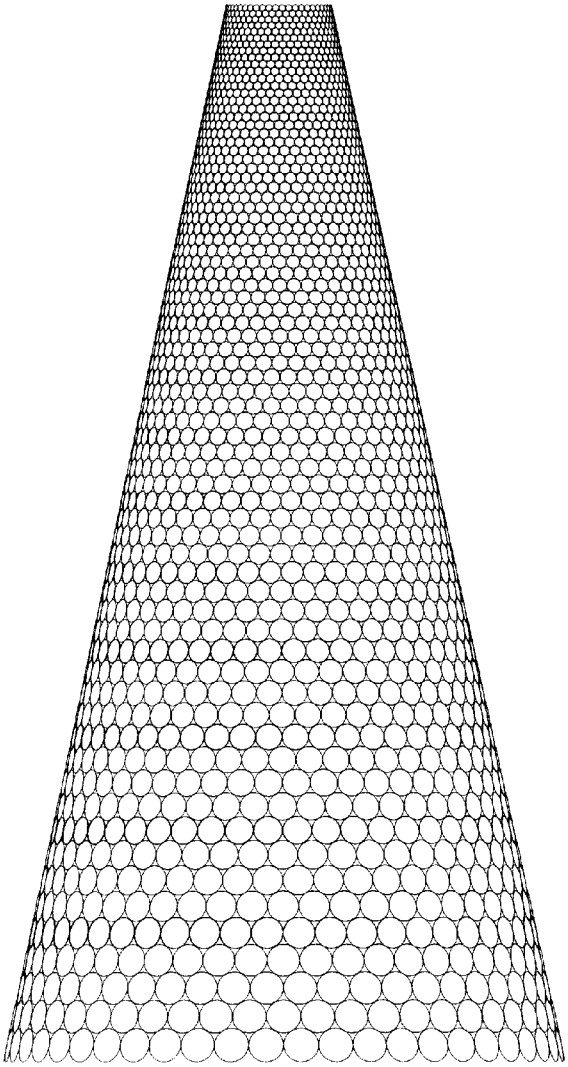

FIG. 278 is a schematic elevation of a conical tower structure formed by successive interleaved layers of equal numbers of toroids of upwardly diminishing diameter, each toroid connected at six points those adjacent.

Figure 279:
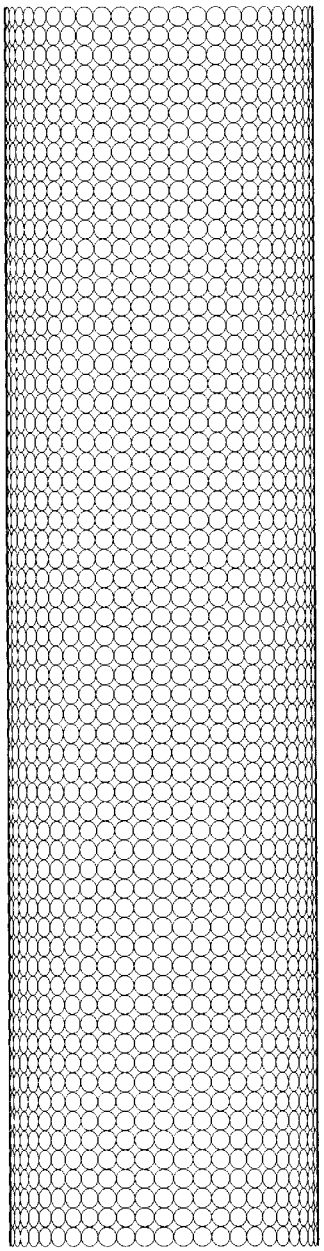

FIG. 279 is a schematic elevation of a cylindrical tower structure formed by successive layers of equal numbers of toroids of the same diameter, each toroid connected to 4 adjacent toroids.

Figure 280:
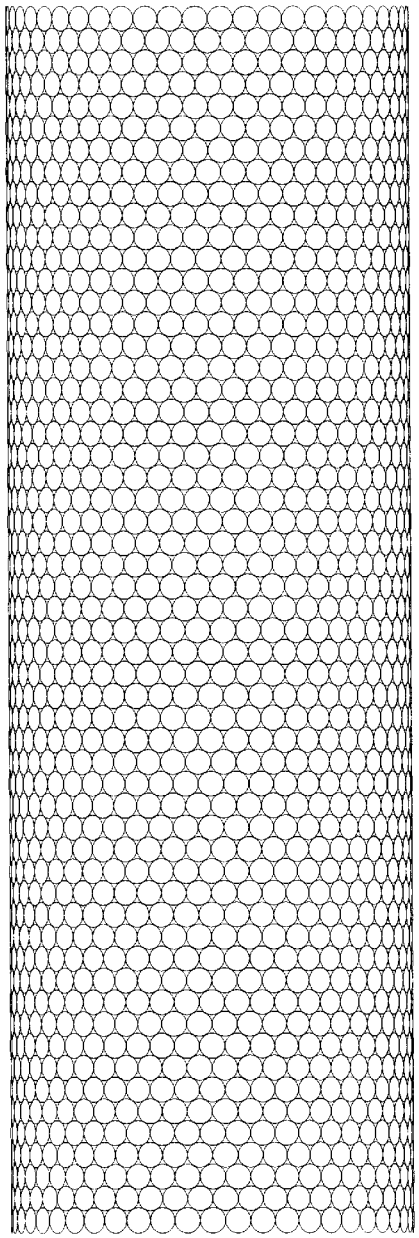

FIG. 280 is a schematic elevation of a cylindrical tower structure formed by successive interleaved layers of equal numbers of toroids of the same diameter, each toroid connected to six adjacent toroids.

Figure 281:
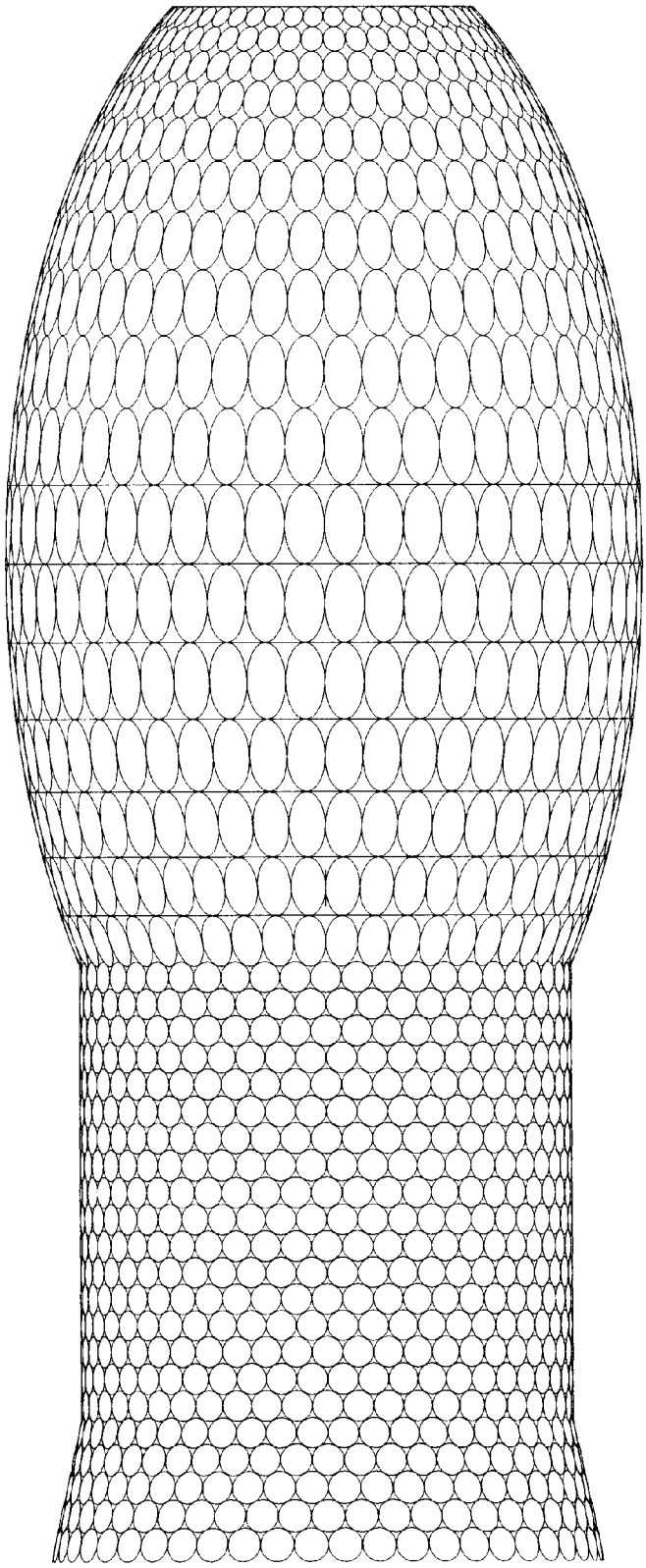

FIG. 281 is a schematic elevation of a tower structure comprised of a conical base of the same type as the conical structure shown in FIG. 278, with interleaved connection to a section of cylindrical tower structure as shown in FIG. 280, topped by an interleaved connection to a trunkated section of a prolate spherical structure as shown in FIG. 259.

Figure 282:
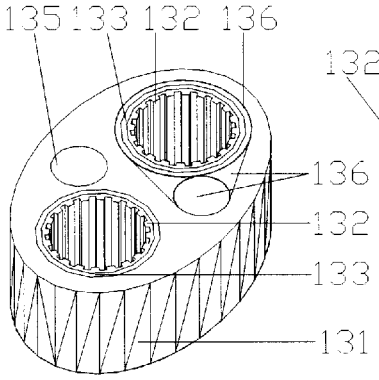
Figure 283:
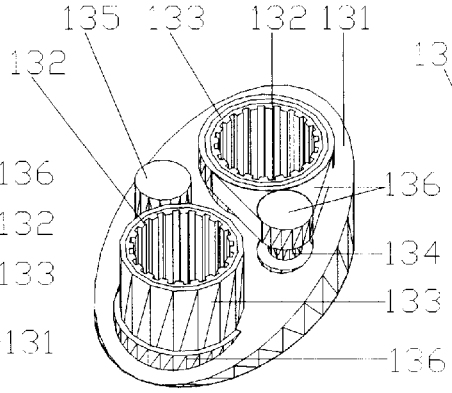
Figure 284:
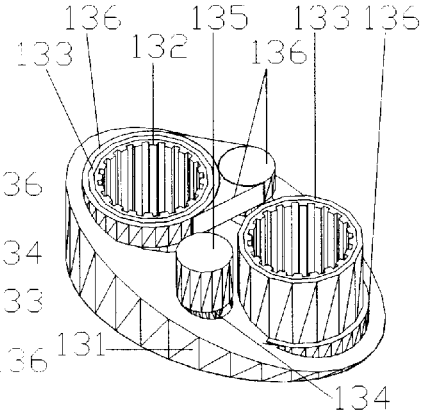

FIGS. 282, 283 and 284 are perspective views of an actuated two element coupling with spline grips, the latter two being cutaway views showing the motors, transmissions and drives for each of the spline grips within the body of the coupling.

Figure 285:
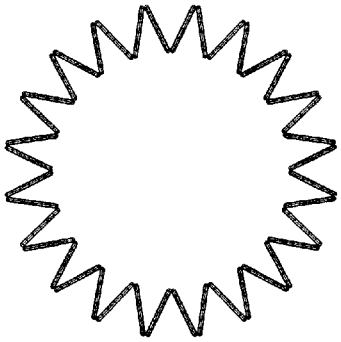
Figure 286:
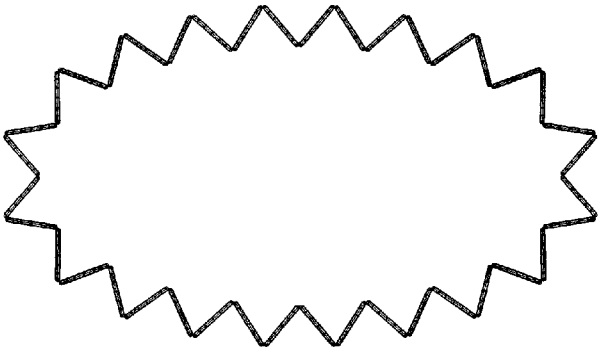
Figure 287:
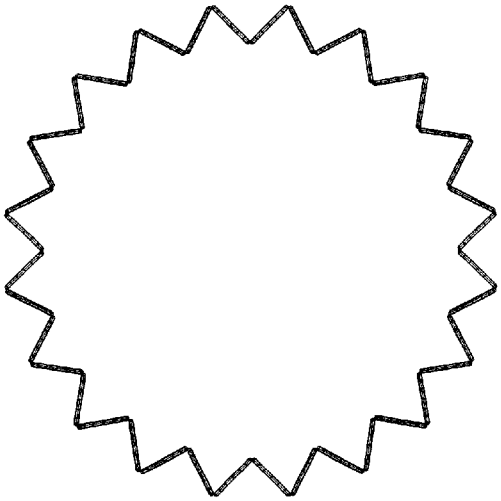

FIGS. 285, 286 and 287 show a series of plan views of a toroidal element shifting shape from that of a circular array of 40 toroidal elements forming a circular toroid to that of an eliptical array forming an eliptical toroid.

Figure 288:
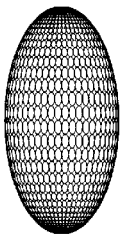

FIGS. 288 trough 297 show a series of schematic elevations of the shifting of shape of a prolate spherical structure to an prolate spherical structure in phases through intermediate structures of lesser volume.

FIGS. 298 through 307 show a series of schematic elevations of the shifting of shape of a prolate spherical structure to an oblate spherical structure in phases through intermediate structures of approximately equal volume.

FIG. 308 is a schematic plan view of an 18 by 18 array of circular toroidal elements connected in a plane.

FIG. 309 is a schematic perspective view of the array of the circular toriodal elements in FIG. 308.

FIG. 310 is a schematic side view of the array of circular toriodal elements in FIG. 308 (essentially a line because the schematic has no depth).

FIG. 311 is a schematic plan view of the 18 by 18 array of the toroidal elements in FIG. 308 after having undergone shape change by actuated couplings forming a paraboloidal section.

FIG. 312 is a schematic perspective view of the paraboloid section in FIG. 311.

FIG. 313 is a schematic side view of the paraboloid section in FIG. 311.

FIG. 314 is a group of 6 connected toroidal elements which comprise the frontmost section of the spherical/dodecahedral structure in FIG. 242.

FIG. 315 is a plan view of the group of toroidal elements in FIG. 314

FIG. 316 is a perspective view of the group of toroidal elements in FIG. 314.

FIG. 317 is a side view of the spherical/dodecahedral structure in FIG. 314 with a group of elements as shown in FIG. 314 scaled to connect to the topmost toroidal element of the structure, with a similar connection of a similar group similarly scaled to connect to the topmost toroidal element of the first group.

FIG. 318 is a top view of the structure in FIG. 317.

FIG. 319 is a perspective view of the structure in FIG. 317.

Figure 320:
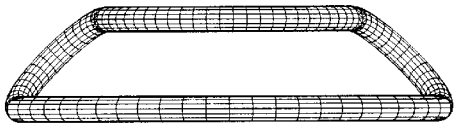

FIG. 320 is a side view of an irregular toroidal element.

Figure 321:
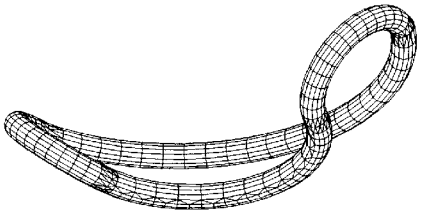

FIG. 321 is a persptective view of the toroidal element shown in FIG. 320.

Figure 322:
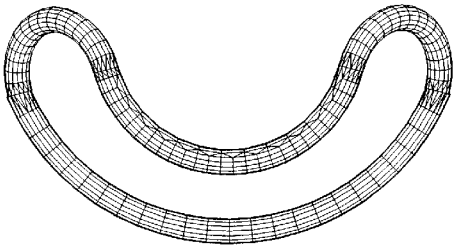

FIG. 322 is a plan view of the toroidal element shown in FIG. 320.

Figure 323:
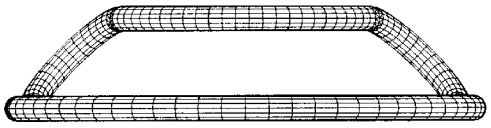

FIG. 323 is a side view of an irregular toroidal element.

Figure 324:
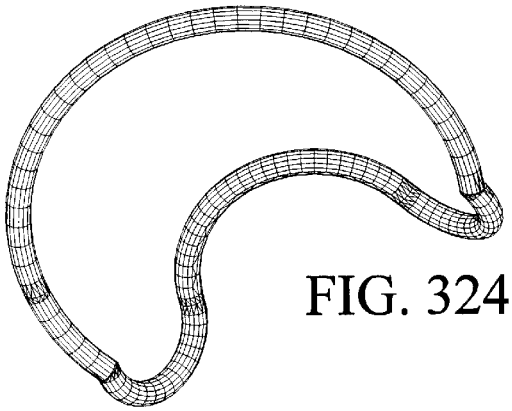

FIG. 324 is a perspective view of the toroidal element shown in FIG. 323.

Figure 325:
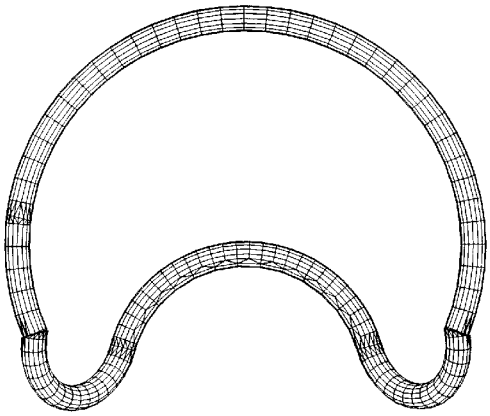

FIG. 325 is a plan view of the toroidal element shown in FIG. 323.

DETAILED DESCRIPTION OF THE INVENTION

The present invention is a structural system which employs "toroidal elements", structural elements which are toroidal in shape, which are connected to form structures, and includes a method of construction therewith. The structural system of toroidal elements may be used to create new structural forms for both stationary and moveable structures.

As used in this description and the appended claims the term "toroidal" means of or pertaining to a "toroid". The term "toroid" is not intended to limit the present invention to employment of elements that are in the shape of a torus, which is mathematically defined as a surface, and the solid of rotation thereby bounded, obtained by rotating a circle which defines the cross section of the tube of the torus about an axis in the plane of the circular cross section. As used in this description and the appended claims the term "toroid" means any form with the general features of a torus, i.e. a tube, cylinder or prism closed on itself, without regard to any regularity thereof, and further means any tubular, cylindrical or prismatic form which is closed on itself in the general configuration of a torus, thus completing a mechanical circuit forming the "tube" of a "toroid", regardless of the shape of the cross section thereof, which may even vary within a given "toroid". A toroid may be formed by the connection of cylindrical or prismatic sections, straight or curved, or by the connection of straight and curved sections in any combination or order; and may be of any shape which the closed tube may form: elliptical, circular, polygonal, whether regular or irregular, symmetrical, partially symmetrical, or even asymmetrical, whether convex or concave outward, partially or completely. Moreover, as used in this description and the appended claims, the term "toroid" applies to and includes: (a) the continuous surfaces of toroids, tube walls of finite thickness, the exterior of which are bounded by the toroidal surface, and the solids that are bounded by the toroidal surface; (b) any framework of elements which if sheathed would have the shape of a toroid; (c) any framework of elements which lays in the locus of a toroidal surface; (d) a bundle or coil of fibers, wires, threads, cables, or hollow tubing that are, bound, wound, woven, twisted, glued, welded, or otherwise bonded together in such a manner as to form in their plurality or individuality a toroidal shape.

The principal objects of the present invention are:

1. To provide a universal structural system for all types of immobile and mobile structures comprised of connected toroidal elements and having a high degree of structural integrity, strength, efficiency, and flexibility.
2. To provide a structural system where toroidal elements are subjected to the greatest part of the structural loading for redistribution of such loading throughout the toroidal structures and conventional elements of the constructions in which they are included.
3. To provide a structural system in which a structure constructed of toroidal elements is uniformly loaded so that the material of which such toroidal elements are composed is uniformly stressed, thereby achieving a high strength-to-weight ratio.
4. To provide a structural system in which loads are well distributed over all of the structural elements thereof.
5. To provide a structural system which is integrated and attractive in appearance, allowing for aesthetic design with self-supporting toroidal elements in which curved structures are architecturally natural.
6. To provide a structural system with dynamic shape shifting and dynamic redistribution of loading by actuated structural connections.
7. To provide a structural system which is economical, adaptable to automated design, automated fabrication, and efficient in ultimate assembly, in its smallest elements and its largest structural forms.
8. To provide a structural system in which conventional structural elements such as beams, joists, decks, trusses, etc. can be constructed with toroidal elements.
9. To provide a structural system in which various toroidal elements may be standardized and databased with all dimensional, material and loading characteristics so as to provide for automated selection of components for structural design therewith.
10. To provide a structural system that is compatible with conventional structural systems.

Toroidal elements use the strength of materials more effectively and have the capacity to redistribute the loads distributed to them by the connections of the structural system of which they are a part, The structural system effectively distributes most compression, tension, flexion and torsion loading of constructions using the system among the connected elements. Thus the construction is distinguished from conventional constructions employing elements which function only in compression, tension or flexion, such as beams, struts, joists, decks, trusses, etc., for which torsional effects are design defects that can lead to catastrophic structural failure. However, when elements which function in compression, tension or flexion are constructed using the present invention, the same structural benefit of torsional load distribution applies.

The present invention contemplates that toroidal elements may be constructed of yet other toroidal elements, so that a given toroidal element so constructed functions to bear loads by the bearing of structural loads by its constituent substructures. Such substructures may be structural elements, toroidal, conventional or otherwise, which are part of a combination of structural elements of a scale similar to the given toroidal element; or structural elements of a scale significantly smaller than the given toroidal element and fundamentally underlying the bearing capacity of given toroidal element. In the latter case the structure of a given toroidal element may be the replication of small substructures of toroidal elements, which in turn may be replications of still smaller substructures of toroidal elements. This process of structural replication can be continued to microscopic, and even molecular, levels of smallness.

The system also includes the construction of conventional elements using toroidal elements which in turn may be used in combination with other structures using toroidal element constructions. Moreover, it is one of the features of the present system that such conventional elements, such as beams, joists, decks, trusses, etc., so constructed using toroidal elements may be engineered with arching camber. Although some toroidal elements may bear resemblance to conventional trusses, the structural integrity and strength of toroidal elements is not necessarily dependent on elements such as linear chords and struts.

Toroidal elements can be made of virtually any material suitable for the loads to which the structure may be subjected and for the environment in which the structure may be utilized.

The present invention contemplates that structures constructed of connected toroidal elements may be incorporated in yet other structures together with conventional structural elements in order to bear loads in conjunction with such toroidal structures.

The preferred embodiment of the present invention employs toroidal elements that are constructed with the use of "torsion elements" which are toroidal in shape. As used in this description and the appended claims the term "torsion element" means a structural element that functions with torsion as its principal load bearing mode. Torsion elements use the torsional strength of materials and have the capacity to bear the torsion loads distributed to them by the connections of the structural system of which they are a part. The present invention using toroidal torsion elements converts most compression, tension and flexion loading of constructions using the system to torsional loading of the torsion elements of which the constructions are comprised. The use of toroidal torsion elements also contributes to construction of toroids which are self-supporting.

Toroidal elements may be used to create new structural forms for both stationary and moveable structures. The toroidal shape allows for replication of toroidal elements to produce larger and larger toroidal elements which may be suitable to the dimensions of the structural application. A large variety of structures made feasible by origination of the replication process with toroidal elements on the order of nanostructures or larger may themselves be considered as materials which can be utilized in conventional structures such as decking, plates, skins, and sheeting of arbitrary curvature.

Erection of structural frames using the present invention requires only connection of the toroidal elements, and may use connectors which are propositioned and even integrated in the design of the toroidal elements.

The structural system is comprised of a plurality of toroidal elements connected together by a means for connection. Two or more toroidal elements may be connected in the same connection. The connection of the toroidal elements is the means by which loading is transmitted between and distributed among the toroidal elements.

As used in this disclosure and the appended claims the term "connected" means, in addition to its ordinary meaning, being in a "connection" with toroidal elements; and the term "connection" as used as in this disclosure includes, in addition to its ordinary meaning, any combination of components and processes that results in two or more structural elements being connected, and further includes the space actually occupied by such components, the objects resulting from such processes, and the parts of the structural elements connected by contact with such components or objects; but both the terms "connected" and "connection" exclude interlining ("intersection") of structural elements as a means for connecting toroidal elements.

Toroidal elements may be connected by any means that does not permit unwanted movement in the connection, Such means may be any type of joining, such as welding, gluing, fusing, or with the use of fasteners, such as pins, screws and clamps. However, the preferred means for connection is by use of a "coupling". The term "coupling" is used in this disclosure to mean a device which connects two or more toroidal elements by holding them in a desired position relative to one another, so that when the desired positions of the torsion elements are achieved, the toroidal elements will not be able to unwantedly move relative to each other within the coupling. The coupling may itself be constructed of toroidal elements, or may be solid or have some other structure. The term "coupling" also includes a device which connects a toroidal element to a conventional structural element by holding both the toroidal element and the conventional structural element so that when the desired position is achieved, the elements will not be able to unwantedly move relative to each other within the coupling. Although, the function of couplings is to hold toroidal elements in position in relation to each other, there may be motion of the toroidal elements associated with the structural loading of the elements, including rotation of the elements with respect to each other about the axis defined by the grip within the coupling, and sliding of the elements through the grip of the coupling. Such motion is expected and appropriate for the distribution of stress among the elements of a given toroidal structure.

The function of couplings in holding toroidal elements in position may be combined with prior positional adjustment and actuation of such adjustment. In this respect the position of toroidal elements connected by a coupling with respect to one another may be changed or adjusted and then held in the desired position. Accordingly, the coupling must be designed to have the capability for such adjustment, and may also be designed to have such adjustment actuated by some motive power. Such actuation may implement dynamic distribution of loading among the toroidal elements affected, or implement dynamic shape shifting, or both. This can be achieved by making one or more connections of the structure adjustable, with or without the use of actuation. The function of such a coupling, therefore, is to adjust the coupled connections, with or without the use of such controlled actuation, so that a toroidal element may be moved within a connection in relation to other structural elements connected therein, and then firmly held by the connection in the position resulting from such movement so that the toroidal element will not have substantial movement within the connection in relation to any other structural element in the connection unless deliberately moved again by the coupling.

The use of the invention includes every conceivable structure bridges, towers, furniture, aircraft, land and sea vehicles, appliances, instruments, buildings, domes, airships space structures and vehicles, and planetary and space habitats, The magnitude of such structures contemplated and made structurally and economically feasible by the system range from the minute to the gigantic. The structures that are possible with the use of the present invention are not limited to any particular design, and may even be freeform.

Some of the structural forms can be applied to construct buildings for unstable foundation conditions and which can survive foundation movement and failure. The use of toroidal elements may also be applied to create structures which are dynamic, with the constituent elements capable of movement by design, not only by deflection as a result of loading, but also by the active management of structural stresses. Toroidal elements may also be varied in shape dynamically so as to achieve alteration of the shape, size and volume of the structure of which they are constituent.

To present the details of the system, the function of its elements, and the method by which structures are constructed using the system, reference is made to the numerous drawings of combinations and arrays of connected toroidal elements.

FIGS. 1–4 are various views of two toroidal elements which are connected, demonstrating the fundamental operation of the present invention, the connection of toroidal elements.

Figure 1:
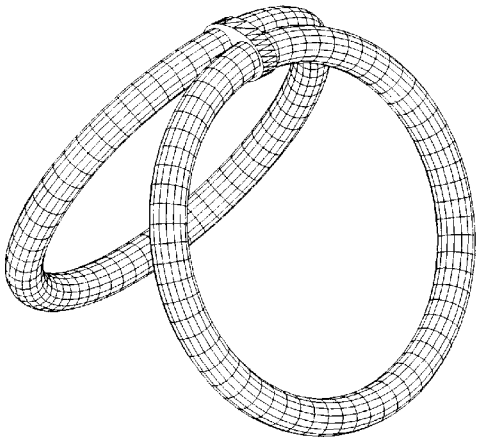
FIG. 1 is a perspective view of two toroidal elements connected at an angle by one coupling.
Figure 2:
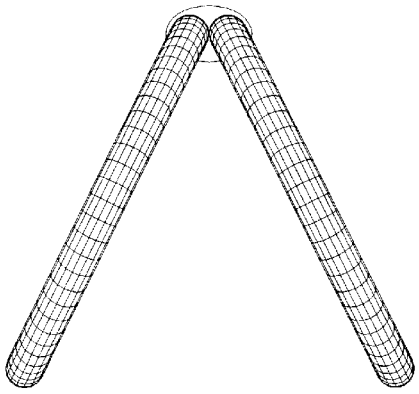
FIG. 2 is side view of the toroidal elements in FIG. 1.
Figure 3:
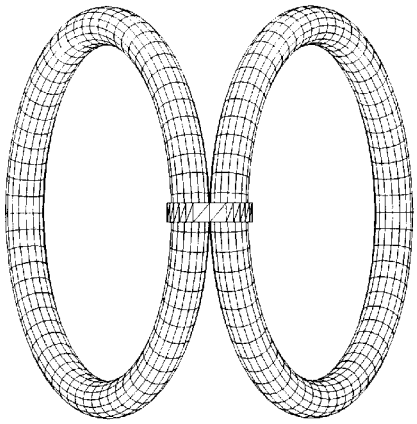
FIG. 3 is a plan view of the toroidal elements shown in FIG. 1.
Figure 4:
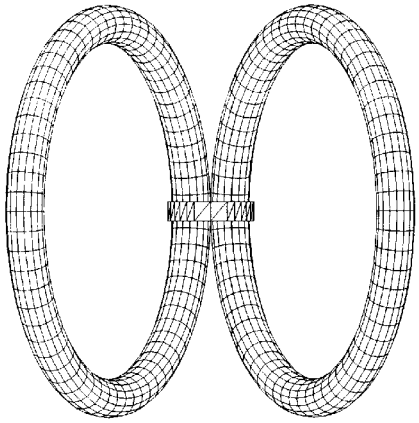
FIG. 4 is a bottom view of the toroidal elements shown in FIG. 1.
Figure 5:
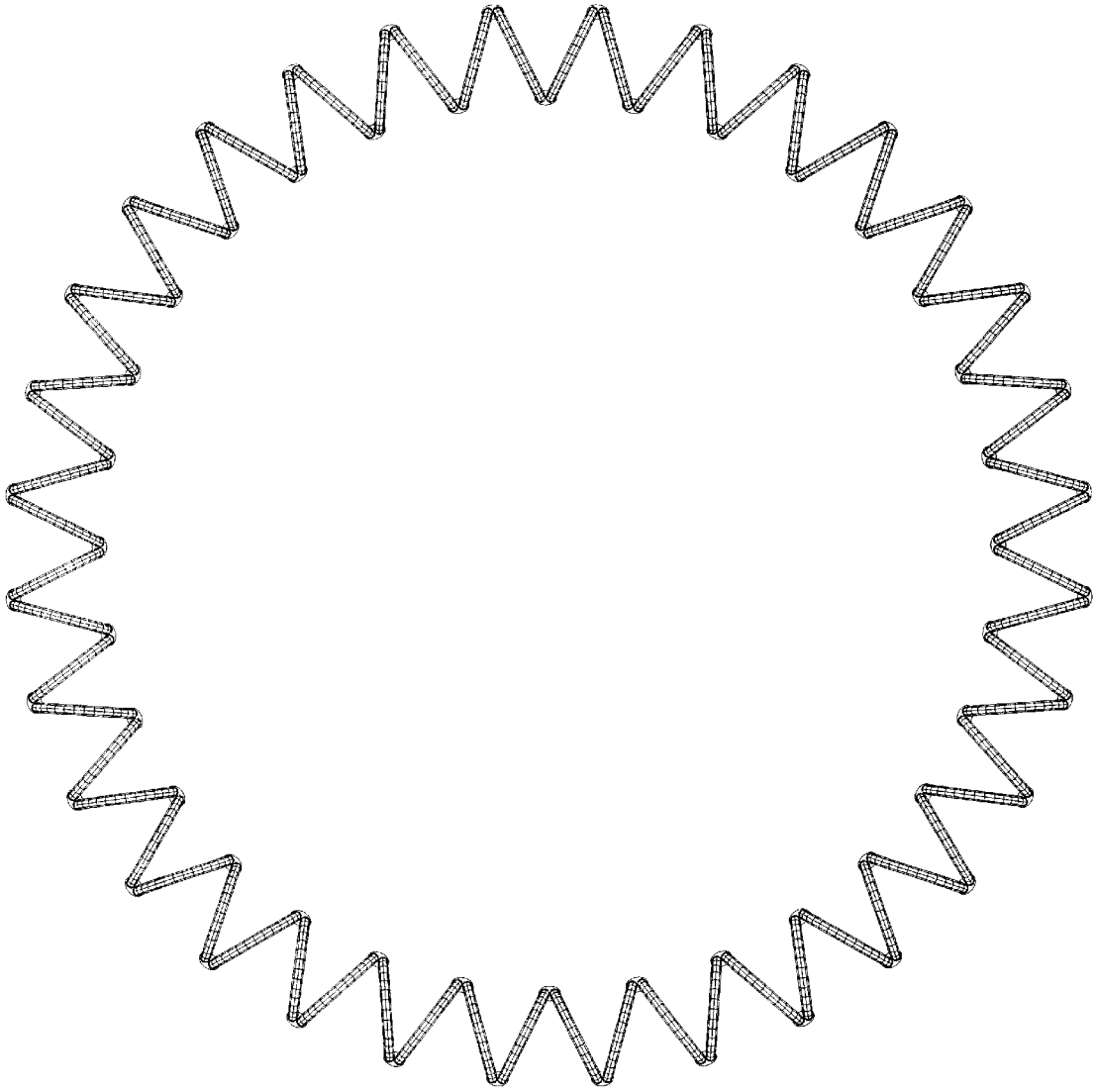
FIG. 5 is a plan view of 32 pairs of toroidal elements shown in FIG. 2 connected in a circular array forming a toroid.
Figure 6:
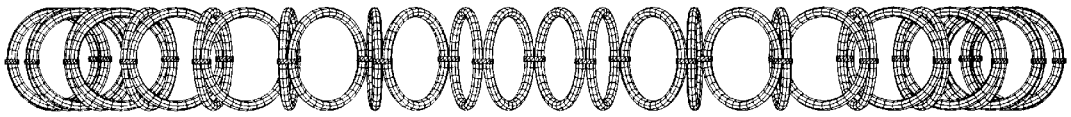
FIG. 6 is a side view of the circular array shown in FIG. 5.
Figure 7:
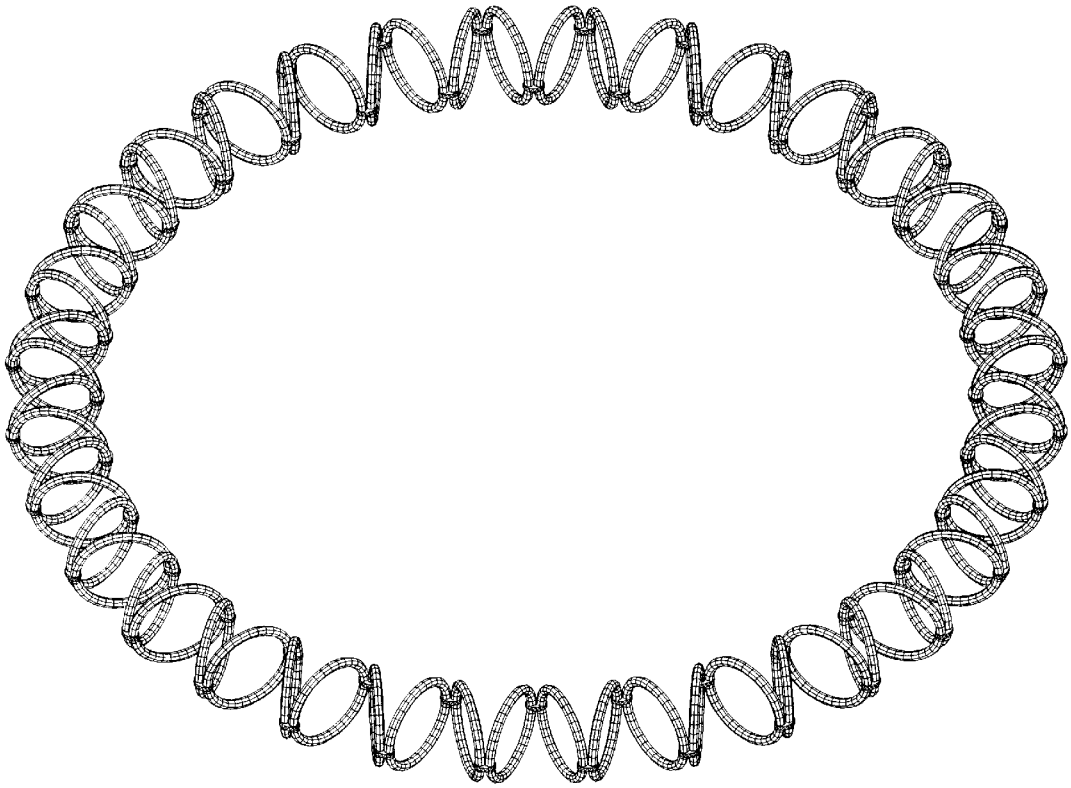
FIG. 7 is a perspective view of the circular array shown in FIG. 5.
Figure 8:
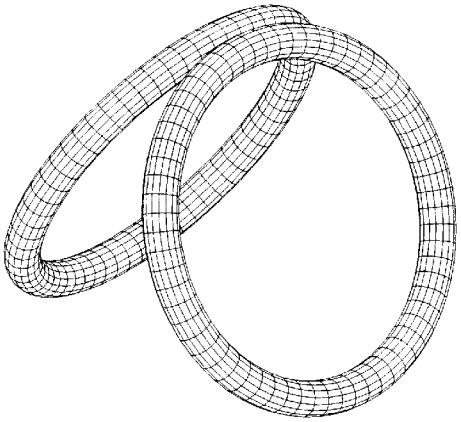
FIG. 8 is a perspective view of two toroidal torsion elements connected at an angle without an external coupling.
Figure 9:
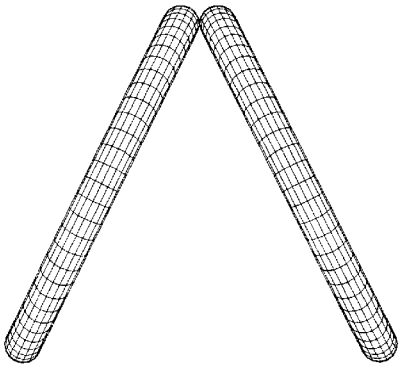
FIG. 9 is a side view of the toroidal torsion elements in FIG. 8.
Figure 10:
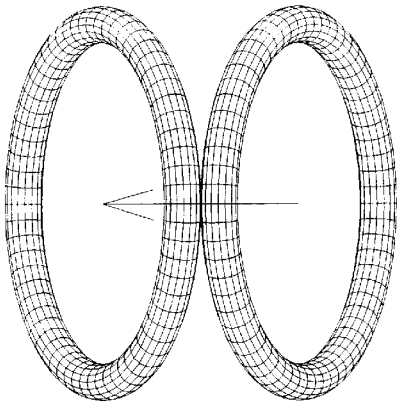
FIG. 10 is a plan view of the toroidal torsion elements in FIG. 8.
Figure 11:
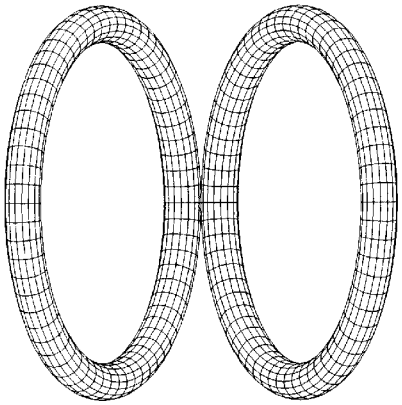
FIG. 11 is a bottom view of the toroidal torsion elements in FIG. 8.

Toroidal elements can be connected in closed arrays as shown in FIGS. 5–7, which may form the framework of larger toroidal elements. Indeed, it is contemplated by this invention that the self-similarity of toroids constructed from other toroidal elements can be extended to control the structural characteristics of such toroidal elements.

Figure 79:
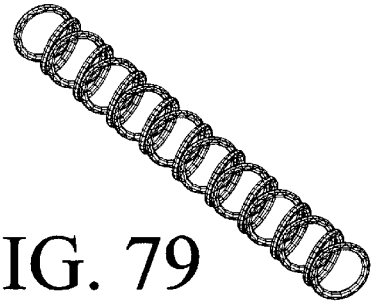
FIG. 79 is a perspective view of the linear array shown in FIG. 78.

Through FIG. 79 all of the connections between toroidal elements have been shown in the figures as "external", i.e. achieved with an "external" coupling applied to the exterior surfaces of toroidal elements. Such connections shall continue to be referred to as "external", as opposed to "internal" connections which include al[008c] means for connecting toroidal elements without the use of a coupling or other intermediate device. Toroidal elements in a connected combination are shown in the various views in FIGS. 8–11.

For the purpose of the figures of this disclosure it shall be understood that all of the closely proximate toroidal elements shown are connected in the region of their closest proximity by internal connection, unless otherwise indicated, such as by connection with couplings. Furthermore, for the purpose of the figures of this disclosure the lack of the appearance of an external coupling at the point of closest proximity of two toroidal elements shall not be taken to mean that such elements are not connectable with couplings, unless otherwise indicated. Also, all connections thus shown in the figures may be internal or external as required by the application, even though not indicated as such in a particular figure. This convention is used in the examples of closed arrays shown in FIGS. 12–16, where the toroidal structural modules shown in FIGS. 8–11 form the framework of toroids.

Figure 16:
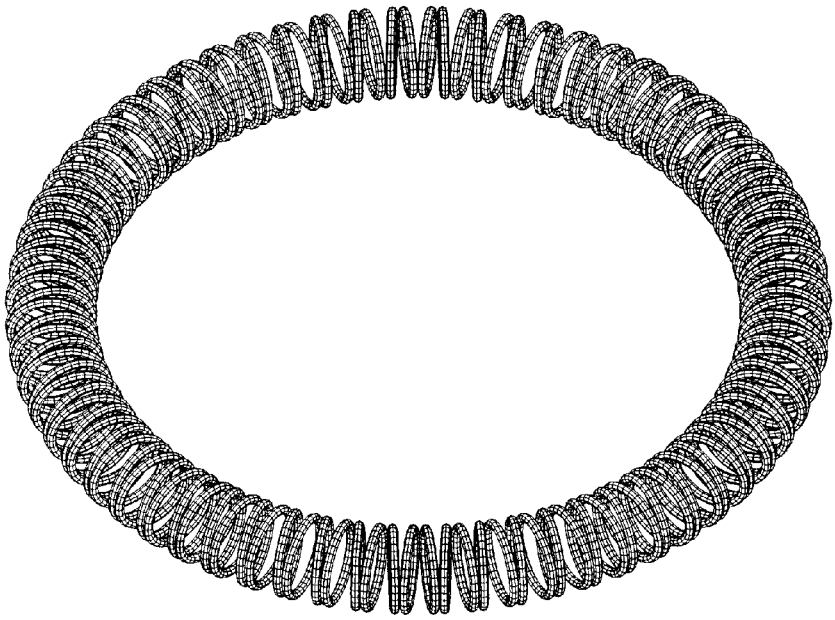
FIG. 16 is a perspective view of the toroid shown in FIG. 15.
Figure 17:
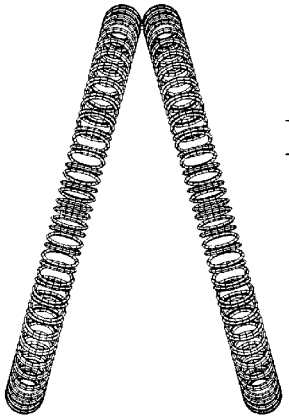
FIG. 17 is a side view of two toroids such as the one shown in FIG. 15 connected internally by couplings connecting a plurality of the toroidal elements of one with proximate toroidal elements of the other.
Figure 18:
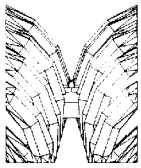
FIG. 18 is a fragmentary view of the region of internal connection between the toroids in FIG. 17
Figure 19:
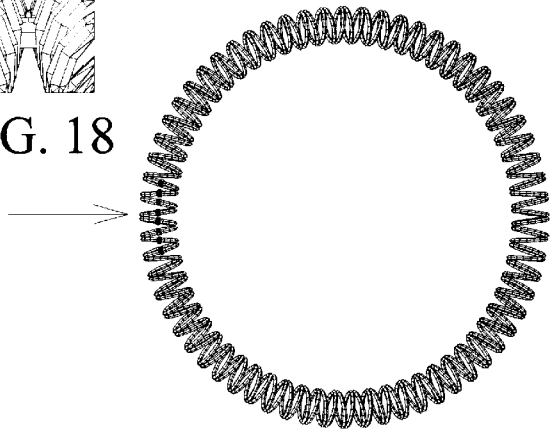
FIG. 19 is another side view of the two toroids shown in FIG. 17.
Figure 20:
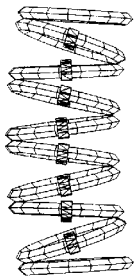
FIG. 20 is a fragmentary view of the region of internal connection between the toroids in FIG. 19
Figure 21:
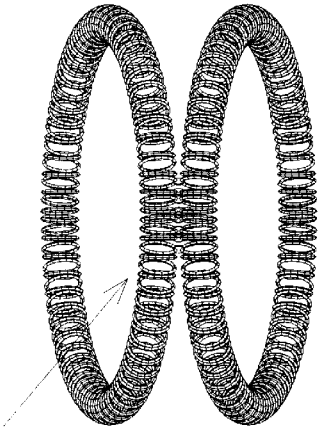
FIG. 21 is a view of the two toroids in the direction of the arrow in FIG. 19.
Figure 22:
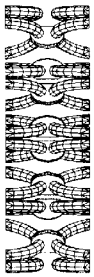
FIG. 22 is a fragmentary view of the region of internal connection between the toroids in FIG. 21.
Figure 23:
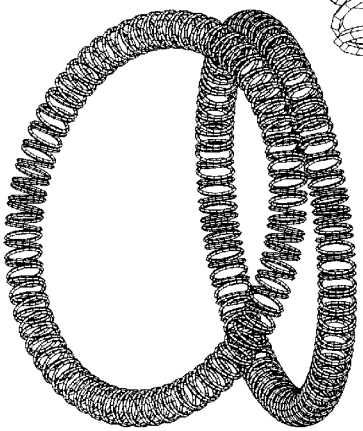
FIG. 23 is a perspective view of the two toroids in the direction of the arrow in FIG. 21.
Figure 24:
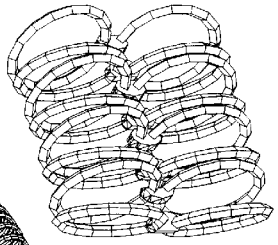
FIG. 24 is a fragmentary view of the region of internal connection between the toroids shown in FIG. 23
Figure 31:
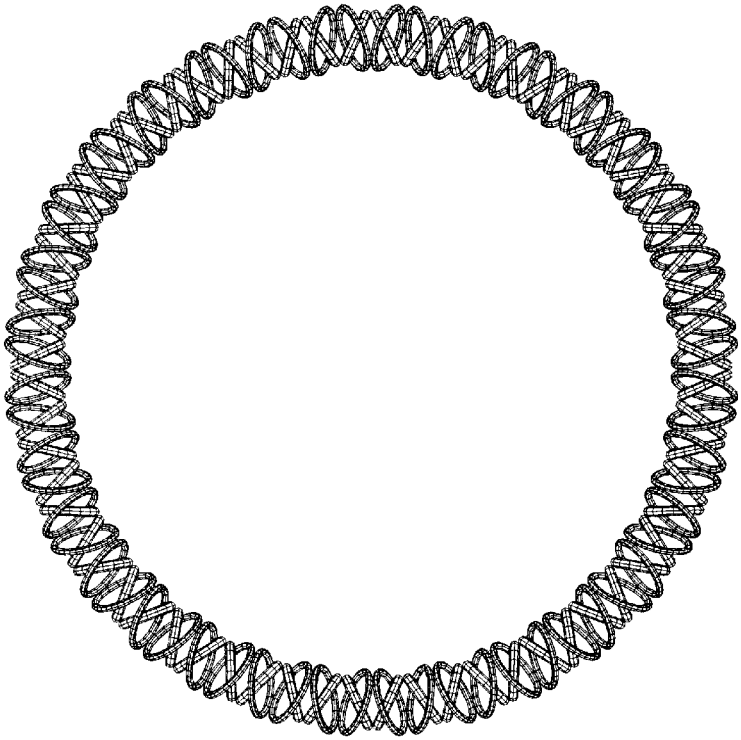
FIG. 31 is a plan view of a toroid formed by two tubularly concentric toroids, the outer being of the type shown in FIG. 30 and the inner being of the type shown in FIG. 12.
Figure 32:
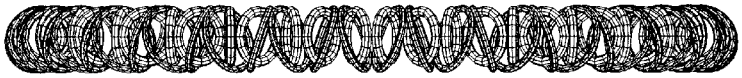
FIG. 32 is a side view of the toroid formed by the circular array shown in FIG. 31.
Figure 33:
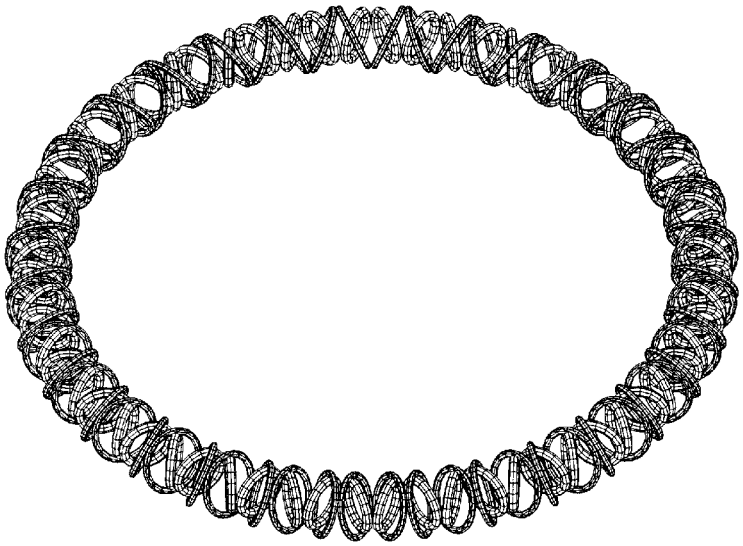
FIG. 33 is a perspective view of the toroid formed by the circular array shown in FIG. 31.
Figure 34:
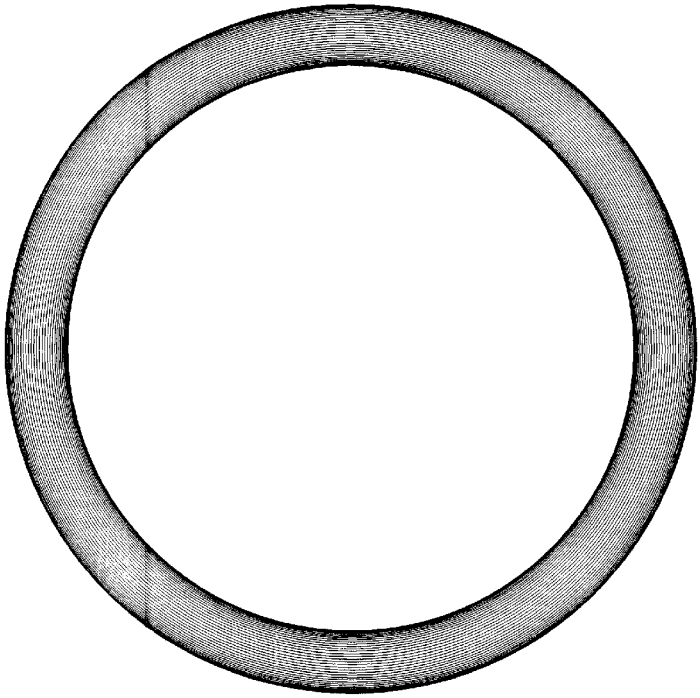
FIG. 34 is a plan view of a filament wound toroidal element.
Figure 36:
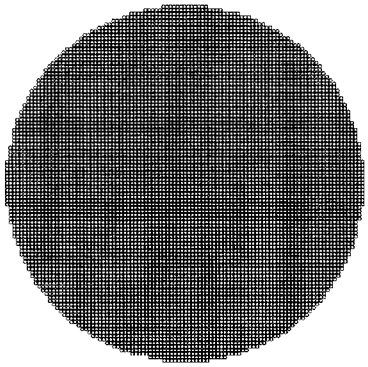
FIG. 36 is a cross section of the tube of the toroidal element shown in FIG. 34.
Figure 35:
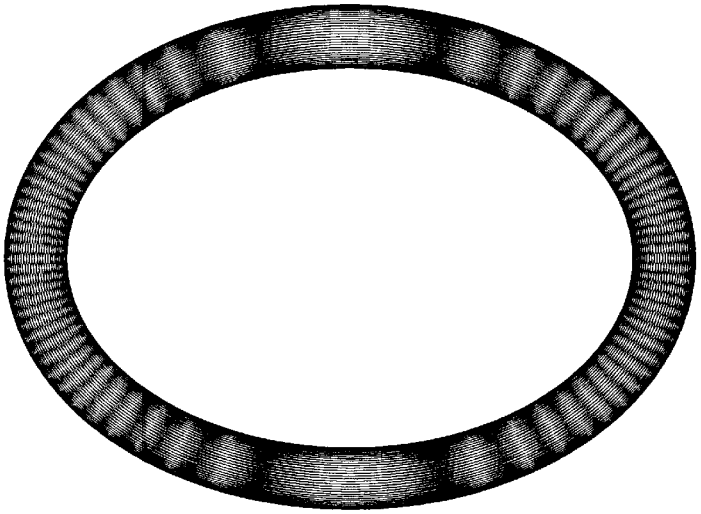
FIG. 35 is a perspective view of the toroidal element in FIG. 34.
Figure 37:
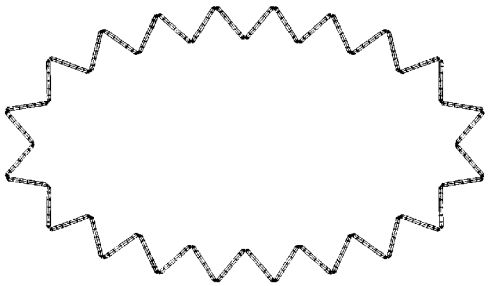
FIG. 37 is a plan view of 20 pairs of toroidal torsional elements as shown in FIG. 9 connected in an eliptical array forming a toroid.
Figure 38:
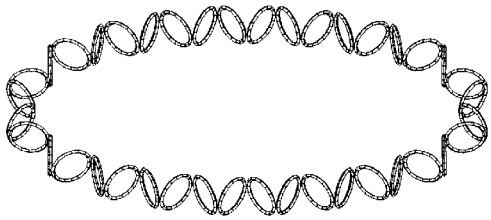
FIG. 38 is a perspective view of the toroid formed by the eliptical array shown in FIG. 37.

By the convention herein established the circular array shown in FIGS. 15 and 16 is comprised of toroidal elements that are internally connected. However, observation of an internal connection, shown in the various views of FIGS. 17–24 between two toroids formed as shown in FIGS. 15 and 16, demonstrates that internal connections between toroidal elements may be achieved by the use of external connections between their constituent toroidal elements. This internal connection, rather than being accomplished by coupling of the constituent toroidal elements of the toroids, could have been accomplished by internal connections between the elements of which the constituent toroidal elements are constructed. Such internal connection may also be mediated by additional elements, toroidal or otherwise. Furthermore, this process may be continually replicated in a self-similar manner on a smaller and smaller scale, down to a fundamental toroidal element, a toroidal element which may be a construction itself, but not necessarily by formation from a circular array Arrays of angularly connected toroidal elements that themselves form toroids may be elliptical, as shown in FIGS. 37 and 38, or of any other shape, and have directional characteristics as shown in FIGS. 25–30. Such varying constructions of toroids may be combined as needed to meet extrinsic structural requirements by tubularly coaxial connection between such toroids as shown in FIGS. 31–33.

Figure 80:
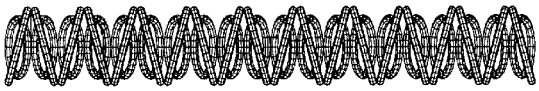
FIG. 80 is a side view of the linear array shown in FIG. 76 which coaxially encloses the linear array shown FIG. 78.
Figure 81:
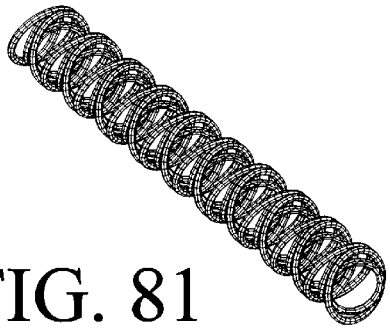
FIG. 81 is a perspective view of the coaxial linear arrays shown in FIG. 80.
Figure 82:
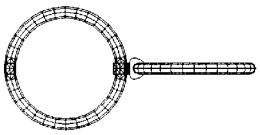
FIGS. 82 through 95 show various connections between toroidal elements (even numbered showing the plan view and odd numbered showing a perspective view).
Figure 83:
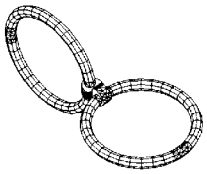
Figure 84:
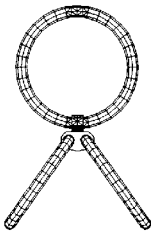
Figure 85:
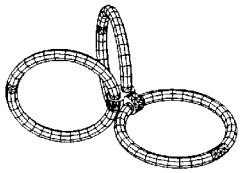
Figure 86:
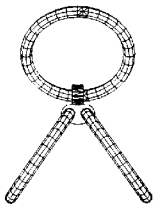
Figure 87:
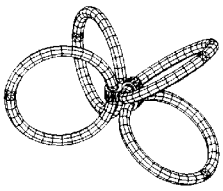
Figure 88:
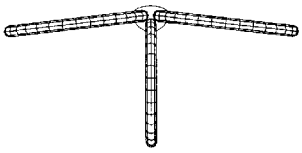
Figure 89:
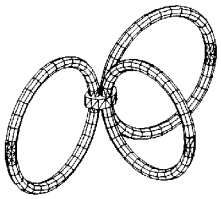
Figure 90:
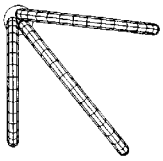
Figure 91:
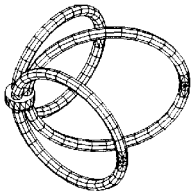
Figure 92:
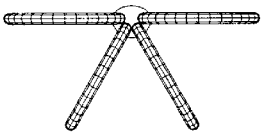
Figure 93:
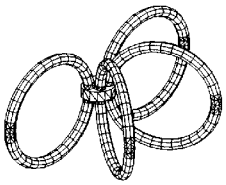
Figure 94:
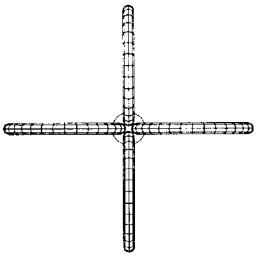
Figure 95:
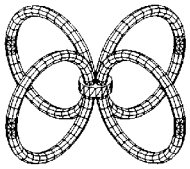
Figure 96:
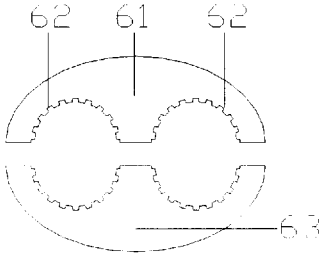
FIGS. 96, 97 and 98 are plan views of a coupling with splined grips for connecting two elements showing, respectively, the coupling open, the coupling compression band, and the coupling closed.
Figure 97:
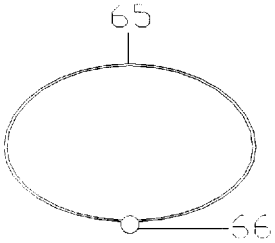
Figure 98:
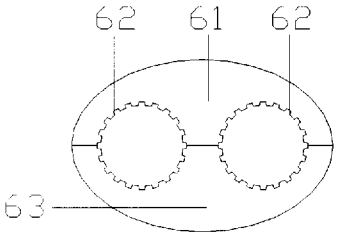
Figure 99:
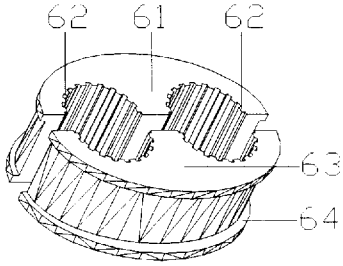
FIGS. 99, 100 and 101 are perspective views of a coupling with splined grips showing for connecting two elements showing, respectively, the coupling open, the compression band, and the coupling closed with the compression band applied.
Figure 100:
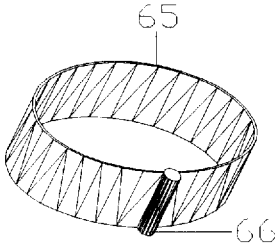
Figure 101:
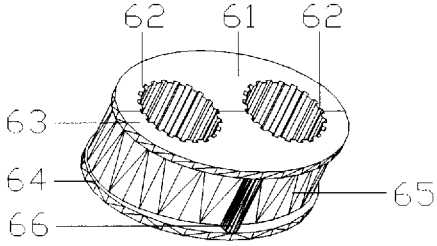
Figure 102:
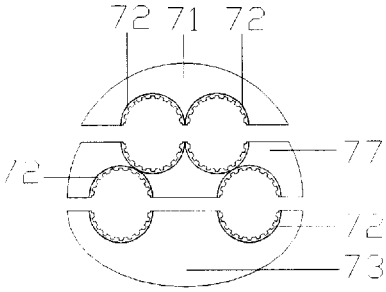
FIGS. 102, 103 and 104 are plan views of a coupling with splined grips for connecting four elements showing, respectively, the coupling open, the coupling compression band, and the coupling closed.
Figure 103:
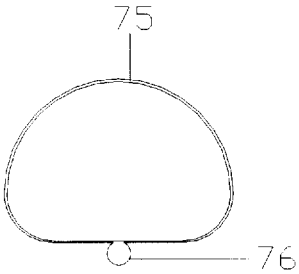
Figure 104:
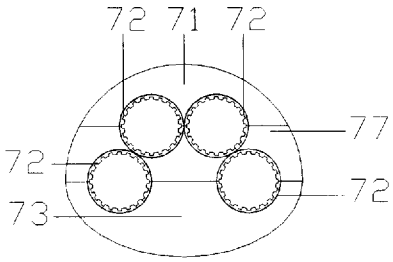
Figure 105:
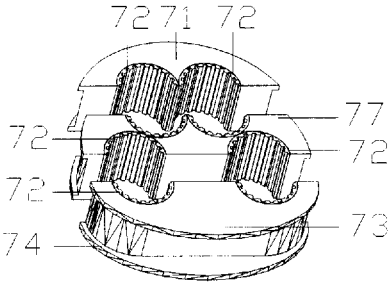
FIGS. 105, 106 and 107 are perspective views of a coupling with splined grips showing for connecting four elements showing, respectively, the coupling open, the compression band, and the coupling closed with the compression band applied.
Figure 106:
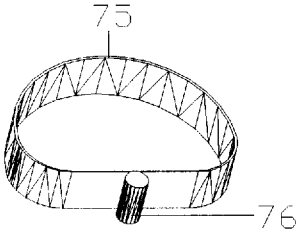
Figure 107:
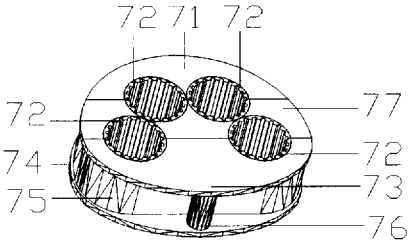
Figure 108:
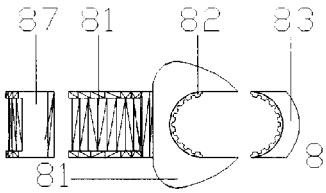
FIGS. 108, 109, 110 and 111 are plan views of a coupling with splined grips for connecting two axially askew toroidal elements showing respectively, the coupling open, the compression bands, the coupling closed with compression bands applied, and the coupling with an arbitary angle between the grip axes (also with compression bands applied).
Figure 109:
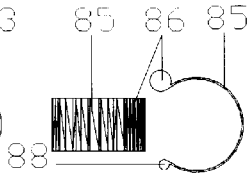
Figure 110:
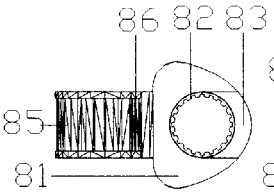
Figure 111:
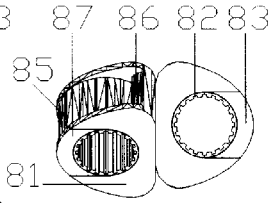
Figure 112:
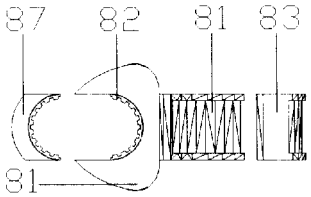
FIGS. 112, 113, 114 and 115 are side views of a coupling with splined grips for connecting two axially askew toroidal elements showing respectively, the coupling open, the compression bands, the coupling closed with compression bands applied, and the coupling with an arbitary angle between the grip axes (also with compression bands applied).
Figure 113:
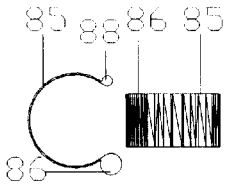
Figure 114:
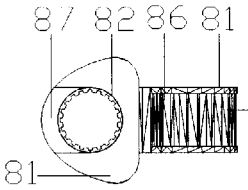
Figure 115:
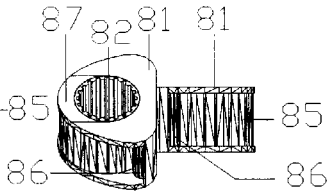
Figure 116:
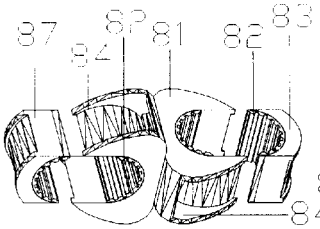
FIGS. 116, 117, 118 and 119 are perspective views of a coupling with splined grips for connecting two axially askew toroidal elements showing, respectively, the coupling open, the compression bands, the coupling closed with compression bands applied, and the coupling with an arbitary angle between the grip axes (also with compression bands applied).
Figure 117:
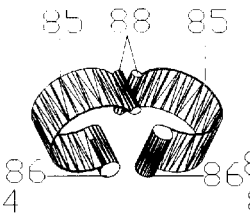
Figure 118:
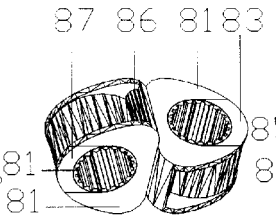
Figure 119:
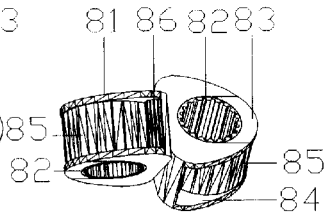
Figure 120:
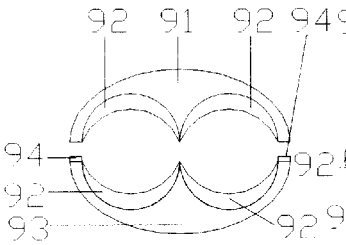
FIGS. 120 and 122 are plan views of a two element coupling with compression foam grips for connecting two elements showing, respectively, the coupling open and the coupling closed.
Figure 121:
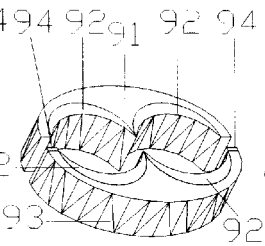
FIGS. 121 and 123 are perspective views of a two element coupling with compression foam grips for connecting two elements showing, respectively, the coupling open and the coupling closed.
Figure 122:
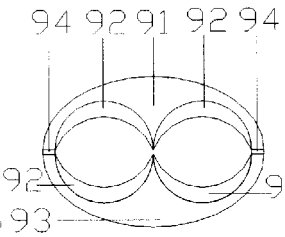
Figure 123:
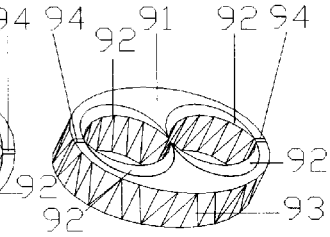
Figure 124:
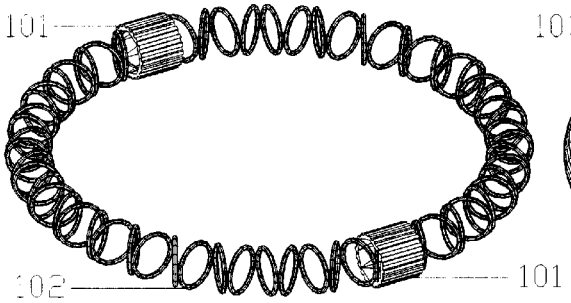
FIGS. 124 through 127 are perspective views of a toroidal elements as shown in FIGS. 14, 41, 27 and 48 respectively with two spline collars on opposite sides of the element bonded to the toroidal elements of which they are comprised.
Figure 125:
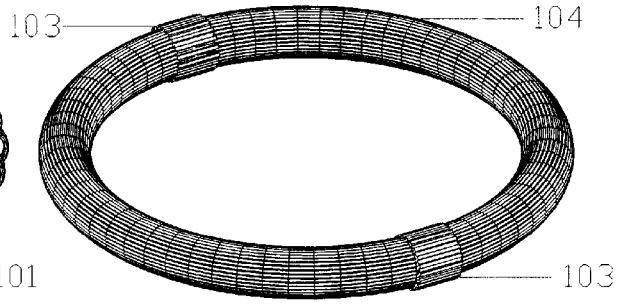
Figure 126:
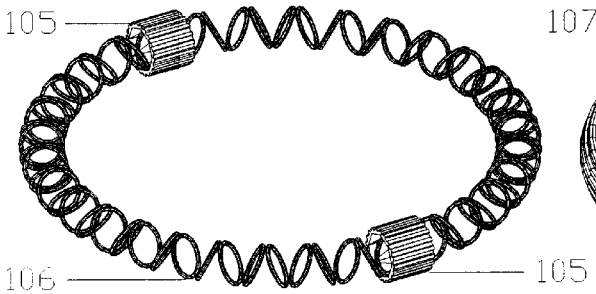
Figure 127:
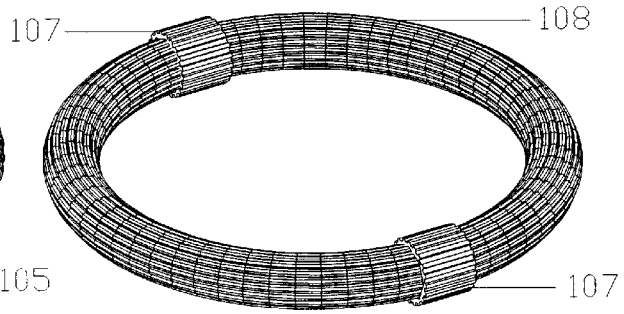
Figure 128:
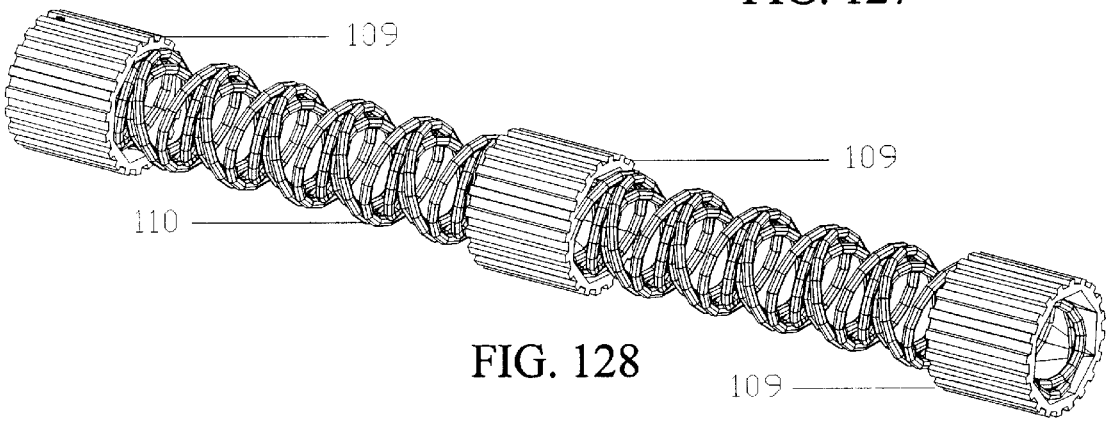
FIG. 128 is a perspective view of the linear array as shown in FIG. 80 with three spline collars bonded to toroids which comprise the element.

Constructions from linear arrays of connected toroidal elements may also be used to form structural members such as rods, tubes, poles or posts, examples of which are shown in FIGS. 76–79. These constructions may also have directional characteristics similar to that of the closed arrays discussed above, and may be included in compound tabularly concentric constructions as shown in FIGS. 80–81.

Figure 39:
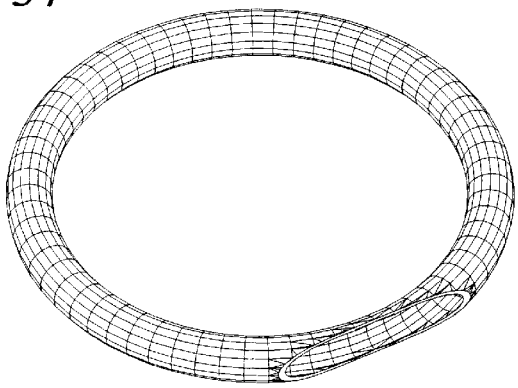
FIG. 39 is a perspective view of a hollow tubular toroidal element sectioned to show its interior.
Figure 40:
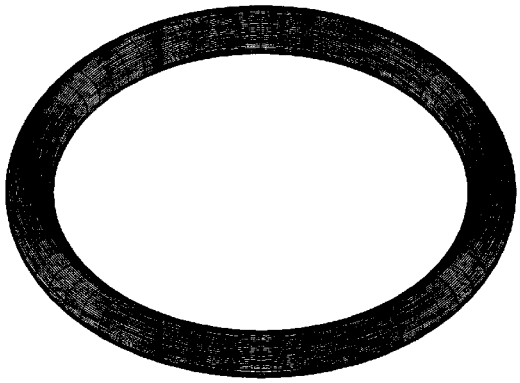
FIG. 40 is a perspective view of a filament wound toroidal element with the filament toroidal tube bundle radially bound.
Figure 41:
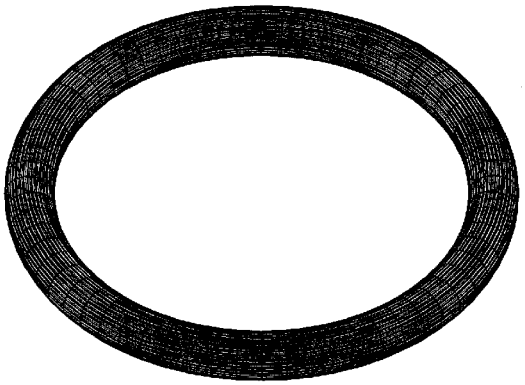
FIG. 41 is a perspective view of a filament wound toroidal element with relatively thicker filaments than that of the toroid shown in FIG. 40.
Figure 42:
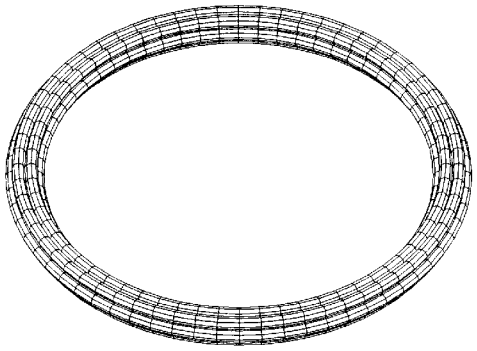
FIG. 42 is a perspective view of a toroidal element comprised of seven coaxial toroidal elements, the tubes of which are bonded, bound or otherwise connected to one another.
Figure 45:
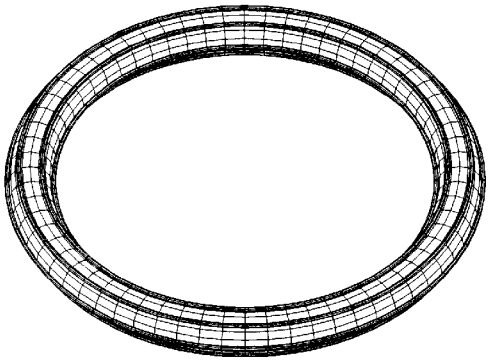
FIG. 45 is a perspective view of a toroidal element comprised of a tubularly central toroidal element whose tube is bordered by other toroidal elements of lesser tubular diameter which are bonded, bound or otherwise connected to the central element.
Figure 43:
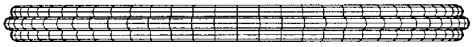
FIG. 43 is a side view of the toroidal element shown in FIG. 42.
Figure 46:
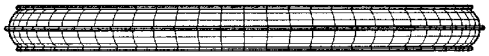
FIG. 46 is a side view of the toroidal element shown in FIG. 45.
Figure 44:
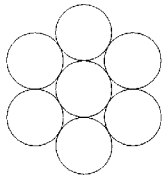
FIG. 44 is a cross section of the tube of the toroidal element shown in FIG. 42.
Figure 47:
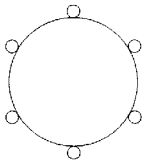
FIG. 47 is a cross section of the tube of the toroidal element shown in FIG. 45.
Figure 48:
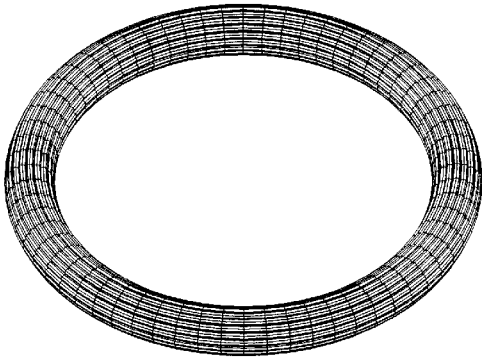
FIG. 48 is perspective view of a toroidal element the tube of which is comprised of 18 coaxial toroidal elements, the tubes of which are bonded, bound or otherwise connected to one another.
Figure 49:
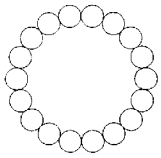
FIG. 49 is a cross section of the tube of the toroidal element shown in FIG. 48.

Fundamental toroidal elements may be fabricated from what can be considered solid material, such as metal, polymers, foams, wood, or tubes of such material, as in FIG. 39. Such, fundamental toroidal elements may even be molded as toroidal elements connected in modules, partial or whole, in the form of a framework of a toroidal element. Fabrication of fundamental toroidal elements may proceed from any standard manufacturing method, such as winding as indicated in FIGS. 34–36 and FIG. 40, extrusion, injection molding, layering of resins and fabrics, and fiber compositing.

Toroidal elements may also be constructed from other toroidal elements without the use of connected arrays, such as in FIGS. 41–49 showing toroids consisting of constituent toroids that are connected coaxially. The constituent toroidal elements of these constructions may themselves be fundamental or constructed, even from arrays of connected toroidal elements. Another example of a toroidal element constructed without the use of a circular array and which may be employed as fundamental is shown in FIGS. 66–69. The interlinkage, as shown in FIGS. 70–75, forms an apparent braid of six toroids about a central axial toroid, all of which are identical in dimension. The principal characteristic of this type of toroidal element is that the apparent braid of toroids rotates freely about its circular axis impeded only by the internal friction of the toroids and the frictional forces between them.

Figure 50:
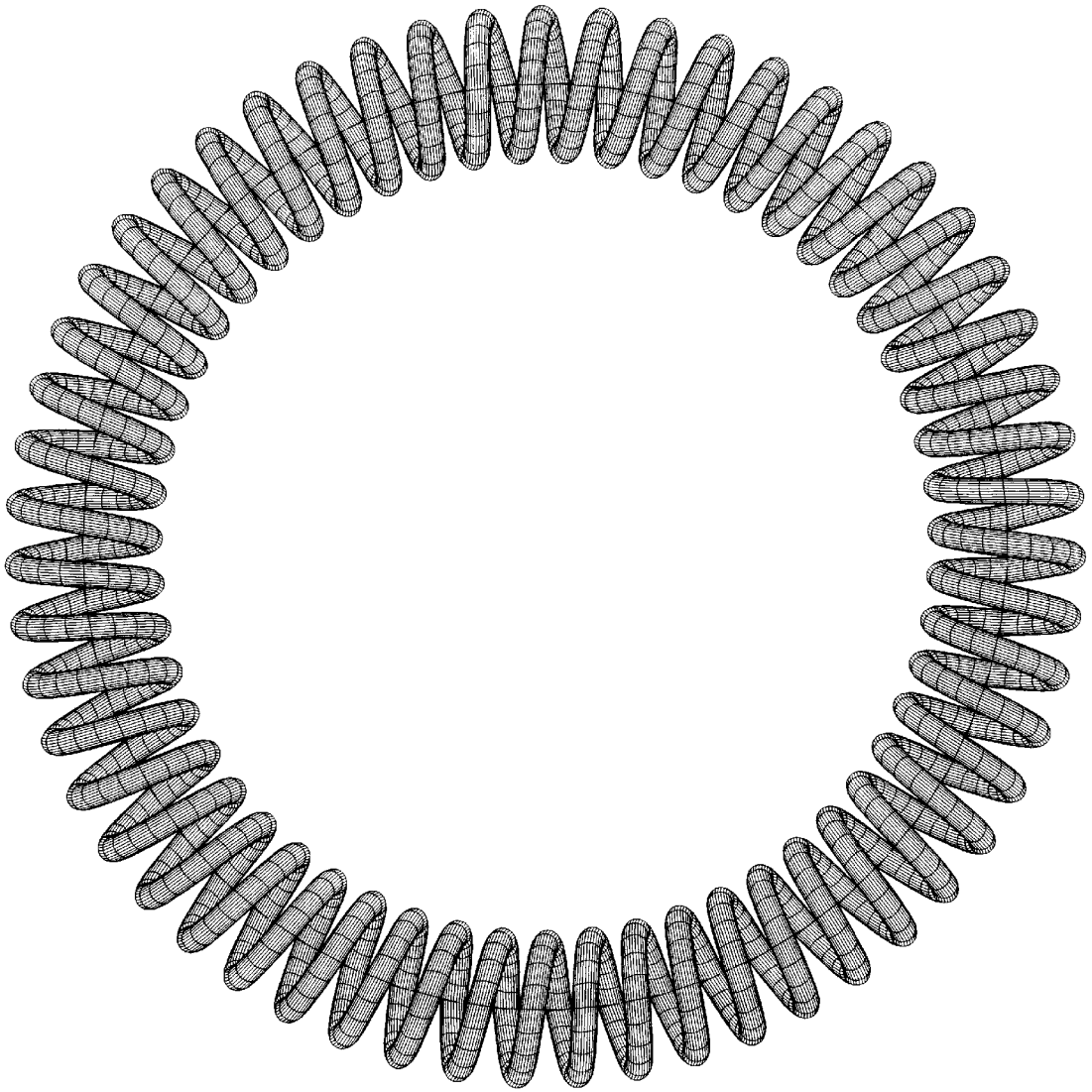
FIG. 50 is a plan view of a toroidal element with a circular spiral tube.
Figure 51:
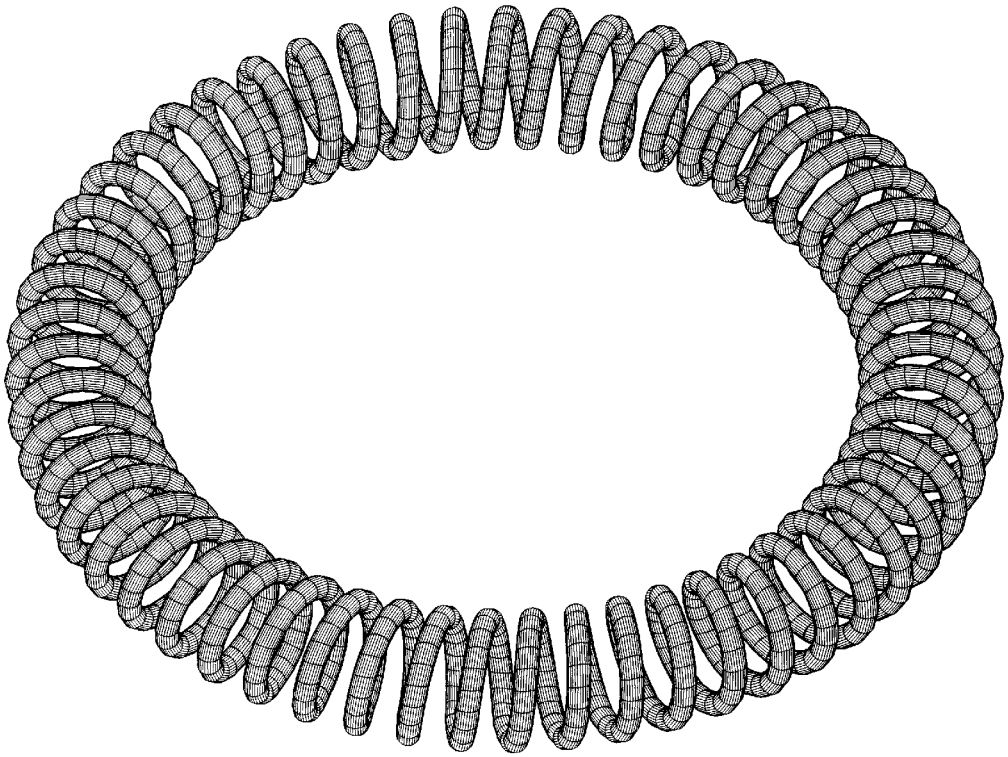
FIG. 51 is a perspective view of the toroidal element shown in FIG. 50.
Figure 52:
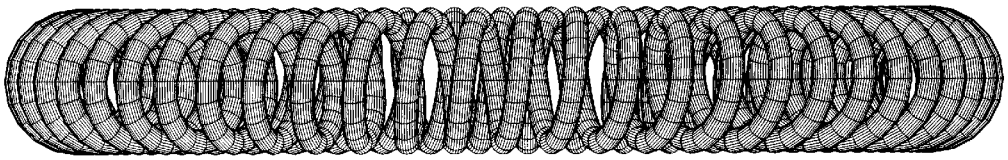
FIG. 52 is a side view of the toroidal element shown in FIG. 51.
Figure 53:
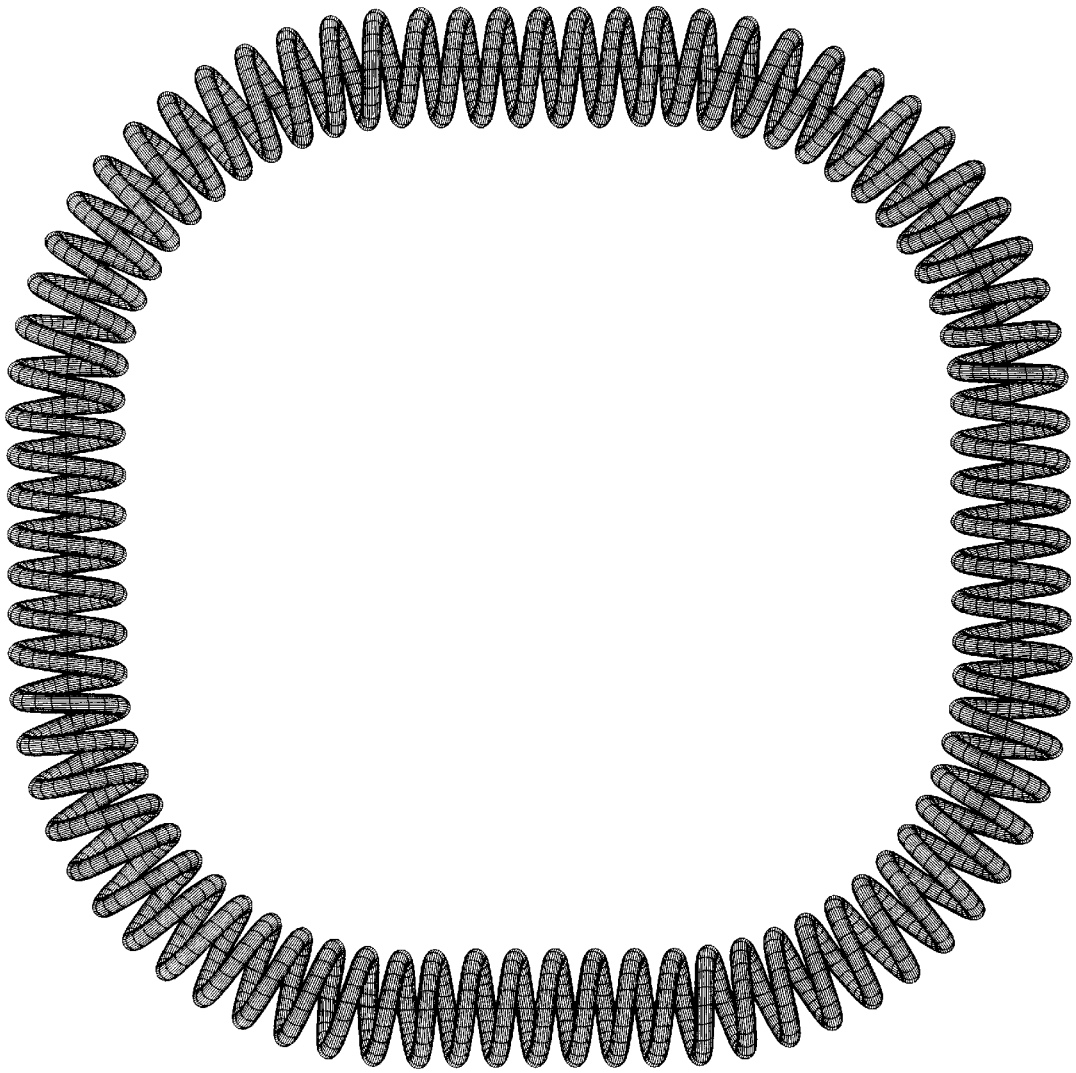
FIG. 53 is a plan view of a toroidal element with a rounded rectangle spiral tube.
Figure 54:
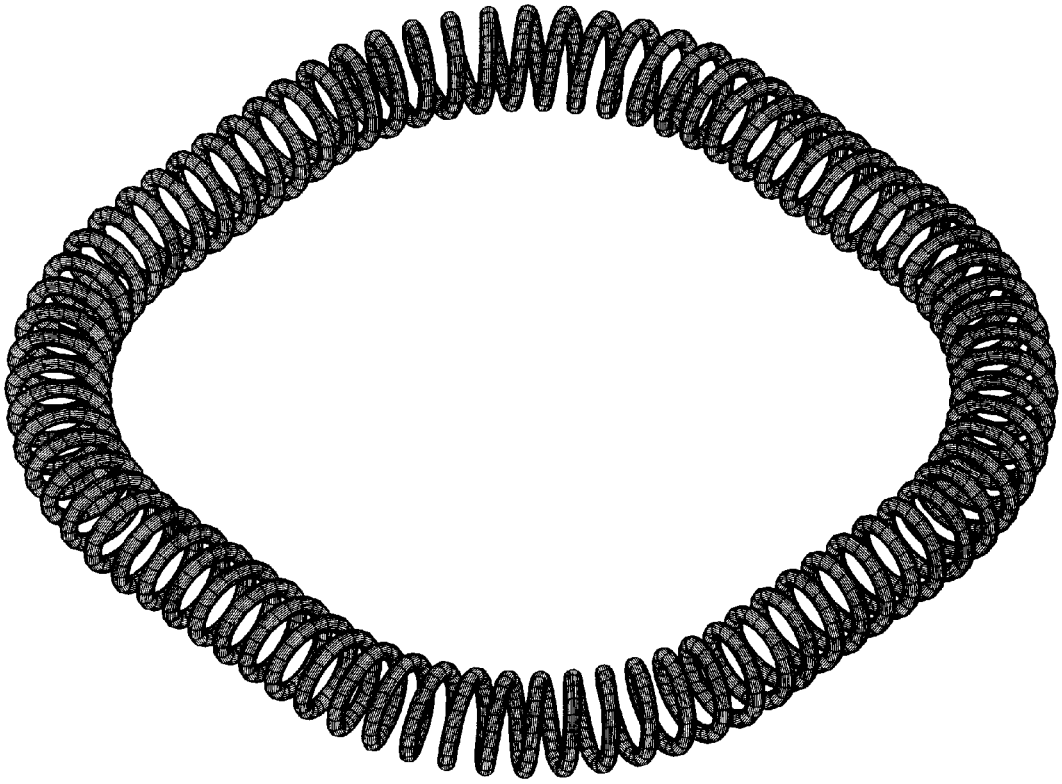
FIG. 54 is a perspective view of the toroidal element in FIG. 53.
Figure 55:
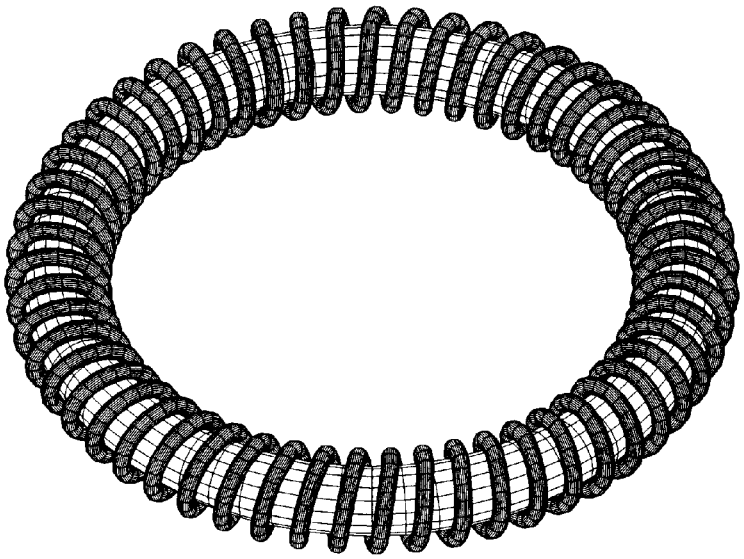
FIG. 55 is a perspective view of a toroidal element comprised of a spiral tube toroidal element as shown in FIG. 50 which encloses another toroidal element within the spiral tube.
Figure 56:
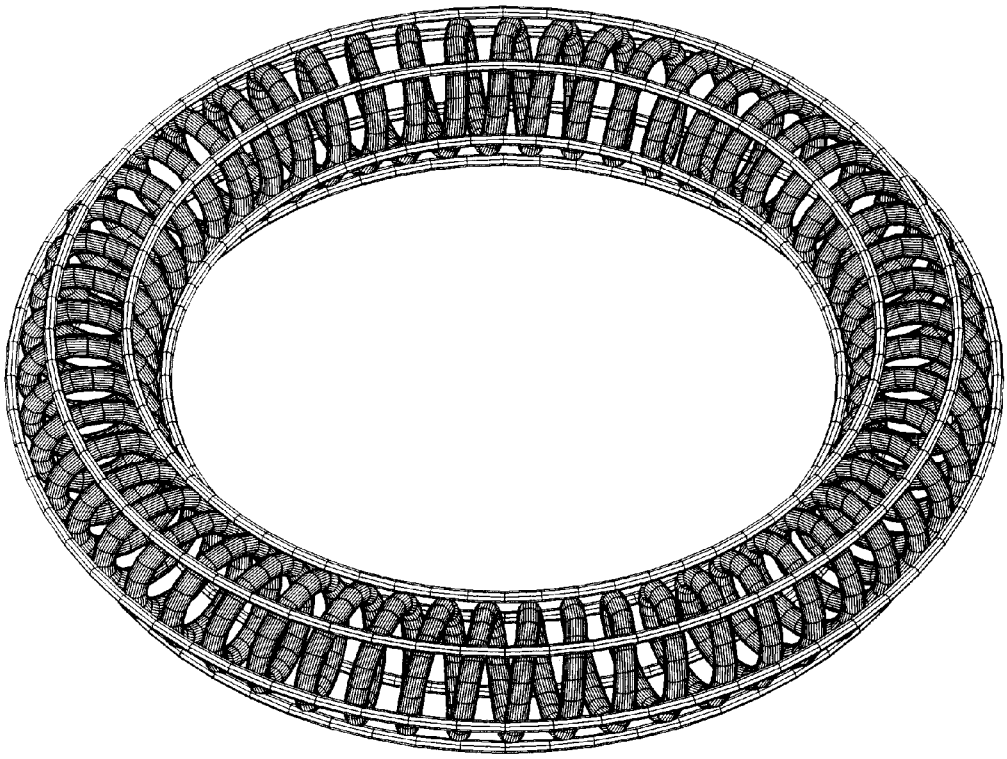
FIG. 56 is a perspective view of a toroidal element with a circular spiral tube as shown in FIG. 50 the tube of which is bordered by other coaxial toroidal elements of lesser tubular diameter which are bonded, bound or otherwise connected to the central toroidal element.
Figure 57:
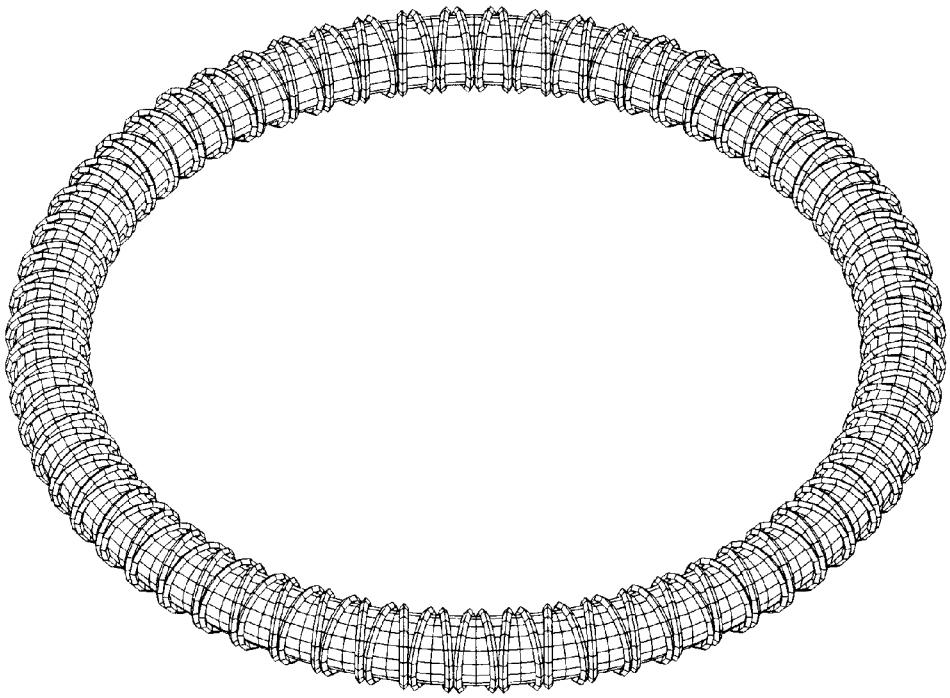
FIG. 57 is a perspective view of a toroidal element comprised of a toroidal element as shown in FIG. 15 which encloses another toroidal element within its tube.
Figure 58:
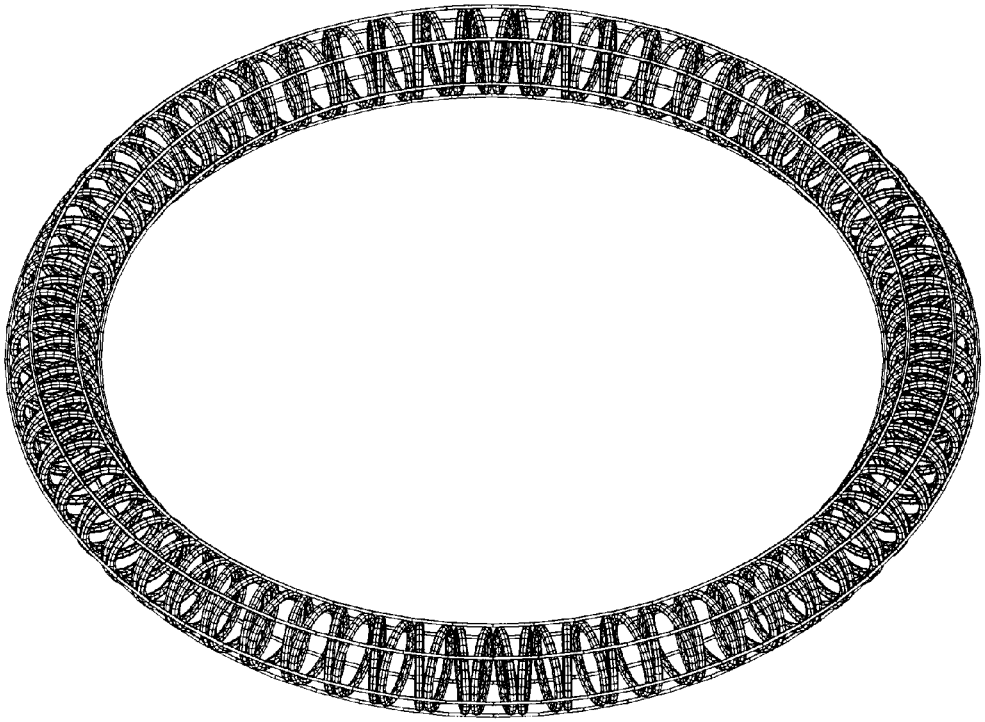
FIG. 58 is a perspective view of a toroidal element as shown in FIG. 15 the tube of which is bordered by other toroidal elements of lesser tubular diameter which are bonded, bound or otherwise connected to the central toroidal element.
Figure 59:
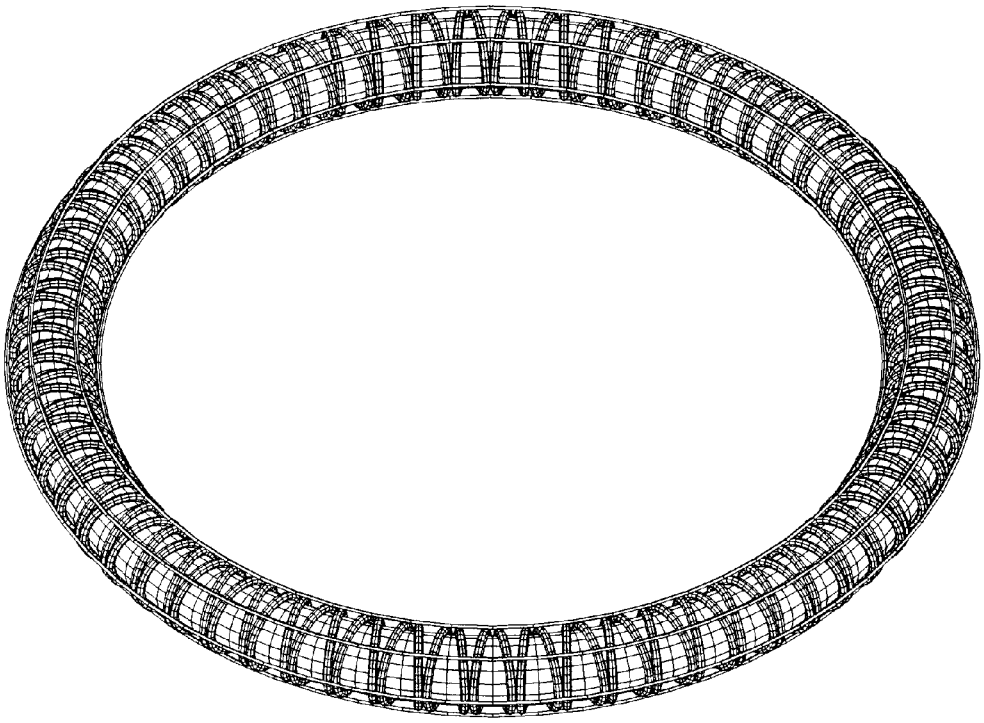
FIG. 59 is a perspective view of a toroidal element as shown in FIG. 57 the tube of which is bordered by other toroidal elements of lesser tubular diameter which are bonded, bound or otherwise connected to the central element.
Figure 60:
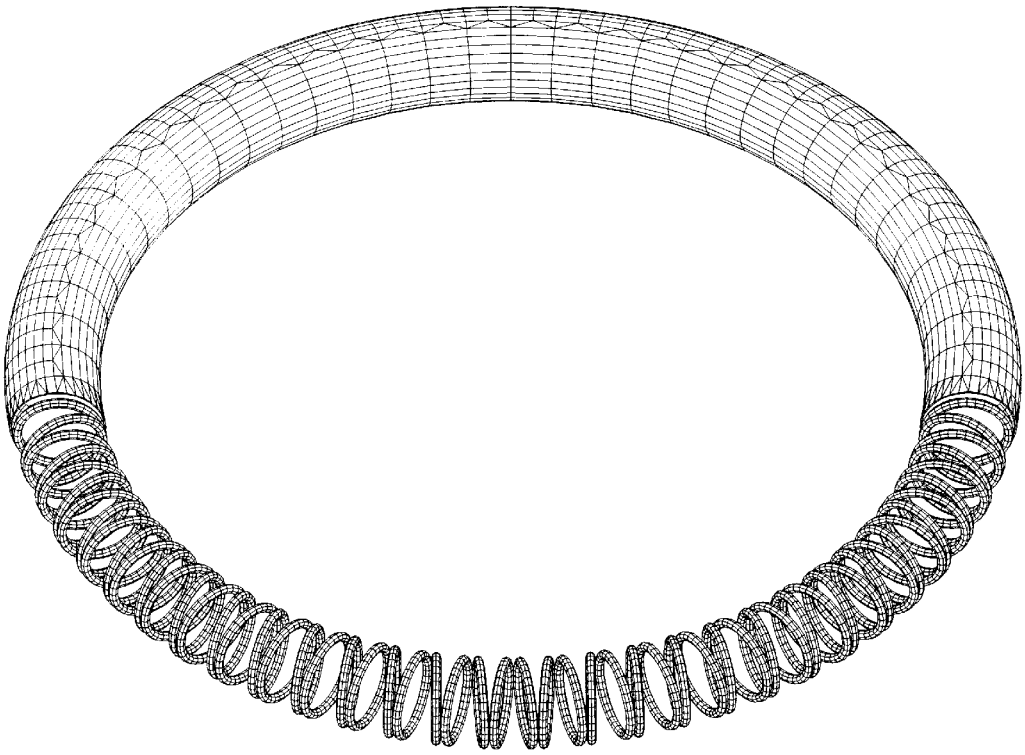
FIG. 60 is a cutaway perspective view of a toroidal element comprised of a toroid as shown in FIG. 15 the tube of which is sheathed by the tube of another toroidal element, which may be bonded, bound or otherwise connected to the central element.
Figure 61:
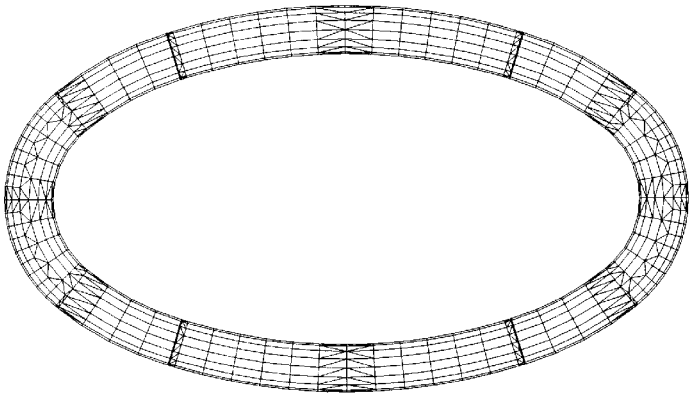
FIG. 61 is a plan view of a elliptical toroidal element.
Figure 62:
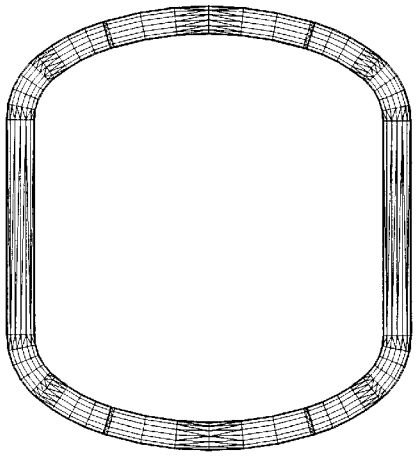
FIG. 62 is a plan view of a toroidal element with two opposite semi-eliptical sides and two opposite straight sides.
Figure 63:
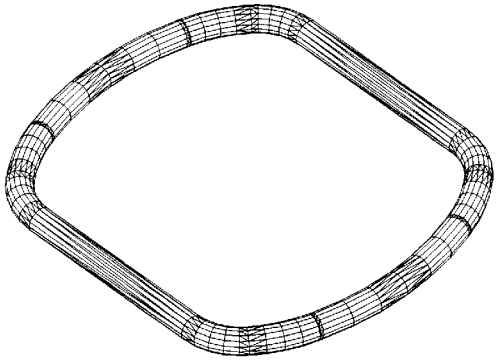
FIG. 63 is a perspective view of the toroidal element in FIG. 62.
Figure 64:
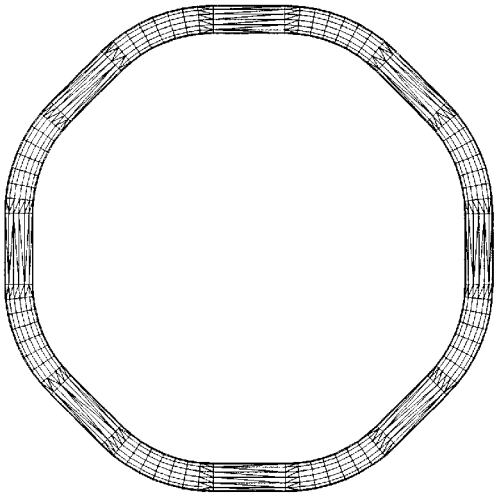
FIG. 64 is a plan view of a rounded octagon toroidal element.
Figure 65:
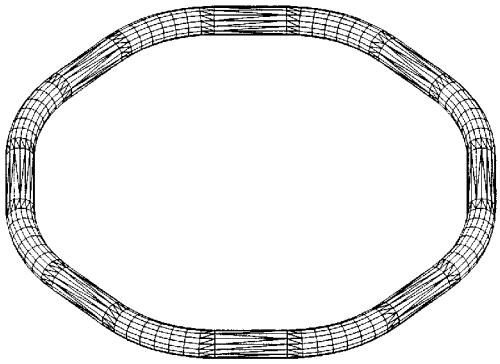
FIG. 65 is a perspective view of the toroidal element in FIG. 64.
Figure 66:
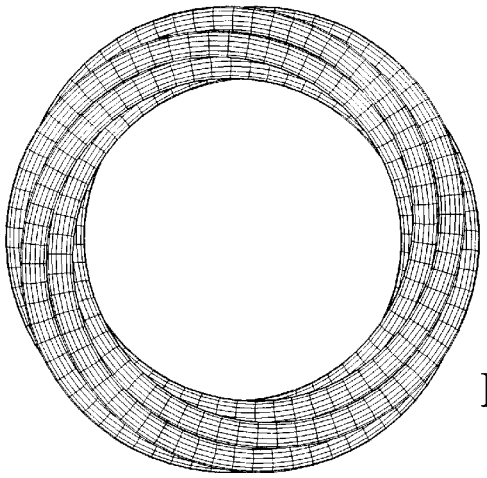
FIG. 66 is a plan view of a toroidal element consisting of seven interlinked toroidal elements, the tubes of which may be bonded, bound or otherwise connected to one another.
Figure 67:
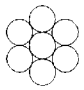
FIG. 67 is a cross section of the toroidal element in FIG. 66.
Figure 68:
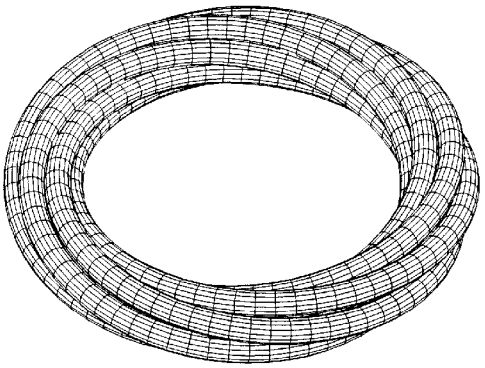
FIG. 68 is a perspective view of the toroidal element in FIG. 66.
Figure 69:
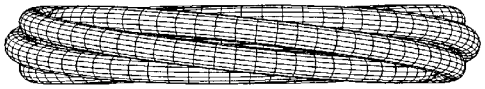
FIG. 69 is a side view of the toroidal element in FIG. 66.
Figure 70:
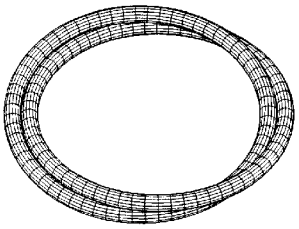
FIGS. 70 through 75 show the method of interlinkage in 6 steps which produces the toroidal element in FIG. 66.
Figure 71:
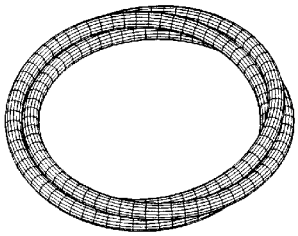
Figure 72:
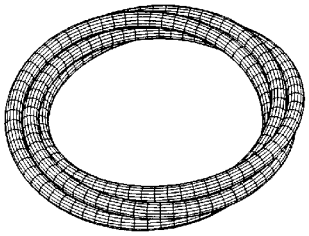
Figure 73:
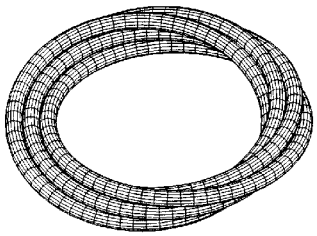
Figure 74:
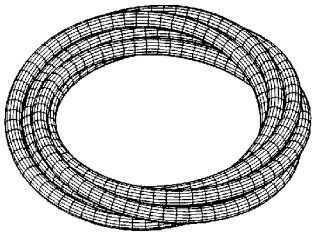
Figure 75:
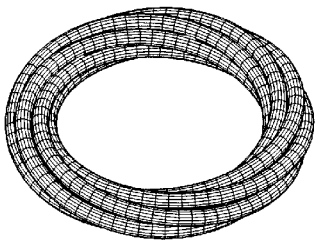
Figure 76:
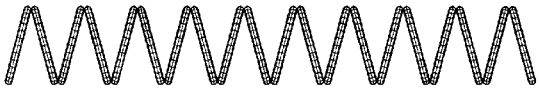
FIG. 76 is a side view of a plurality of pairs of toroidal elements as shown in FIG. 9 connected in a linear array to form a straight cylindrical rod, post or tube.
Figure 77:
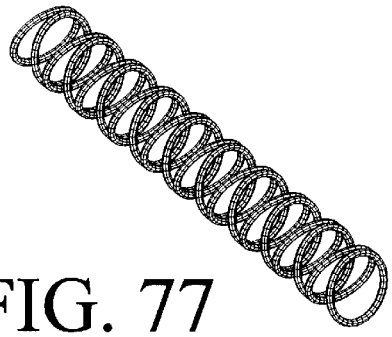
FIG. 77 is a perspective view of the linear array shown in FIG. 76.
Figure 78:
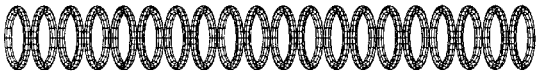
FIG. 78 is a side view of a plurality of pairs of toroidal elements with the orientation shown in FIG. 10 connected in a linear array to form a straight cylindrical rod, post or tube.

It is possible to construct a toroidal element with a tube defined by a closed spiral, as shown in FIG. 50–52, and various other spiral forms exemplified in FIGS. 53 and 54. The principal characteristic of this type of toroidal element is that the tubular coil rotates freely about its tubular axis, impeded only by internal friction, which is the circle within and at the center of the tube, impeded only by internal friction. Such a toroidal spiral can transmit torque about the tubular axis of the tube to any point around the tube. Such a toroidal spiral can be stabilized by another toroidal element to form a compound element as shown in FIG. 55. Such a toroidal spiral can also be stabilized by toroidal elements connected to the periphery of the tube as shown in FIG. 56, so that the rotation of the spiral about its tubular axis is regulated by the peripheral toroidal elements. The toroidal spiral element may itself be a spiral array of connected toroidal elements.

Other toroids formed by closed arrays of connected toroidal elements can be stabilized and their torsion stress regulated as shown in FIGS. 57–60, as in the case of the toroidal element formed by a spiral, which can be seen by the comparison of FIGS. 55 and 56 with FIGS. 57–60.

Virtually any shape of toroidal element is possible as shown in FIGS. 61–65 and FIGS. 320–325, and may be constructed by either appropriately shaped arrays of toroidal elements, or fabricated as fundamental toroids.

The combination and orientations in which toroidal structural modules may be constructed with the use of couplings is exemplified by the categories shown in FIGS. 82–95. Examples of couplings that can be used to achieve such combinations and orientations are shown in FIGS. 96–101 and FIGS. 102–122 for two-element connections, as shown in FIGS. 1–4; in FIGS. 102–107 for four-element connections, as shown in FIGS. 92–95; and in FIGS. 108–119 for the types of connections shown in FIGS. 82–87.

The spline grip couplings and the corresponding spline collars of toroidal elements are among several other means contemplated for achieving connections between toroidal elements and couplings. Examples of such other means are welding, gluing, fusing; the use of fasteners, such as pins, screws and clamps; and the mating of the coupling with a toroidal element of non-circular cross section.

Couplings may also be designed with various mechanical devices for integrated securing against movement of the toroidal element held. An example of such a coupling is shown in FIGS. 96–101, a split block coupling in which each of the parts of the block 61 and 63 are fitted with spline grips 62. The manner in which the coupling effects the connection is to close the block sections 61, 63 around the spline collars of the toroidal elements to be connected, and bind the block with the compression band 65 tightened into the band groove 64 with a tightening device 66, such as a ratcheted roller on which the compression band is wound.

Similarly the coupling shown in FIGS. 102–107 is a split block coupling in which each of the parts of the block, 71, 73 and 77 are fitted with spline grips 72. The manner in which the coupling effects the connection is to close the block sections 71, 73 and 77 around the spline collars of the toroidal elements to be connected, and bind the block with the compression band 75 tightened into the band groove 74 with the tightening device 76.

The coupling shown in FIGS. 108–119 is an open-end coupling in which each of the end caps 83 and 87 and the main body of the coupling 81 are fitted with spline grips 82. The manner in which the coupling effects the connection is to close end caps 83 and 87 around the spline collars of the torsion elements to be connected, and bind the caps to the main body block with the compression bands 85, which are locked to the main body by the lock pins 88 and tightened into the band grooves 84 with the tightening devices 86.

Toroidal elements such as 102, 104, 106, 108, and 110 shown in FIGS. 124–128 with spline collars 101, 103, 105, 107 and 109, are those which are connected by the couplings which have spline grips. The spline collars may be integral to the toroidal element, or may be attached by a means of bonding the spline collar to the toroidal elements or their components, by means of a mechanical linkage within the spline collar, or by attachment or fastening to the spline collar. If a structural element does not have spline collars attached, other forms of connection are possible, such as with a coupling with form grips, or by internal connection with toroidal elements constituting such structural elements.

An example of a split-block coupling with form grips is shown in FIGS. 120–123 for the simplest two element connection as shown in FIGS. 1–4. Form grips can be a structural foam that cures to a permanent shape after being compressed about the toroidal element, or a resilient elastic cushion that grips the toroidal element. The coupling is caused to grip the toroidal element by closing the block sections 91 and 93 around the toroidal elements to be connected, so that the form blocks 92 compress and conform to the shape of the toroidal elements, moderated by the cushions 94. The block sections of the coupling are then locked in place by either compression bands, as used on the split-block coupling shown in FIGS. 96–101, or other means of fastening the block together, such as screws or bolts.

Tower structures may be formed by connected stacking of prismatically or cylindrically shaped layers of connected toroidal elements, such as the cylindrical structural modules shown in FIGS. 154–157, or of layers with a larger number of toroidal elements, as shown in FIG. 279. (The terms cylindrical and prismatic (or prismatical) shall be used synonymously and interchangeably hereinafter.) Such layers are level layers, and are shown in horizontal orientation throughout FIGS. 248–281. Also as shown in FIGS. 248–281 such level layers of toroidal elements are arranged in closed courses. The cylindrical tower shown in FIG. 279 is formed by such connected stacking of such level layers, each layer having the same number of toroidal elements and the same size, the toroidal elements comprising each layer having the same size, and the toroidal elements being of the same size from layer to layer. The connected stacking between adjacent layers is accomplished by the connection of each toroidal element in one layer to one corresponding toroidal element in each adjacent layer. The tower structure thus formed is such that each toroidal element in all but the top and bottom layers can be connected in the structure by a "four point connection", which is a connection at four points on a toroidal element to the adjacent toroidal elements: connection to each of the adjacent toroidal elements above and below, and connection to each of the toroidal elements laterally adjacent within the layer.

Figure 153:
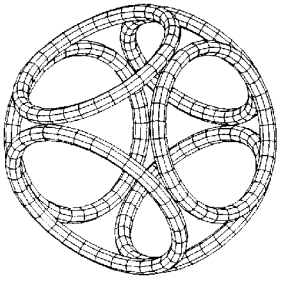
Figure 155:
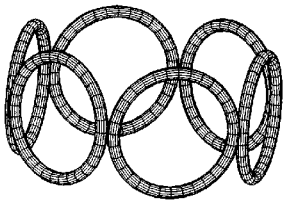
Figure 157:
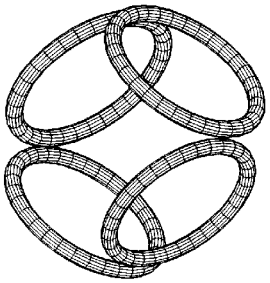
Figure 158:
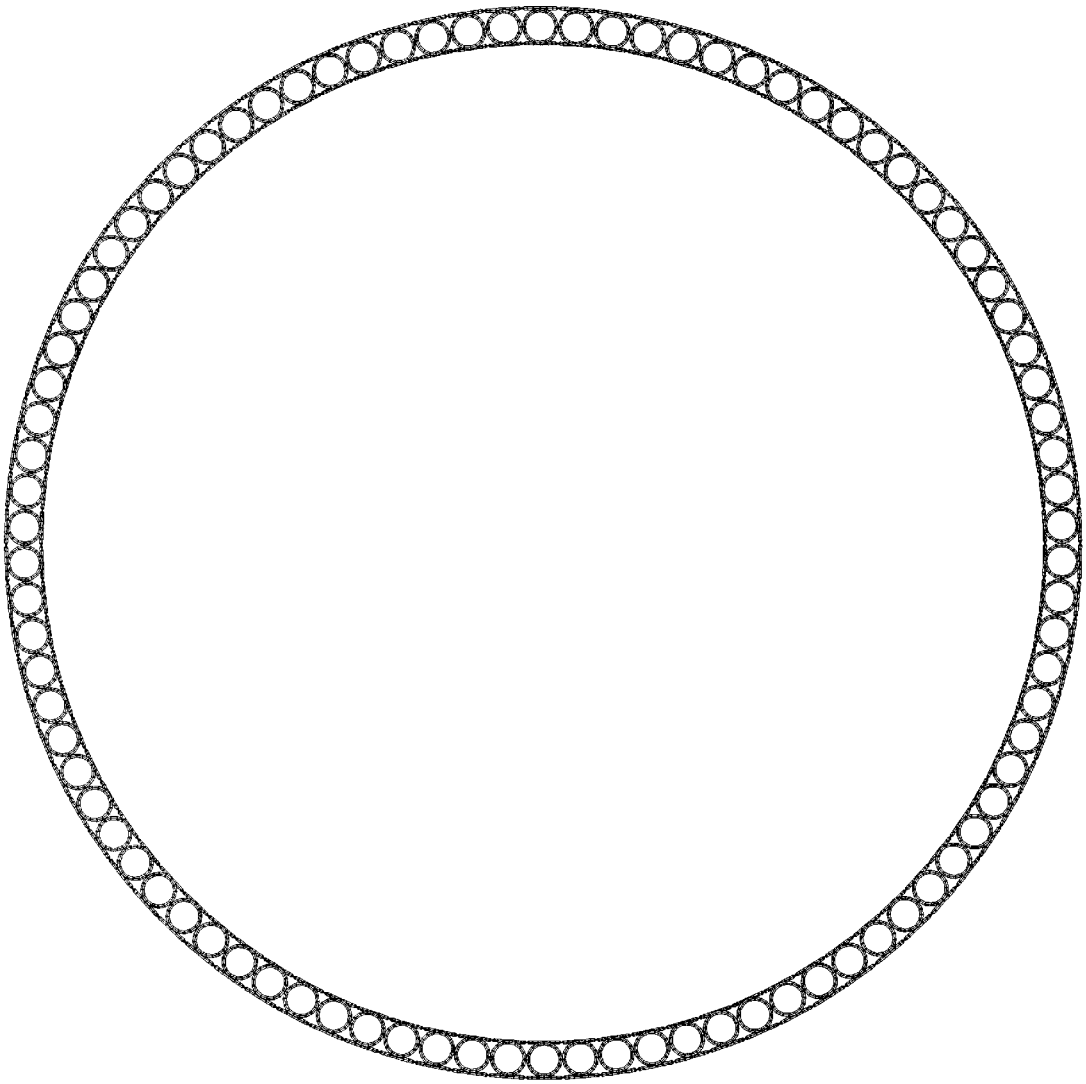
FIG. 158 is a side view of 90 of the structural modules shown in FIG. 156 connected in a circular array.
Figure 159:
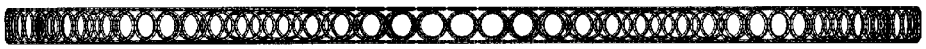
FIG. 159 is atop view of the circular array shown in FIG. 158.
Figure 160:
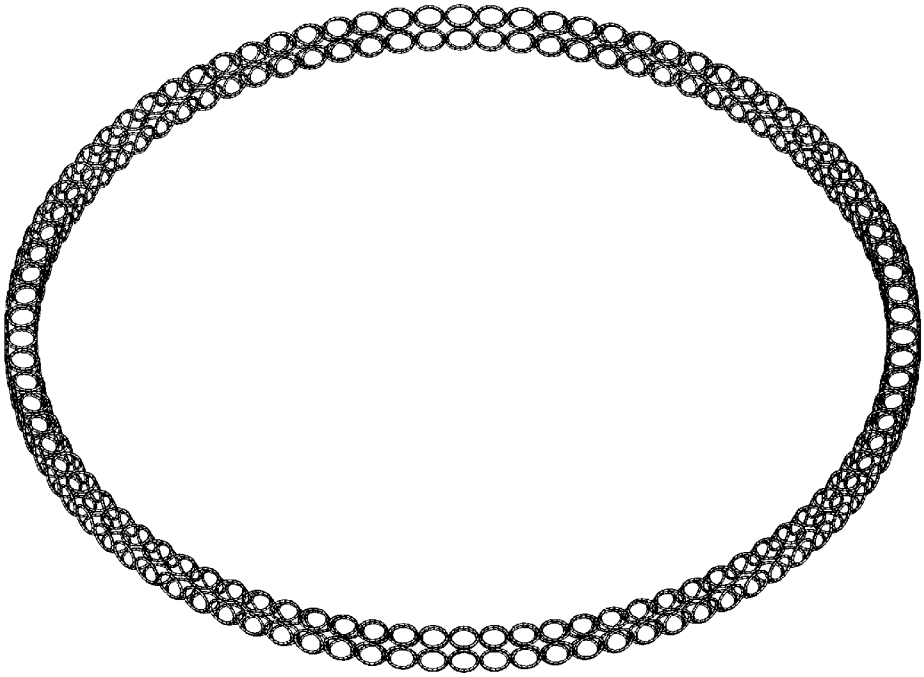
FIG. 160 is a perspective view of the circular array shown in FIG. 158.
Figure 161:
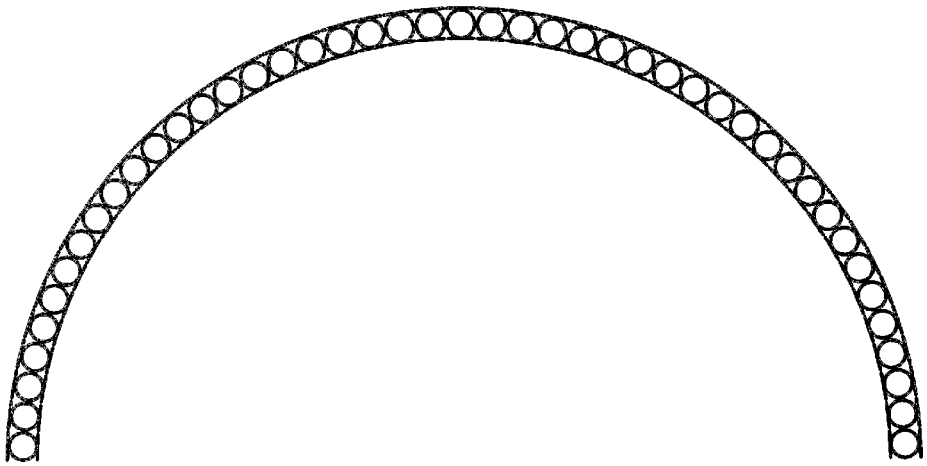
FIG. 161 is a side view of 45 of the structural modules shown in FIG. 156 connected in a semicircular array to form an arch.
Figure 162:
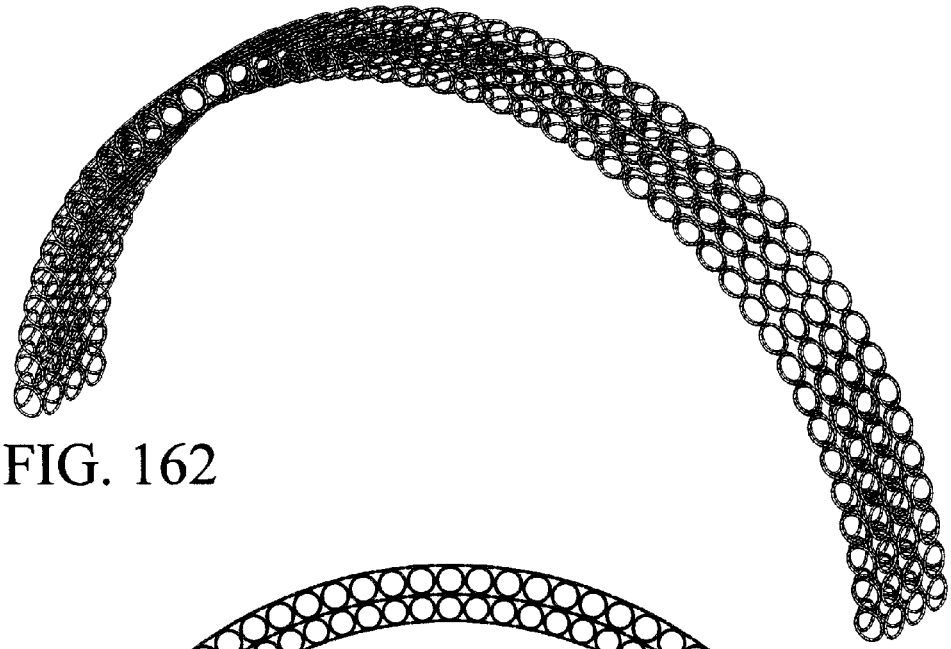
FIG. 162 is a perspective view of a triple width semicircular array as shown in FIG. 161.
Figure 163:
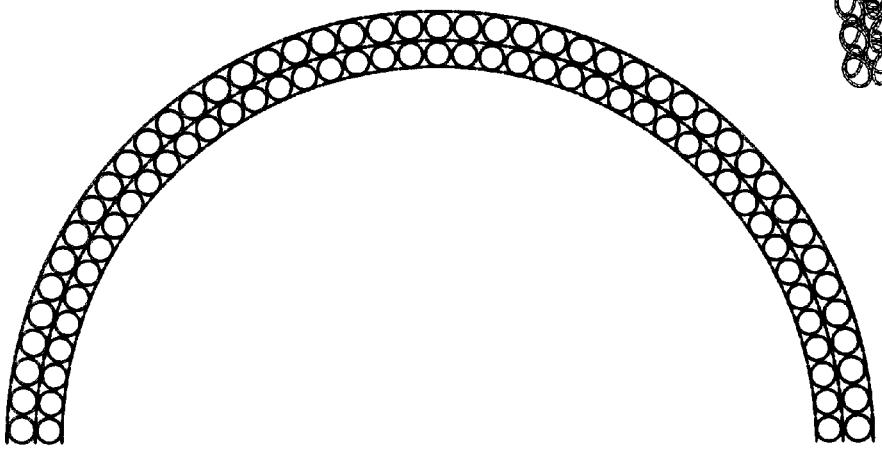
FIG. 163 is a side view of a 2 deep semicircular array shown in FIG. 161.
Figure 164:
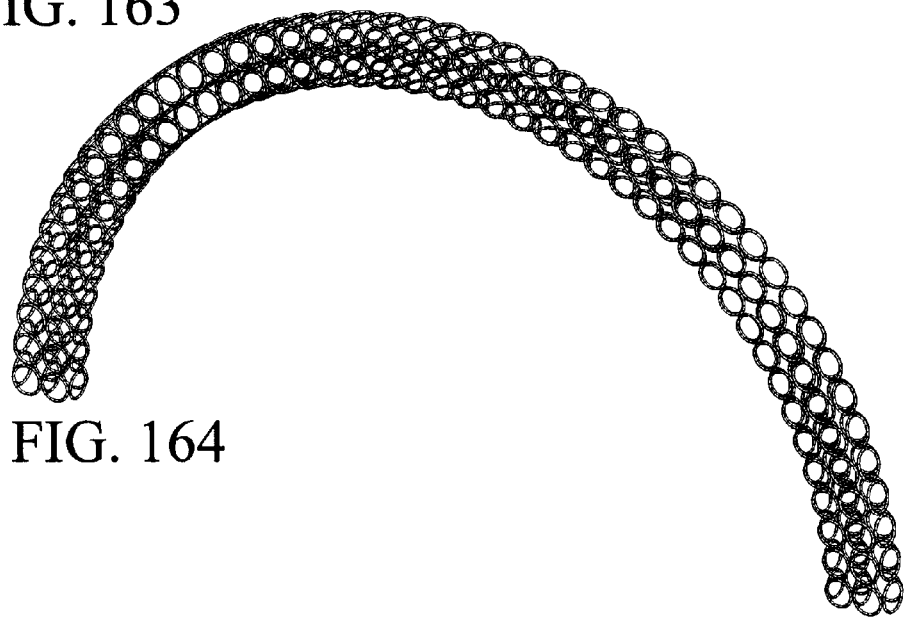
FIG. 164 is a perspective view of the arch structure shown in FIG. 163.

Tower structures may also be formed by connected stacking of pyramidally (used in the sense of pertaining to the frustum of a pyramid) shaped layers of connected toroidal elements. The tower structure shown in FIGS. 248–251 is formed by connected stacking of pyramidally shaped layers of connected toroidal elements that are pyramidal structural modules as shown in FIGS. 152–153, which are comprised of six toroidal elements arranged in the planes of the surfaces of the frustum of a pyramid. The pyramidal structural modules in such a vertical array may be of upwardly diminishing size, as shown in FIGS. 248–250, so that the size and shape of the base of each of the pyramidal layers is the same as the size and shape of the top of the next lower layer upon which it is stacked. The connected stacking between adjacent layers is accomplished by the connection of each toroidal element in one layer to one corresponding toroidal element in each adjacent layer, so that each toroidal element can be connected in the structure by a "four point connection". Such pyramidally shaped layers may have a large number of elements so as to approximate a conical (used in the sense of pertaining to the frustum of a cone) shape, which may form a conical tower structure with connected stacking, such as shown in FIG. 277. (The terms conical and pyramidal shall be used synonymously and interchangeably hereinafter.) In the conical tower shown in FIG. 277 the size of each conically shaped layer of connected toroidal elements is smaller than the next lower layer, i.e. upwardly diminishing in size, but the solid angle of the conical shape is the same; the size of all the toroidal elements in any one layer is the same, but is smaller than the size of the toroidal elements in the next lower layer; and the number of toroidal elements in each of the layer is the same from layer to layer. For conical towers, the fact of upwardly diminishing in size may be stated in a way similar to that for towers of pyramidal layers: the size and shape of the base of each of the conically shaped layers is the same as the size and shape of the top of the next lower layer upon which it is stacked. Again, the connected stacking between adjacent layers is accomplished by the connection of each toroidal element in one layer to one corresponding toroidal element in each adjacent layer, so that each toroidal element can be connected in the structure by a "four point connection".

Domical structures may also be formed, as shown in FIG. 252, by connected stacking of level conically shaped layers of connected toroidal elements, such layers being also upwardly diminishing in size, as indicated with the conical tower shown in FIG. 277, but with an increasing solid (polar) angle of the conical shape. Also as in the case of the conical tower, the size of all the toroidal elements in any one layer is the same, but is smaller than the size of the toroidal elements in the next lower layer; and that the number of toroidal elements comprising each of the layers is the same from layer to layer; so that the toroidal elements in said any one layer will lie in the same domical surface as the next lower layer. Again, the connected stacking between adjacent layers is accomplished by the connection of each toroidal element in one layer to one corresponding toroidal element in each adjacent layer, so that each toroidal element can be connected in the structure by a "four point connection".

Spherical structures such as those shown in FIGS. 253–254 may be formed by connection of the base layers of two of the domical structures shown in FIG. 252, which are in opposite polar orientation (in a convexly opposite relationship), where the bases are of the same size and shape. Where the base layers of the domical structures have the same number of elements, such connection of the base layers may be accomplished by the connection of each toroidal element in the base layer of one domical structure to one corresponding toroidal element in the base layer of the other domical structure, so that each toroidal element in both base layers can be connected in the spherical structure by a "four point connection".

Intermediate latitudinal toroidal elements may also be used between any adjacent layers of connected toroidal elements in a domical structure, in a spherical structure, in a conical/pyramidal tower structure, and in a cylindrical/prismatic tower structure. Such intermediate latitudinal toroidal elements may also be used to effect a second kind of connected stacking, such as where the number of connected toroidal elements comprising the layers to be connected are not the same, by connecting the toroidal elements of each layer to the intermediate latitudinal toroidal element. Such connected stacking permits the use of layers with different numbers of connected toroidal elements in cylindrical tower structures, conical tower structures and domical structures. In the case of domical structures, connected stacking with intermediate latitudinal toroidal elements, as shown in FIGS. 275–276, is used where the toroidal elements are approximately the same size from layer to layer, but with upwardly diminishing numbers of toroidal elements in each layer: the toroidal elements comprising each layer are connected to other layers via intermediate latitudinal elements between the layers. Such connected stacking could also be used to connect two domical structures to form a spherical structure where the numbers of toroidal elements in the base layers of each of the domical structures are not the same: connection of the base layers of the domical structures may be made via an intermediate latitudinal toroidal element which is equatorial to the sphere to be formed.

Structures formed of level layers of connected toroidal elements, such as domical and spherical structures, can also be reinforced longitudinally, as in FIGS. 257–258, which show a spherical structure as shown in FIGS. 255–256 with the toroidal elements connected to the left and right via intermediate longitudinal toroidal elements, where the number of connected toroidal elements is the same from layer to layer.

Layered domical and spherical structures may also be prolate, as shown in FIGS. 259–260, or oblate, as shown in FIGS. 261–262; and may even be prolate along one horizontal axis and oblate along the other perpendicular horizontal axis, as shown in FIGS. 263–267.

A third kind of connected stacking of conically shaped layers having the same number of connected toroidal elements may be used to form domical structures, as shown in FIGS. 268–269, wherein adjacent layers are interleaved so that each toroidal element in one layer is connected to the two toroidal elements in each adjacent layer with which it is interleaved. (The term "interleaved" is used here although it may be more accurate to use the mathematical term "packed on the surface of the dome", as in the mathematical theory of packing.) As in the case of the domical structure shown in FIG. 252, the toroidal elements in each layer is of upwardly diminishing size, but with an increasing angle of the conical shape. Also as in the case of the domical structure shown in FIG. 252, the size of all the toroidal elements in any one layer is the same, but is smaller than the size of the toroidal elements in the next lower layer; and the number of toroidal elements comprising each of the layers is the same from layer to layer, so that the toroidal elements in said any one layer will lie in the same domical surface as the next lower layer. The connected stacking between adjacent interleaved layers is accomplished by the connection of each toroidal element in one layer to the two toroidal elements in each adjacent layer which it is interleaved, so that each toroidal element can be connected in the structure by a "six point connection", which is a connection at six points on a toroidal element to the adjacent toroidal elements: connection to each of the adjacent toroidal elements, two above and two below, and connection to each of the toroidal elements laterally adjacent within the layer. The domical structure thus formed is such that each toroidal element in all but the top and bottom layers can be connected at six points to adjacent toroidal elements. Such interleaved domical structures may also be connected at their bases in an opposite polar orientation (in a convexly opposite relationship), where their respective bases are of the same size and shape, to form a spherical structure as shown in FIG. 270. Where the base layers of the domical structures have the same number of elements, such connection of the base layers can be accomplished by the connection of each toroidal element in the base layer of one domical structure to two toroidal elements with which it is interleaved with the base layer of the other domical structure, so that each toroidal element in both base layers can be connected in the structure by a "six point connection". As with the other domical and spherical structures shown in FIGS. 259–262, domical and spherical structures with interleaved layers may also be prolate, as shown in FIG. 271, or oblate, as shown in FIG. 272; or prolate along one horizontal axis and prolate along the other perpendicular horizontal axis.

Tower structures may also be formed by connected stacking of interleaved layers of connected toroidal elements, as shown in FIG. 278 for conical, and FIG. 280 cylindrical. As in the case of the domical structures connected stacking between adjacent layers is accomplished by the connection of each toroidal element in one layer to the two toroidal elements in each adjacent layer which it is interleaved, so that each toroidal element can be connected in the structure by a "six point connection".

Spherical structures may also be formed by arranging toroidal elements in the planes of the surfaces of an imaginary polyhedra, so that the toroidal elements are connected where they are nearly tangent to one another near the mid points of the edges of a polyhedra. Such spherical structures may be exemplified with regular polyhedra such as the icosahedron and the dodecahedron. The spherical/icosahedral structure shown in FIGS. 239–241 is comprised of twelve connected toroidal elements, each of which is arranged in the plane of one of the surfaces of an imaginary regular icosohedron. The resulting spherical structure is such that each of the toroidal elements lies on the surface of the spherical structure. The spherical/dodecahedral structure shown in FIGS. 242–244 is comprised of twenty connected toroidal elements, each of which is arranged in the plane of one of the surfaces of an imaginary regular dodecahedron. The resulting spherical structure is such that each of the toroidal elements lies on the surface of the spherical structure. The gaps in the resulting spherical structures may be bridged by additional smaller toroidal elements, as shown in FIGS. 245–247, in which gaps in the spherical structure shown in FIGS. 242–244 have been bridged, so that each of the bridging toroidal elements also lies on the surface of the structure.

The formation of a virtually unlimited number of structures are possible with the combination of the basic structures shown here as examples. One example of such a combination is shown in FIG. 281, which is a schematic elevation of a tower structure comprised of a conical base of the same type as the conical structure shown in FIG. 278, with interleaved connection to a section of cylindrical tower structure as shown in FIG. 280, topped by an interleaved connection to a trunkated section of a prolate spherical structure as shown in FIG. 259.

Figure 129:
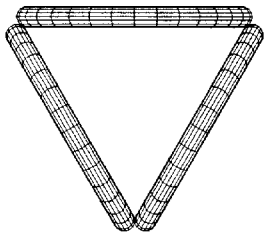
FIG. 129 is a side view of a structural module comprised of three toroidal elements connected to form a triangle.
Figure 131:
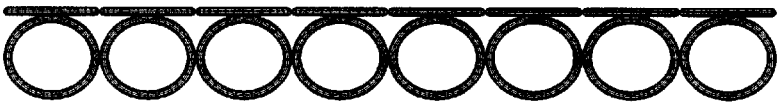
FIG. 131 is a side view linear array of 8 of the structural modules shown in FIG. 129 forming the structure of a post, beam or rod of triangular cross section.
Figure 132:
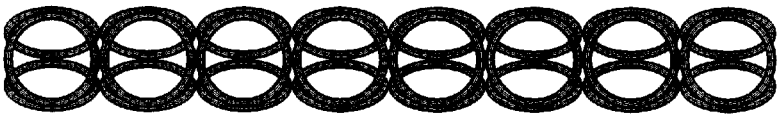
FIG. 132 is a top view of the linear array shown un FIG. 131.
Figure 130:
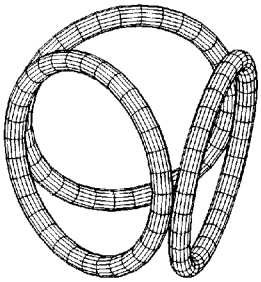
FIG. 130 is perspective view of the structural module shown in FIG. 129.
Figure 133:
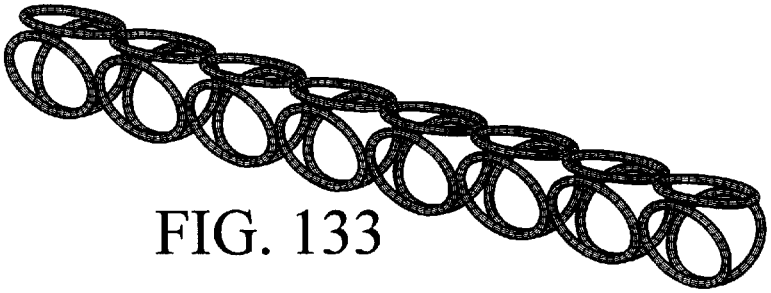
FIG. 133 is perspective view of the linear array shown in FIG. 131.
Figure 134:
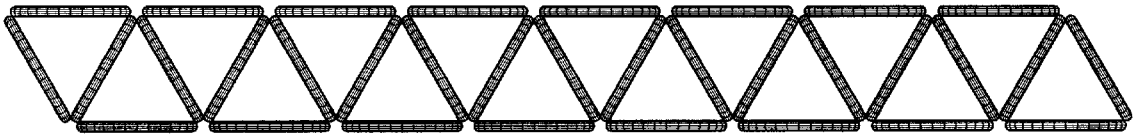
FIG. 134 is a side view of another linear array of 8 of the modules shown in FIG. 129 forming a truss-like structure.
Figure 135:
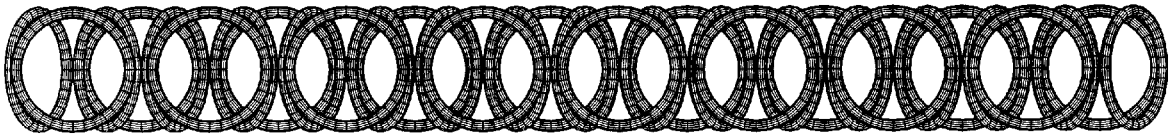
FIG. 135 is a top view of the linear array shown in FIG. 134.
Figure 136:
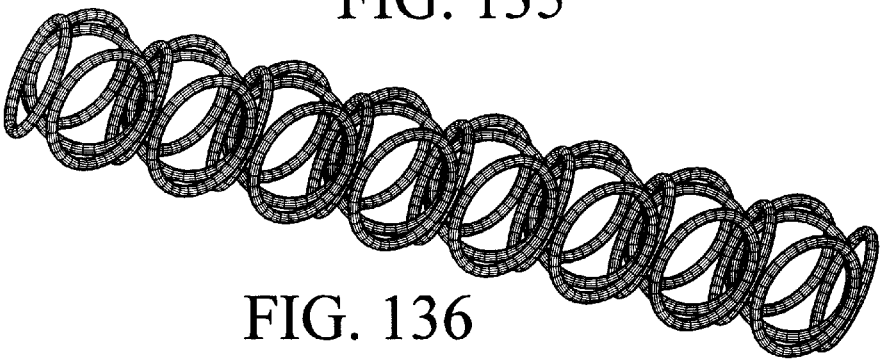
FIG. 136 is a perspective view of the linear array shown in FIG. 134.
Figure 137:
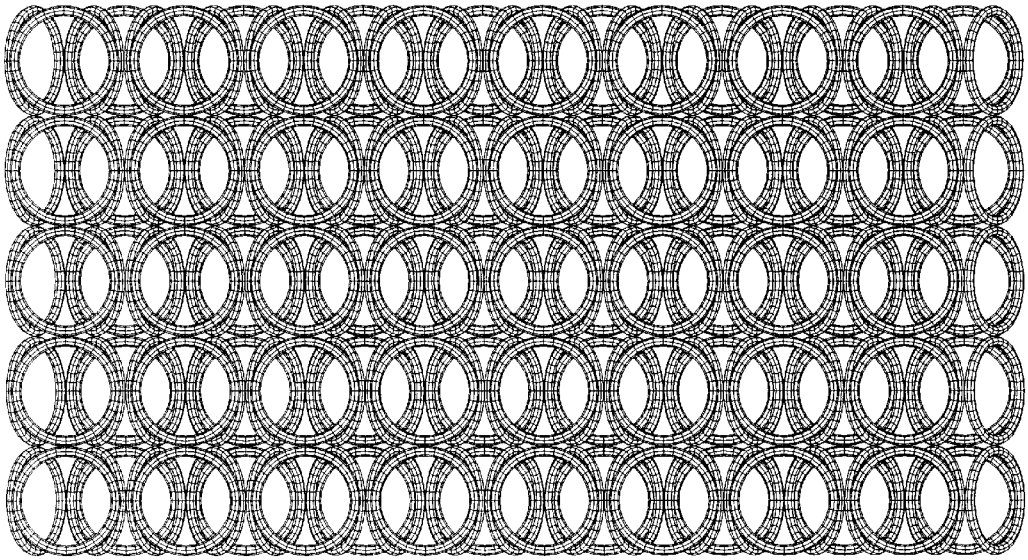
FIG. 137 is a plan view of a 5 wide array of the linear array shown in FIG. 135 to form the structure of a sheet, plate or deck.
Figure 138:
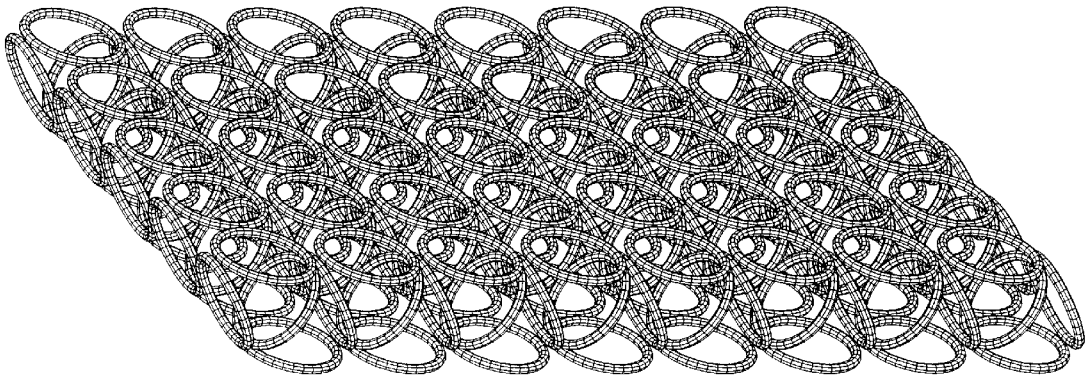
FIG. 138 is a perspective view of the structure shown in FIG. 137.
Figure 139:
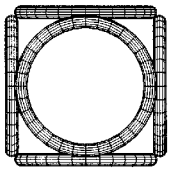
FIG. 139 is a side view of a structural module comprised of six toroidal elements connected to form a rectangular box.
Figure 141:
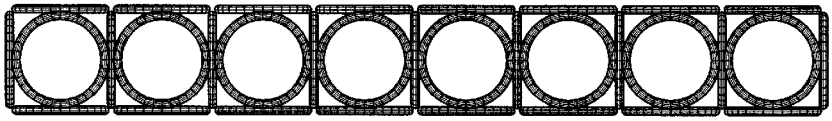
FIG. 141 is a side view linear array of 8 of the structural modules shown in FIG. 139 forming the structure of a post, beam or rod of rectangular cross section.
Figure 142:
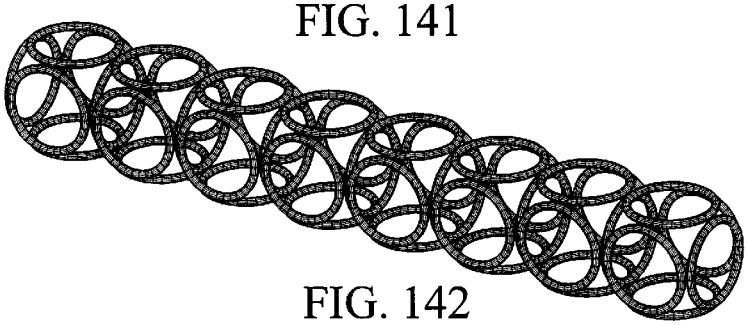
FIG. 142 is a perspective view of the structure shown in FIG. 141.
Figure 140:
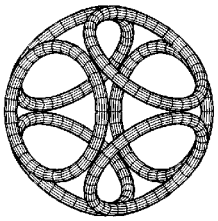
FIG. 140 is a perspective view of the structural module in FIG. 139.
Figure 143:
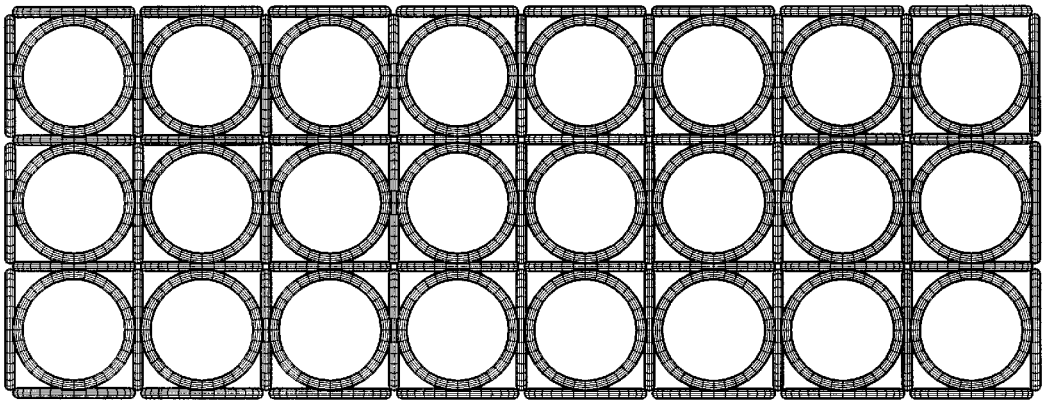
FIG. 143 is a plan view of a 3 deep array of the structure shown in FIG. 141 to form the structure of a joist or beam.
Figure 144:
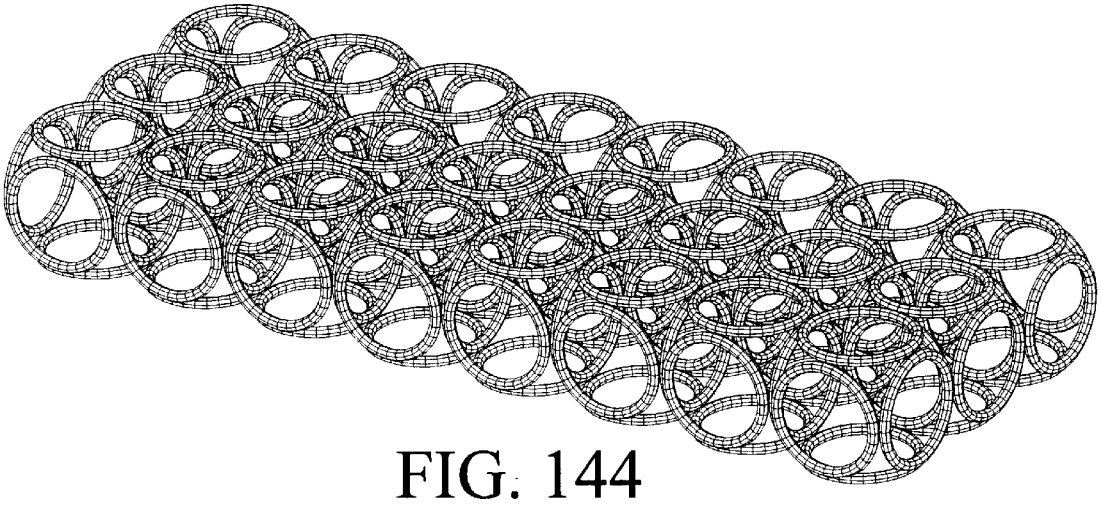
FIG. 144 is a perspective view of the structure shown in FIG. 143.
Figure 145:
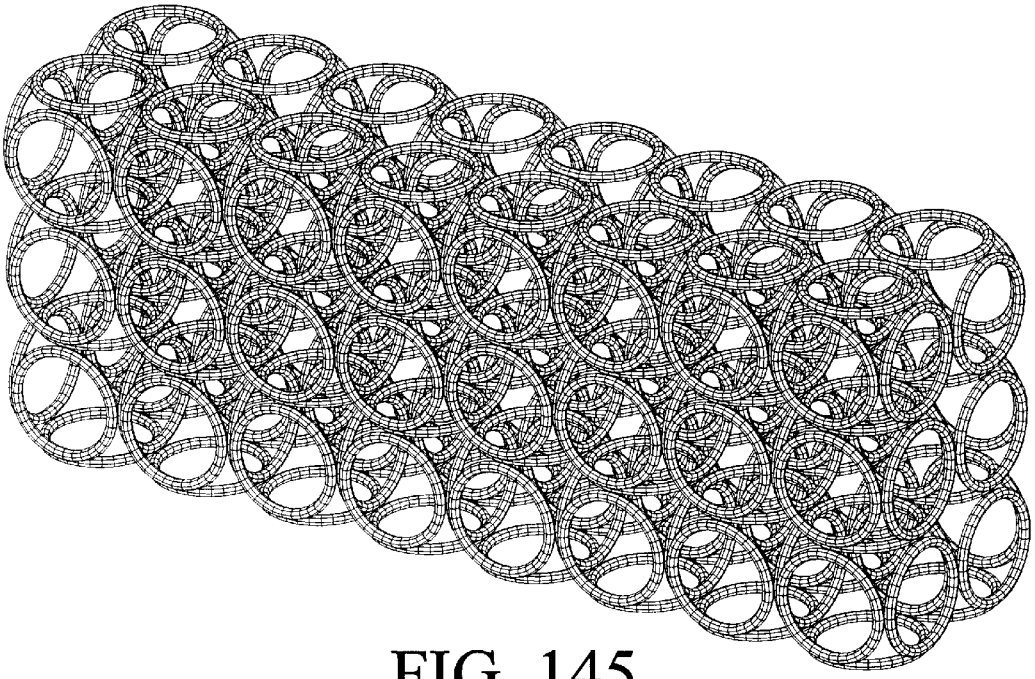
FIG. 145 is a perspective view of a double width of the structure shown in FIG. 143.
Figure 146:
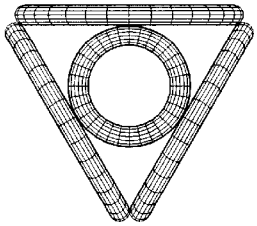
FIGS. 146 through 157 show various structural modules comprised of a plurality of connected toroidal elements (odd numbered showing the plan view and even numbered showing a perspective view).
Figure 148:
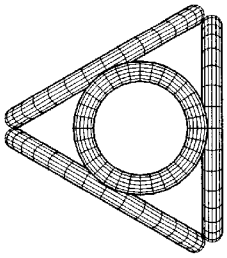
Figure 150:
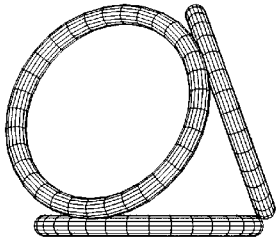
Figure 147:
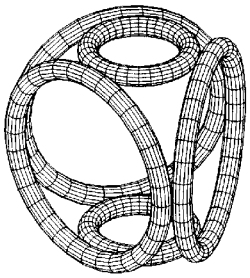
Figure 149:
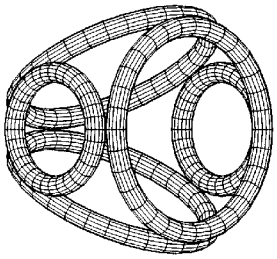
Figure 151:
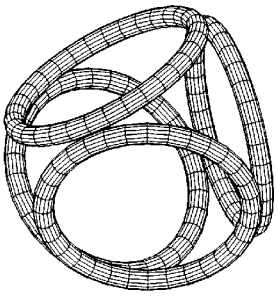

The formation of structures using the system proceeds from constructions which may be referred to as "structural modules". One basic form of structural module is a connected triangular array of toroidal elements shown in FIGS. 129 and 130. Two types of connected linear arrays of the triangular structural module are shown in FIGS. 131–136 which form two different types of rod, beam, or post structures having different structural properties. Connected arrays of such modules can/form plate or deck structures as shown in FIGS. 137 and 138. Another basic structural module is the connected cubic array of toroidal elements which is shown in FIGS. 139 and 140, with a connected linear array shown in FIGS. 141 and 142 forming rod, beam or post structures. Connected arrays of these modules can form plate, deck and joist structures as shown in FIGS. 143–145. As can be seen from some of the examples of possible structural modules in FIGS. 146–157, a wide variation thereof is possible.

Figure 156:
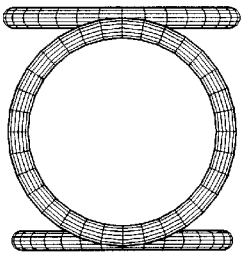

FIGS. 158–164 are examples of the more complex structures, such as arches or ribbing, formed when the structural modules shown are connected in arrays, as with the structural module shown in FIG. 156. The closed array in FIG. 158 may also be another form of toroidal element.

Figure 165:
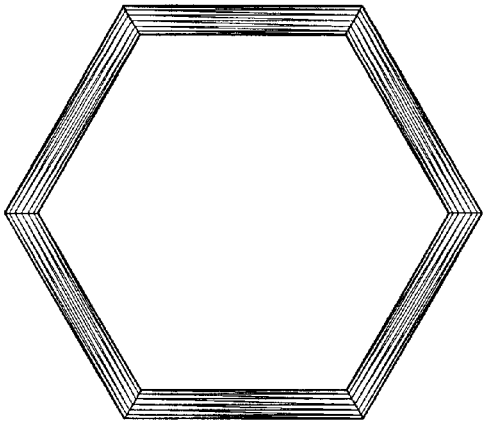
FIG. 165 is a plan view of a hexagonal toroidal element.
Figure 167:
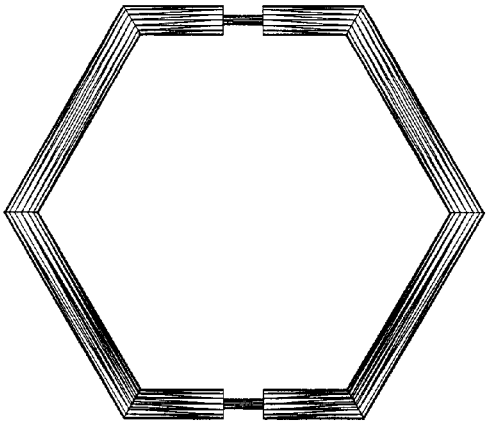
FIG. 167 is a plan view of a hexagonal toroidal element with internal shafts.
Figure 166:
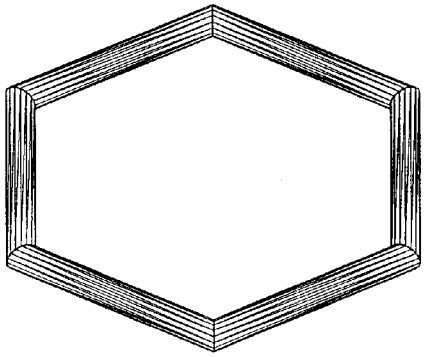
FIG. 166 is a perspective view of the toroidal element shown in FIG. 165.
Figure 168:
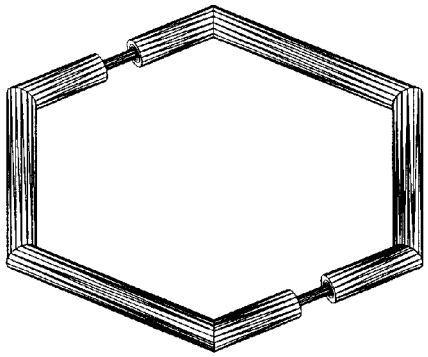
FIG. 168 is a perspective view of the toroidal element in FIG. 167.
Figure 170:
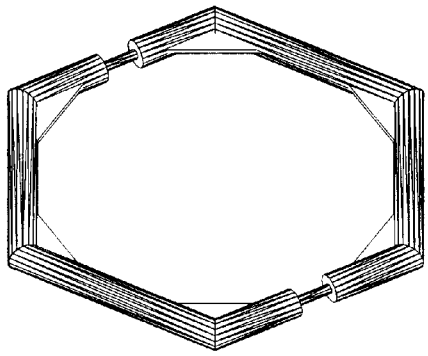
FIG. 170 is a perspective view of the toroidal element in FIG. 169.
Figure 173:
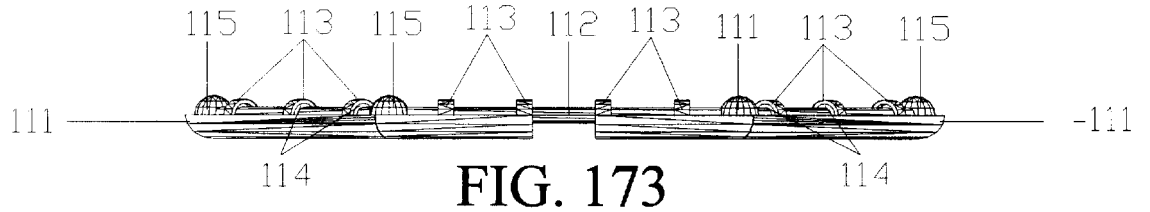

Structures may also be formed from polygonal toroidal elements, such as that shown in FIGS. 165 and 166. The preferred use of such forms is as a body for a complex toroidal element having internal shafts for the absorption of torsion stress as shown in FIGS 167 and 168, with a reinforced version being shown in FIGS. 169 and 170. One variation of this type of toroidal element is shown in FIGS. 171–173, in which torsion stress is absorbed by multiple internal shafts 112. The shafts 112 are the point region of connection with other elements where they are not enclosed by the polygonal body 111 of the element. The shafts 112 rotate on bearings 114 which are positioned by bearing mounts 113 which are fixedly attached to the body 111 . A torque applied to turn the shaft 112 at its point of connection will induce a stress in the shaft 112 if the rotation of the shaft is restricted in some way. In the element shown the shaft 112 to which the torque applied is connected at both ends to other shafts 112 by means of a universal joint 115 which transmits the torque to the other shafts 112. If the rotational motion of any of the shafts 112 are restricted, a torque on the shaft 112 will induce a torsional stress in the shaft 112, and the loading will be transmitted to adjacent shafts 112 by means of the universal joint 115 which connects them. Restriction of motion of a shaft 112 can be provided for by a rotation block 116, which is a means of fixing the end of a shaft 112 to the body 111 or of otherwise resisting rotation so that the end of the shaft 112 will not rotate freely Such a rotation block 116 may be applied to the ends of a shaft 112 to which the torque may be applied where it is exposed for connection to other torsion elements as in FIGS. 174 and 175, or to additional shafts 112 as previously discussed, also shown in FIGS. 176 and 177. If there are no rotational blocks the shafts will be free to rotate. If such free shafts are further connected by universal joints around the sides of the element, as shown in FIGS. 178 and 179, the torque will transmitted from the region of application to the other region of connection. Thus rotation induced at one side of the element will be transmitted to the other side of the element without substantial constraint within the element. However, if the movement of the shafts on one side of the element are restricted, as by connection to another torsion element, a torsional load will result and transmitted equally along the connected shafts and torsion stress will be induced therein.

As with other toroidal elements, polygonal toroidal elements may be connected in arrays, which may be closed to form a toroid as shown in FIGS. 180–185 and 192. The couplings used may be of the split block type shown in FIGS. 186–191. Thus polygonal toroidal elements are another means for implementing the invention. Also as with other toroidal elements a wide variation in form and combination is possible with polygonal toroidal elements, as shown in FIGS. 193–204) in which polygonal elements are shown that range from the pentagonal (FIGS. 193–196) to the octagonal (FIGS. 197–200) to the nonogonal (FIGS. 201–204) and with the number of sides limited only by the application. FIGS. 205–208 demonstrate the manner in which polygonal toroidal elements may be combined with other toroidal elements to form complex toroidal elements with structural features that can be tailored to any structural application. In this last case it should be noted that the toroidal shell enclosing the polygon is partially filled interior to the polygonal toroidal element. Such filling can be with the material of the shell, structural foam or other structures, partially or not at all, again, depending on the structural requirements of the By application.

In addition to the connections between toroidal elements in which the toroidal elements remain outside of the peripheral tube of the other, previously demonstrated in FIGS. 1–4, 8–11, and 82–95, connections between toroidal elements where one element is within the space surrounded by the tube of another are a useful structural alternative to combination by constructing toroidal element& with coaxial tubes. Such a variation is shown in FIGS. 209–218 where the toroidal elements are coaxial, and in FIGS. 219–238 where the axes of the toroidal elements are angulated with each other.

Certain basic structural forms that are difficult to achieve without significant structural disadvantage using conventional structural systems, are natural using the present invention with no structural disadvantages. Among these are symmetrical spherical frameworks, as shown in FIGS. 239–247, and framework towers, as shown in FIGS. 248–251. Other examples of structures for which toroidal elements are similarly suitable are shown in FIGS. 252–281. All of the simple structural forms demonstrated in FIGS. 239–281 are also useful in combination with each other, for reinforcement and for aesthetics, as well as in the design of complex structures.

With regard to the spherical frameworks shown in FIGS. 239–247 another useful structural form is possible with the replication of a section as shown in FIGS. 314–316, and then connecting it in an appropriate scale to a toroidal element forming the spherical surface shown in FIGS. 317–319. The replication of the spherical section shown in FIG. 314 is applied once 141 and then again in smaller scale 142 to the first. This application of the spherical section shown in FIG. 314 can be made in replication to all of the toroidal elements that form the sphere, and yet again and again to all of the toroidal elements that form successive replications, until a practical limit is reached beyond which the process has no structural efficacy.

Generally, structures such as buildings, bridges, even automobiles, seacraft, airframes and spaceframes are considered to be static structures in accordance with their manner of performance. That is, the expectation of performance for such structures is that they respond to the loads to which they are subjected by adequate management of the stress on the materials used and the means by which the materials are connected to comprise the structure. There are some structures that are built with moving parts, such as a roof that opens by sliding or some other aperture that is created by actuation, manual or otherwise, as in the housing of an astronomical observatory. As stated earlier the present invention also contemplates its application to create a dynamic structure, a structure in which the stress of the materials and their connections are managed by automated actuation of the coupling of toroidal elements. Also as stated earlier, this invention contemplates the shifting of the size and shape of structures by actuation of couplings.

Figure 289:
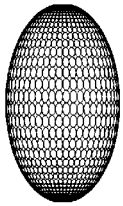
Figure 290:
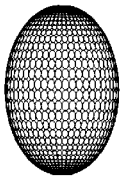
Figure 291:
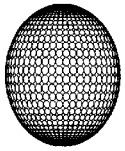
Figure 292:
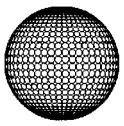
Figure 293:
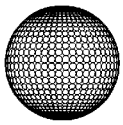
Figure 294:
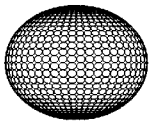
Figure 295:
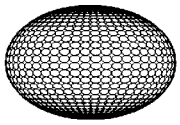
Figure 296:
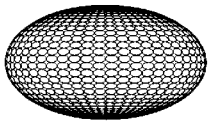
Figure 297:
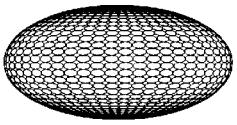
Figure 298:
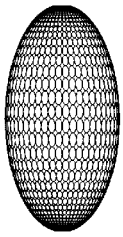
Figure 299:
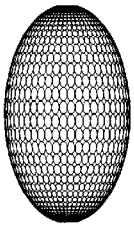
Figure 300:
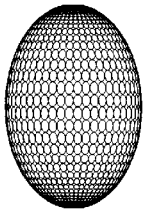
Figure 301:
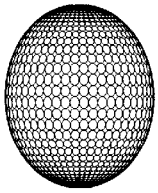
Figure 302:
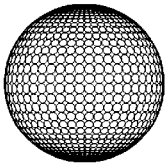
Figure 303:
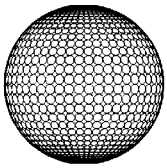
Figure 304:
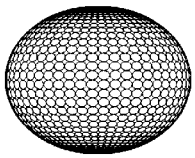
Figure 305:
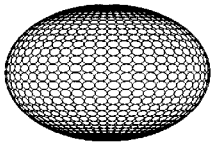
Figure 306:
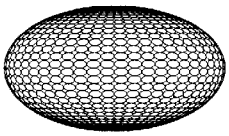
Figure 307:
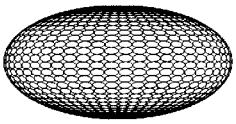

An example of an actuated coupling which can perform a fundamental shifting of shape is shown in FIGS. 282–284, in which a motor 135 rotates a bearing 133 supporting spline grip 132 by the rotational power it delivers to the drive 136 through the use of a transmission 134. When the motor 135 is powered, the spline grips 132 are driven, in a controlled manner to rotate and thus rotate a toroidal element held in a grip, in relation to the body 131 of the coupling, as well as any other torsion or toroidal element held in the other spline grip 132. The manner in which the change in shape of a 20 element array can be effected using such actuated couplings is demonstrated in FIGS. 285–287. Couplings such as those described above and shown in FIGS. 282–284 (but not shown in FIGS. 285–287) would connect the toroidal elements, in the region of closest proximity of the elements, and would cause the angulation of the elements to change with sufficient precision so as to achieve the exact shape and size of the resulting toroid required. Such a change of shape or size could be directed to take place in an organized way for all of the toroidal elements of the structure, including replicated substructures which would result in a change of shape or size of the entire structure. An example of such an operation is shown in the schematic series of FIGS. 288–297, where the frame of the surface of the prolate spheroid (FIG. 288) is transformed in stages (FIGS. 289 and 290) to the frame of the surface of a sphere (FIG. 292) by the changing of the shape of the constituent connected elliptical toroidal elements comprising the frame of the surface of the prolate sphere to more circular toroidal elements. This transformation results in a reduction of the volume bounded by the framework. A further transformation is shown in the schematic series of FIGS. 293–297 where the frame of surface of the sphere (FIGS. 292 and 293) is transformed in stages (FIGS. 294–296) to the frame of the surface of an oblate spheroid (FIG. 297) again by the changing of the shape of the constituent connected circular toroidal elements comprising the frame of the surface of the sphere to elliptical toroidal elements. This transformation results in an increase in the volume bounded by the framework. A similar but isovolumetric pair of transformations is shown in the series of FIGS. 298–307.

This aspect of the present invention thus demonstrated for spheroids is a general property of the structural system. This can be demonstrated further, schematically, with the transformation of a plane array of connected toroidal elements, schematically shown in three views in FIGS. 308–310, to a connected array of toroidal elements in the surface of a paraboloid, also schematically shown in three views in FIGS. 311–313, by a calculated and controlled changing of the shape of the constituent connected toroidal elements comprising the framework of the plane to more elliptical toroidal elements variably to form the framework of the paraboloid. Such shape shifting may be used to alter the shape or size of any array of elements, not only those that provide the framework of surfaces.

While the invention has been disclosed in connection with a preferred embodiment, it will be understood that there is no intention to limit the invention to the particular embodiment shown, but it is intended to cover the various alternative and equivalent constructions included within the spirit and scope of the appended claims.

What I claim as my invention is:

1. A structural system of toroidal elements for structural frameworks of posts, pillars, beams, joists, arches, plates, decks, helixes, and tori which operate as structural members comprising:

(a) a plurality of toroidal elements; and (b) means for connecting toroidal elements without interlinking or intersection of toroidal elements to form a structural framework;

wherein each one of said plurality of toroidal elements is self-supporting as part of said structural framework, without non-toroidal support in the space exterior to and surrounded by the tube of said each one of said plurality of toroidal elements; and wherein the greatest dimension of each toroidal element is greater than the greatest dimension of each connection of said each toroidal element with another of said plurality of toroidal elements.

2. The structural system of claim 1 in which one or more of said plurality of toroidal elements is comprised of a framework of connected toroidal elements.

3. The structural system of claim 1 in which the means for connecting toroidal elements is adjustable so that the position of one or more of the toroidal elements connected by said means for connecting may be changed with respect to other toroidal elements connected to said one or more of the toroidal elements by said means for connecting.

4. The structural system of claim 1 wherein each one of said plurality of toroidal elements is connected to no more than one other of said plurality of toroidal elements in any one connection by said means of connection.

5. The structural system of claim 1 in which two or more of said plurality of toroidal elements are in direct contact with each other within a connection.

6. The structural system of claim 1 wherein each of said plurality of toroidal elements is connected to no more than two other of said plurality of toroidal elements in separate connections with each of said no more than two other of said plurality of toroidal elements.

7. The structural system of claim 1 in which the means for connecting toroidal elements is such that any motion of a toroidal element in a connection will be regulated by the connection.

8. The structural system of claim 1 in which the means for connecting toroidal elements is such that a toroidal element may be moved in a connection and that such movement will be regulated by the connection.

9. The structural system of claim 1 in which the means for connecting toroidal elements is such that a toroidal element may be moved in a connection and that such movement will be regulated by the connection so that the toroidal element will not thereafter have substantial movement in the connection except as regulated by the connection.

10. The structural system of claim 1 in which the means for connecting toroidal elements is such that after a toroidal element is moved in a connection such movement will be regulated by the connection so that the toroidal element will not have substantial movement in the connection except as regulated by the connection.

11. The structural system of claim 1 in which the means for connecting toroidal elements is such that after a toroidal element is moved by a connection in the connection such movement will be regulated by the connection so that the toroidal clement will not have substantial movement in the connection unless again moved by the connection.

12. The structural system of claim 1 in which the means for connecting toroidal elements is such that a toroidal element may be moved by a connection and then held by the connection in the position resulting from such movement so that the toroidal element will not have substantial movement in the connection unless again moved by the connection.

13. The structural system of claim 1 in which the means for connecting toroidal elements is actuated, so that one or more toroidal elements may be moved by a connection and then held by the connection in the position resulting from such movement, so that the toroidal element will not have substantial movement in the connection unless again moved by the connection.

14. A structural system of toroidal elements for constructing non-domical and non-spherical frameworks, comprising: a plurality of toroidal elements which are connected without interlinking or intersection of toroidal elements to form a structural framework, each one of said plurality of toroidal elements being self-supporting as part of the structural framework without non-toroidal support in the space exterior to and surrounded by the tube of said each one of said plurality of toroidal elements, wherein the greatest dimension of each toroidal element is greater than the greatest dimension of each connection of said each toroidal clement with another of said plurality of toroidal elements.

15. The structural system of claim 14 in which one or more of said plurality of toroidal elements is comprised of a framework of connected toroidal elements.

16. The structural system of claim 14 in which one or more connections are adjustable so that the position of one or more of the toroidal elements in such a connection may be changed in such a connection with respect to other toroidal elements in such a connection.

17. The structural system of claim 14 wherein each one of said plurality of toroidal elements is connected to no more than one other of said plurality of toroidal elements in any one connection by said means of connection.

18. The structural system of claim 14 in which two or more of said plurality of toroidal elements are in direct contact with each other within a connection.

19. The structural system of claim 14 wherein each of said plurality of toroidal elements is connected to no more than two other of said plurality of toroidal elements in separate connections with each of said no more than two other of said plurality of toroidal elements.

20. The structural system of claim 14 in which the connections are such that any motion of a toroidal element in a connection will be regulated by and in the connection.

21. The structural system of claim 14 in which the connections are such that a toroidal element may be moved in a connection and that such movement will be regulated by the connection.

22. The structural system of claim 14 in which the connections are such that a toroidal element may be moved in a connection and that such movement will be regulated by the connection so that the toroidal element will not thereafter have substantial movement in the connection except as regulated by the connection.

23. The structural system of claim 14 in which the connections are such that after a toroidal element is moved in a connection such movement will be regulated by the connection so that the toroidal element will not have substantial movement in the connection except as regulated by the connection.

24. The structural system of claim 14 in which the connections are such that after a toroidal element is moved by a connection in the connection such movement will be regulated by the connection so that the toroidal element will not have substantial movement in the connection unless again moved by the connection.

25. The structural system of claim 14 in which the connections are such that a toroidal element may be moved by a connection and then held by the connection in the position resulting from such movement so that the toroidal element will not have substantial movement in the connection unless again moved by the connection.

26. The structural system of claim 14 in which one or more connections are actuated so that one or more toroidal elements may be moved by a connection and then held by the connection in the position resulting from such movement so that the toroidal element will not have substantial movement in the connection unless again moved by the connection.

27. The structural system of claim 14 in which the non-domical and non-spherical framework structures may range in size from nanostructures to an extremely large scale.

28. A structural system of toroidal structural elements for tower, domical and spherical structures comprising: a plurality of toroidal elements which are connected without interlinking or intersection of toroidal elements to form a plurality of level layers of toroidal elements in closed courses, wherein said level layers of toroidal elements are arranged and connected in a stack; wherein each one of said plurality of toroidal elements is self-supporting as part of said structures, without non-toroidal support in the space exterior to and surrounded by the tube of said each one of said plurality of toroidal elements; and wherein the greatest dimension of each toroidal element is greater than the greatest dimension of each connection of said each toroidal element with another of said plurality of toroidal elements.

29. The structural system of claim 28 wherein one or more of said plurality of toroidal elements is comprised of a framework of connected toroidal elements.

30. The structural system of claim 28 wherein each of said level layers has the same number of toroidal elements.

31. The structural system of claim 28 wherein the toroidal elements comprising said level layers have the same size within each layer.

32. The structural system of claim 28 wherein each of said level layers has the same size and shape.

33. The structural system of claim 28 wherein the toroidal elements comprising said level layers have the same size from layer to layer.

34. The structural system of claim 28 wherein each of the toroidal elements comprising one of said level layers in the stack is connected to one of the toroidal elements comprising one of the other adjacent level layers in the stack.

35. The structural system in claim 28 wherein one or more of said level layers have a conical shape.

36. The structural system in claim 28 wherein the size of one or more of said level layers is smaller than another of said level layers which are adjacent to said one or more of said layers.

37. The structural system in claim 28 wherein each of said level layers have a conical shape, and the solid angle of such conical shapes is the same from layer to layer in the stack.

38. The structural system in claim 28 wherein each of said level layers have a conical shape, and the solid angle of such conical shapes increases from the first of said level layers in the stack to the last of said level layers in the stack.

39. The structural system of claim 28 further comprising structural means for making said toroidal elements self-supporting.

40. The structural system of claim 28 further comprising one or more intermediate longitudinal toroidal elements, wherein one or more of the toroidal elements included in said level layers are connected to said one or more intermediate longitudinal toroidal elements.

41. The structural system of claim 28 wherein the level layers which are adjacent in the stack are arranged so that each toroidal element in one of said adjacent level layers is connected to one of the toroidal elements in the other of said adjacent level layers.

42. The structural system of claim 28 further comprising a means for making said toroidal elements self-supporting.

43. A spherical structure of toroidal elements comprising: a plurality of toroidal elements of substantially the same size arranged in the planes of the surfaces of an imaginary regular poyhedron, which are connected without interlinking or intersection of toroidal elements to form a structural framework, each one of said plurality of toroidal elements being self-supporting as part of the spherical structure without non-toroidal support in the space exterior to and surrounded by the tube of said each one of said plurality of toroidal elements; wherein the greatest dimension of each toroidal element is greater than the greatest dimension of each connection of said each toroidal element with another of said plurality of toroidal elements.

44. The spherical structure of claim 43 wherein said plurality of toroidal elements lie in the surface of the spherical structure.

45. The spherical structure of claim 43 further comprising one or more, additional toroidal elements connected to said plurality of toroidal elements, wherein said one or more additional toroidal elements lie in the surface of the spherical structure, so that said one or more additional toroidal elements bridge one or more spaces between two or more of said plurality of toroidal elements in the surface of the spherical structure.

46. The spherical structure of claim 43 further comprising one or more toroidal elements within the spherical structure are connected to two or more of said plurality of toroidal elements, so that said one or more toroidal elements within the spherical structure reinforce the spherical structure from within.

47. A structural system of toroidal elements for tower, domical and spherical structures comprising: a plurality of toroidal elements which are connected to form a plurality of level layers of toroidal elements in closed courses, wherein the connections between said plurality of toroidal elements are not the result of interlinking or intersection of toroidal elements; wherein said level layers of toroidal elements are arranged and connected in a stack; and wherein the size of all the toroidal elements comprising one of said level layers is smaller than the size of the toroidal elements comprising another of said level layers which are adjacent to said one of said level layers.

48. A structural system of toroidal elements comprising: a plurality of toroidal elements which are connected without interlinking or intersection of toroidal elements to form a structural framework; wherein each one of said plurality of toroidal elements is self-supporting as part of said structural framework without non-toroidal support in the space exterior to and surrounded by the tube of said each one of said plurality of toroidal elements; and wherein the greatest dimension of each toroidal element is greater than the greatest dimension of each connection of said each toroidal element with another of said plurality of toroidal elements.

49. A structural system of toroidal elements comprising: a plurality of toroidal elements which are connected without interlinking or intersection of toroidal elements to form a structural framework; wherein each one of said plurality of toroidal elements is self-supporting as part of said structural framework without non-toroidal support in the space exterior to and surrounded by the tube of said each one of said plurality of toroidal elements; wherein the greatest dimension of each toroidal element is greater than the greatest dimension of each connection of said each toroidal element with another of said plurality of toroidal elements; and wherein one or more of said plurality of toroidal elements is comprised of a framework of connected toroidal elements.

50. A structural system of toroidal elements for tower, domical and spherical structures comprising: a plurality of toroidal elements which are connected to form a plurality of level layers of toroidal elements in closed courses, wherein the connections between said plurality of toroidal elements are not the result of interlinking or intersection of toroidal elements; wherein said level layers of toroidal elements are arranged and connected in a stack; and wherein the level layers which are adjacent in the stack are interleaved so that each toroidal element in one of said adjacent level layers is connected to two of the toroidal elements in the other of said adjacent level layers.

51. A structural system of toroidal elements for tower, domical and spherical structures comprising: a plurality of toroidal elements which are connected to form a plurality of level layers of toroidal elements in closed courses, wherein the connections between said plurality of toroidal elements are not the result of interlinking or intersection of toroidal elements; wherein said level layers of toroidal elements are arranged and connected in a stack; and wherein the toroidal elements in adjacent level layers in the stack arc arranged so that each toroidal element in one of said adjacent level layers is connected to two of the toroidal elements in the other of said adjacent level layers; whereby said level layers are interleaved.

* * * * *